US006848925B2

(12) United States Patent
Nishide

(10) Patent No.: US 6,848,925 B2
(45) Date of Patent: Feb. 1, 2005

(54) CONNECTOR ASSEMBLY, CONNECTOR, CONNECTOR ASSEMBLING CONSTRUCTION AND METHOD OF ASSEMBLING THEM

(75) Inventor: Satoru Nishide, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/665,328

(22) Filed: Sep. 18, 2003

(65) Prior Publication Data

US 2004/0077197 A1 Apr. 22, 2004

(30) Foreign Application Priority Data

| | | |
|---|---|---|
| Sep. 19, 2002 | (JP) | 2002-273617 |
| Sep. 20, 2002 | (JP) | 2002-275145 |
| Sep. 25, 2002 | (JP) | 2002-279546 |
| Jan. 7, 2003 | (JP) | 2003-001519 |

(51) Int. Cl.[7] ..... H01R 13/64

(52) U.S. Cl. ..... 439/247; 439/34; 439/157; 439/374

(58) Field of Search ..... 439/245–248, 439/157, 34, 374–376

(56) References Cited

U.S. PATENT DOCUMENTS

| | | | | |
|---|---|---|---|---|
| 4,963,098 A | | 10/1990 | Myer et al. | |
| 4,978,313 A | | 12/1990 | Kameyama et al. | |
| 5,252,087 A | | 10/1993 | Spinnato et al. | |
| 5,263,871 A | | 11/1993 | Sano | |
| 5,975,933 A | | 11/1999 | Yamaguchi et al. | |
| 6,174,185 B1 | * | 1/2001 | Cecil, Jr. | 439/248 |
| 6,254,408 B1 | * | 7/2001 | Hattori et al. | 439/157 |
| 6,325,652 B1 | * | 12/2001 | Grant | 439/248 |
| 6,435,891 B1 | * | 8/2002 | Beck et al. | 439/248 |

FOREIGN PATENT DOCUMENTS

| | | |
|---|---|---|
| JP | 2001-150979 | 6/2001 |

* cited by examiner

*Primary Examiner*—Truc T. Nguyen
(74) *Attorney, Agent, or Firm*—Gerald E. Hespos; Anhony J. Casella

(57) ABSTRACT

An object of the present invention is to miniaturize a connector assembly upon providing a means for taking up a displacement between connectors. A module M is provided with guide rails (32) extending in vertical direction intersecting with a connecting direction of a male and a female connectors (10), (40), and guidable portions (27F, 27R) provided on the male connector (10) are engaged with the guide rails (32) to be relatively movable along the longitudinal direction of the guide rails (32). If the connectors (10, 40) are vertically displaced or inclined, the guidable portions (27F, 27R) move along the guide rails (32), whereby a displacement between the connectors (10, 40) is taken up.

7 Claims, 45 Drawing Sheets

360
342
361
362
331
330
320
323
325
351
350
334
346
365
336
332
321
TD
CD

CONNECTOR ASSEMBLY, CONNECTOR, CONNECTOR ASSEMBLING CONSTRUCTION AND METHOD OF ASSEMBLING THEM

BACKGROUND OF THE INVENTION

1. Field of the Invention

The invention relates to a connector and to a method of assembling connectors, such as the connector of an instrument panel module and a body-side connector of an automotive vehicle.

2. Description of the Related Art

Japanese Unexamined Patent Publication No. 2001-150979 discloses a construction for reducing the number of operation steps required to connect a module-side connector, such as the connector of an instrument panel, with a body-side connector in an automotive vehicle. The construction includes a floating mechanism that enables at least one of the connectors to be displaced in a direction intersecting a connecting direction with respect to the module or the body to correct a possible displacement between the connectors. For example, the floating mechanism may employ springs to support the connector resiliently in a frame on the module or the body. The frame, the spring pieces and the connector housing may be molded integrally from a synthetic resin into a resilient supporting means. The connector is positioned with the mating connector by resiliently deforming the springs and displacing the connector housing.

However, the springs of the above-described connector must be arranged in pairs at opposite sides of the connector housing. This necessarily enlarges the frame.

The connecting construction may include a female connector that is fitted into a receptacle of the male connector. A guiding portion is formed at the leading end of the receptacle of the male connector and is slanted to wider dimensions toward the front to correct for such a displacement. The guiding portion surrounds the peripheral edge of the rear surface of the female connector when the two connectors are connected. The female connector may require a mounting portion for fixed engagement with a bracket of the body or the module. The mounting portion is provided on the rear surface of the female connector so as not to interfere with the receptacle when the two connectors are connected. Wires are drawn out through the rear surface of the female connector. Thus, the mounting portion must project back normal to the rear surface of the female connector from a peripheral portion of the rear surface of the female connector to avoid interference with the wires and the guiding portion. However, the backwardly projecting mounting portion enlarges the female connector in forward and backward directions. Further, the mounting portion extends along a wire draw-out path and hinders the insertion of terminal fittings and the wires into the female connector from behind.

The module is assembled with the body by moving the module, and the two connectors are connected at the end of this movement. However, the module may slide slightly in a direction intersecting the connecting direction after the start of the connecting operation. As a result, the module may get caught and partly locked by a bracket of the body.

A floating mechanism is provided to displace at least one of the connectors with respect to its mount base on the module or body. Thus, the module can slide with respect to the body in a direction intersecting with the connecting direction of the connectors while holding the two connectors connected. A sliding distance of the module preferably is long to ensure a large area of engagement of the module and the bracket. Accordingly, a floating distance of the floating mechanism needs to be increased to ensure a sufficient sliding distance of the module. The above-described guiding portion can correct displacement between the connectors. The dimensions of the guiding portion are determined by a maximum possible displacement between the connectors, and the guiding portion needs to be enlarged as the displacement increases.

The above-described floating mechanism moves the module horizontally and enables the connector to be displaced with respect to the mount base in a direction intersecting the connecting direction before the connection of the two connectors is started. As a result the two connectors may be relatively displaced. The guiding portion corrects such a displacement during the connector of the two connectors.

However, the longer the floating stroke of the floating mechanism, the larger the displacement between the two connectors, and the larger the displacement, the larger the guiding portion. Thus, the guiding portion needs to be enlarged as the floating stroke becomes longer. The increased area of engagement of the module and the bracket achieves a desirably longer floating distance. However, this causes a problem of enlarging the guiding portion.

U.S. Pat. No. 5,263,871 and FIG. 45 herein disclose a connector connecting construction for assembling an instrument panel with a dashboard. The construction includes a waiting-side connector 1 mounted on the dashboard and a movable connector 2 mounted on the instrument panel. A resin bracket 3 is secured to the dashboard, and a flange 4 of the waiting-side connector 1 is engageable with four resilient supporting pieces 5 provided respectively at the upper, lower, left and right sides of the bracket 3. The waiting-side connector 1 and the movable connector 2 can be displaced during assembly of the instrument panel with the dashboard by resiliently deforming the respective resilient supporting pieces 5. Thus, the waiting-side connector 1 can be displaced normal to the connecting direction of the connectors 1, 2 so that the two connectors 1, 2 can be positioned properly.

However, the resilient supporting pieces 5 must be deformed resiliently in a process of positioning the two connectors. This increases a force necessary for assembling, and results in poor operability.

In view of the above problem, an object of the present invention is to allow a miniaturization of a connector assembly particularly upon providing a means for taking up a displacement between connectors.

SUMMARY OF THE INVENTION

The invention relates to an assembly for connecting a module-side connector and a body-side connector. The module-side connector may be part of a module, such as an instrument panel and the body-side connector may be part of an automotive vehicle. At least one of the module and the body has at least one guide rail that intersects a connecting direction of the connector. Additionally, the connector of the module or the body that has the guide rail includes at least one guidable portion that is engageable with the guide rail for movement along the longitudinal direction of the guide rail.

The two connectors could be displaced in a direction that intersects the connecting direction. In this situation, the guidable portion moves along the guide rail to take up the displacement between the connectors. Spring pieces for resiliently supporting the connector need not be provided at the opposite sides of the connector according to the present invention. Thus, the assembly can be made smaller by as much as the absence of the spring pieces.

The guidable portion may be inclinable in along an inclination direction with respect to the guide rail substantially about an axis that intersects both the longitudinal direction of the guide rail and the connecting direction of the connectors. Thus, the assembly can accommodate displacements resulting from parallel movements intersecting the connecting direction and movements resulting from inclinations in directions oblique to the connecting direction.

The guide rail preferably is rib-shaped, and two guidable portions hold the guide rail from opposite sides. The guidable portions may curve so that a space between the guidable portions is shortest at a contact position with the guide rail. Thus, a maximum angle of pivotal displacement of the connector can be restricted by bringing a portion of the guidable portion distanced from a supporting point of the pivotal displacement into contact with the guide rail.

One of the module-side connector and the body-side connector may include a receptacle into which the other connector is fittable, and a slanted diverging guiding portion may be formed near an opening of the receptacle. The slanted guiding portion corrects the relative positions of two displaced connectors automatically without manually correcting the position and posture of the connector. Thus, the two connectors can be connected properly.

The invention also relates to a method for connecting a module-side connector, such as the connector of an instrument panel, and a body-side connector on a body of an automotive vehicle. The method comprises providing a guide rail on at least one of the module and the body. The guide rail preferably extends in a direction intersecting the connecting direction of the connectors. The method also comprises providing a guidable portion on at least one of the connectors for engaging the guide rail. The method then comprises engaging the guidable portion with the guide rail for movement along the longitudinal direction of the guide rail.

The method may comprise inclining the guidable portion in an inclination direction about an axis intersecting both the longitudinal direction of the guide rail and the connecting direction of the connectors.

The method may also comprise holding the guide rail from opposite sides by guidable portions that curve or bend so that a spacing therebetween is shortest at a contact position with the guide rail.

A receptacle preferably is provided on one of the module-side connector and the body-side connector and has a diverging guide near an opening of the receptacle. The method then comprises inserting the other connector into the diverging portion of the receptacle.

The invention also relates to a connector with the above-described assembly. The connector comprises a mounting portion at a rear side of the connector for fixing the connector to the module or the body. The connector also has a wire cover for at least partly covering the rear surface of the connector. Wires are drawn out from the rear side of the connector and are bent to extend substantially along the rear surface of the connector. The mounting portion is formed on the rear surface of the wire cover. Accordingly, the mounting portion does not enlarge the connector and does not reduce efficiency during insertion of terminal fittings into the connector.

The mounting portion on the rear surface of the wire cover takes up less room than a mounting portion that projects back beyond the rear surface of the wire cover. Further, the mounting portion does not hinder the insertion of the terminal fittings if the wire cover is left detached from the connector. The wire cover is mounted to cover the rear surface of the connector with the connector engaged with a mating connector. Thus, a guiding portion on the mating connector and the wire cover will not interfere with each other.

The mounting portion preferably is formed by at least one rib extending along the rear surface of the wire cover.

The rear surface of the wire cover may be pressed against the module or the body while connecting the connector with a mating connector, and may create a force that acts to open the side wall of the wire cover outward. However, the connector preferably comprises at least one outward-displacement restricting portion for contacting a sidewall of the wire cover from outside and restricting an outward displacement of the sidewall.

The outward-displacement restricting portion preferably is at least partly accommodated in a recess formed in the outer surface of the sidewall of the wire cover. The recess prevents the outward-displacement restricting portion from being deformed or damaged by interference with external matter.

The invention also relates to a connector assembly comprising the above-described first connector and a second connector, one of which is a module-side connector and the other of which is a body-side connector, as described above. The second connector has a receptacle for receiving the first connector. A guiding portion preferably is formed near an opening edge of the receptacle for correcting a displacement between the connectors.

The connector assembly may also comprise a floating mechanism to support at least one of the connectors in such a manner that the connector is relatively displaceable in the direction intersecting with the connector connecting direction with respect to the module or the body on which the connector is mounted. The floating mechanism preferably comprises a restricting means for restricting a relative displacement of the connector when the connectors are unconnected and canceling the restriction on the displacement after the connection of the connectors is started. Accordingly, the guiding portion does not have to be enlarged to ensure a large floating distance for correcting displacement. The connector assembly is permitted to make a maximum relative displacement with respect to the module or the body in the floating mechanism because the restriction by the restricting means is canceled after the connection of the connectors is started.

The floating mechanism preferably comprises a guide rail on the module or the body and extending along a direction intersecting the connecting direction of the first and second connectors, and a floating member movable substantially along the guide rail while supporting the connector.

The restricting means preferably comprises a displacing means for displacing the connector substantially in the same direction as the connecting direction with respect to the floating member as the connection of the first and second connectors progresses. The restricting means also preferably comprises contact means on the floating member and the connector. Thus, a movement of the floating member along the guide rail is restricted by the mutual contact of the contact means with the first and second connectors unconnected. However, the contact means disengage to cancel the restriction on the movement of the floating member along the guide rail when the connector is displaced with respect to the floating member as the connection of the two connectors progresses. Thus, the floating member and the connector supported on the floating member are permitted to make large movements.

The invention also relates to a connector connecting construction for connecting a movable connector with a waiting-side connector to be mounted on a fixed member. One of the waiting-side connector and the fixed member comprises a first supporting member extending in a direction intersecting a connecting direction and slidably supporting the respective connect substantially along an extending direction thereof.

In a process of connecting the movable connector with the waiting-side connector mounted on the fixed member, the two connectors are substantially aligned with each other by sliding the respective connector along the supporting member in the direction intersecting the connecting direction.

Sliding the waiting-side connector in this way substantially aligns the two connectors. Thus, it is not necessary to resiliently deform resilient supporting pieces, as in the prior art. Thus, a force necessary for the connection can be relatively small.

The movable connector preferably is mounted on an assembling member to be assembled with the fixed member. The two connectors are connected as the assembling member is assembled with the fixed member, and one of the movable connector and the assembling member comprises a second supporting member extending in a direction intersecting the connecting direction and substantially normal to a sliding direction of the waiting-side connector and slidably supporting the movable connector along an extending direction thereof.

The connectors are aligned with each other by sliding the waiting-side connector along the first supporting member and sliding the movable connector along the second supporting member in the direction substantially normal to the sliding direction of the waiting-side connector. The connectors are aligned by being displaced in the directions substantially normal to each other. Thus, alignment precision is higher and connection resistance is reduced.

Preferably, the first supporting member is a guide rail extending substantially straight along a direction substantially normal to the connecting direction and a guidable portion is slidable along the guide rail while holding the guide rail from front and back sides with respect to the connecting direction. Thus, the connector can be slid without shaking along the connecting direction.

One of the waiting-side connector and the movable connector preferably includes a receptacle for receiving the mating connector. The receptacle has a guide surface for guiding the mating connector for substantial alignment. A restricting means is provided to restrict a slidable area of the waiting-side connector or the movable connector permitted by the supporting member within a guidable area by the guide surface of the receptacle.

The two connectors may be displaced. However, the mating connector to be fit into the receptacle slides in contact with the guide surface in the connecting process. Thus, the mating connector slides along the supporting member to align the connectors as the connection progresses.

The waiting-side connector or the movable connector is located in the guidable area by the restricting means regardless of its position in the slidable area. Thus, the two connectors can be aligned securely with each other in the connecting process.

The waiting-side connector preferably is mounted on the fixed member with a connecting surface thereof faced up and the movable connector is mounted on the assembling member with a connecting surface faced down.

The movable connector is connected with the waiting-side connector by displacing the assembling member down with respect to the fixed member.

The weight of the assembling member acts as a connecting force for connecting the connectors. Thus, a burden on an operator can be reduced.

The invention also relates to a method for connecting a movable connector with a waiting-side connector to be mounted on a fixed member. The method comprises providing one of the waiting-side connector and the fixed member with a first supporting member extending in a direction intersecting with a connecting direction and slidably supporting the respective connector substantially along an extending direction of the first supporting member.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector assembly according to a first embodiment of the invention is identified by the letter C in FIGS. 1 to 6. The connector C is designed to connect male and female connectors 10 and 40. The male connector 10 is provided on a module M, such as an instrument panel, and the female connector 40 is provided on a body B of an automotive vehicle. The module M is moved substantially horizontally and is guided by an unillustrated guiding means during assembly with the body B. Thus, the two connectors 10, 40 are connected in a substantially horizontal connection direction CD. In the following description, a mating side of the connectors 10, 40 is referred to as the front.

Figure 1:
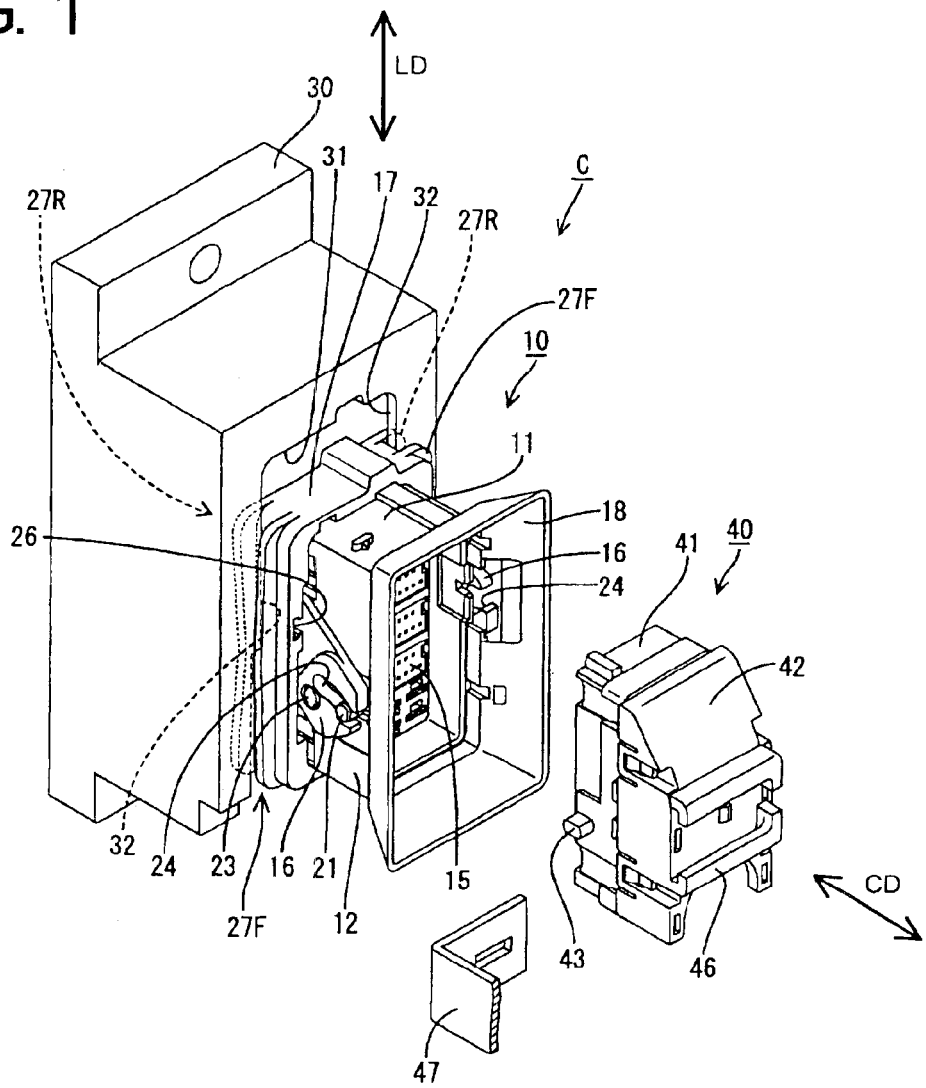
FIG. 1 is a perspective view showing a state where male and female connectors are separated.
Figure 2:
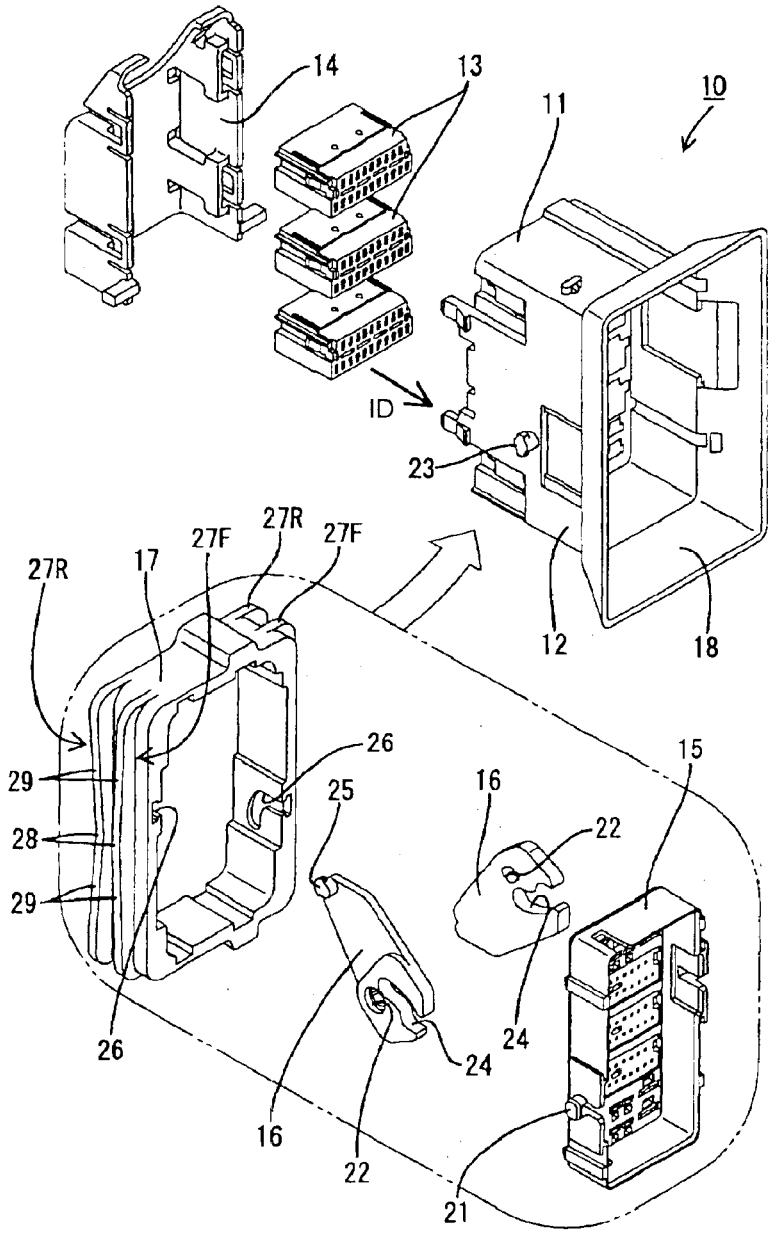
FIG. 2 is an exploded perspective view of the male connector.

The male connector 10 includes a housing 11 having a forwardly open substantially rectangular receptacle 12. With reference to FIG. 2, auxiliary connectors 13 are mountable from behind into the housing 11 from an inserting direction ID, which is parallel to the connecting direction CD. A wire cover 14 is mounted on the rear surface of the housing 11 and a moving plate 15 is provided in the receptacle 12 for movement forward and backward substantially along the connecting direction CD. Two levers 16 are supported for rotation on the left and right outer surfaces of the housing 11, and a frame 17 is fit on the housing 11 for movement forward and backward substantially along the connecting direction CD.

A guiding portion 18 is formed at the front opening edge of the receptacle 12 of the housing 11 and is slanted to be wider toward the front. The peripheral edge of the front end of the female connector 40 can contact the slanted inner surface of the guiding portion 18 to correct any displacement that may exist as the female connector 40 is fit into the receptacle 12.

Figure 6A:
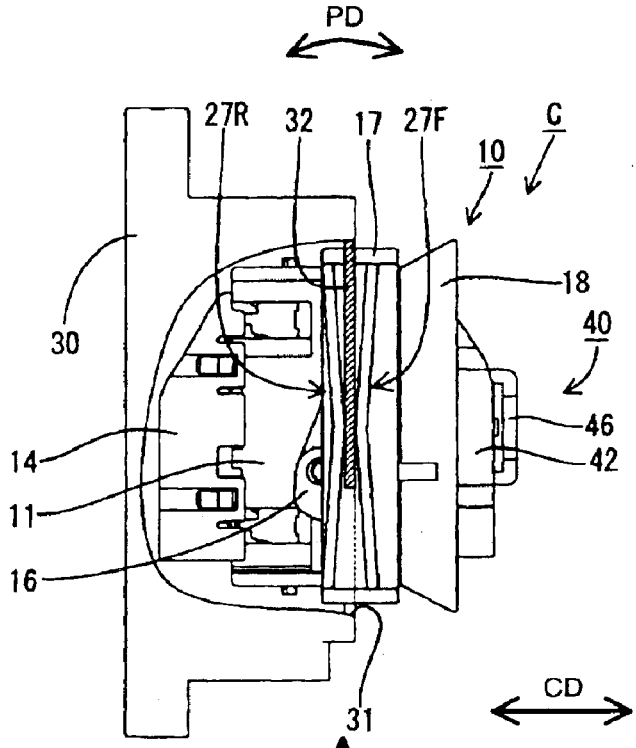
FIGS. 6(*a*) and 6(*b*) are a side view partly in section and a section showing a state where the two connectors are connected.
Figure 6B:
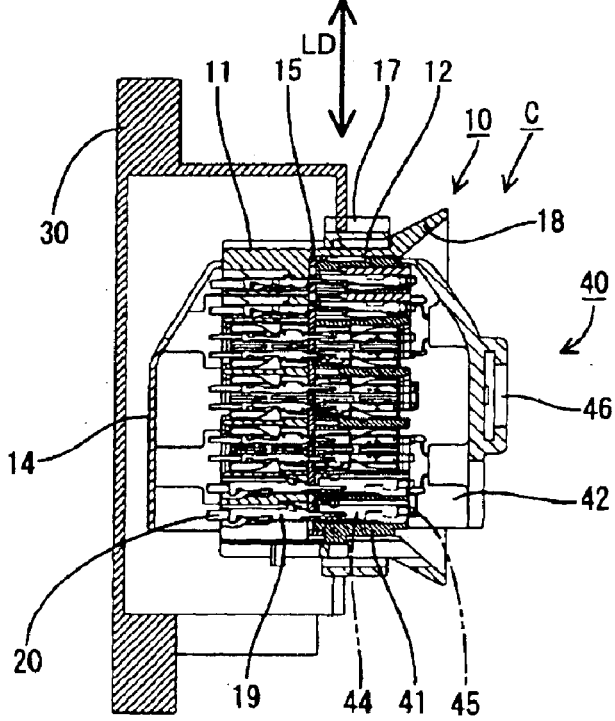
Figure 7:
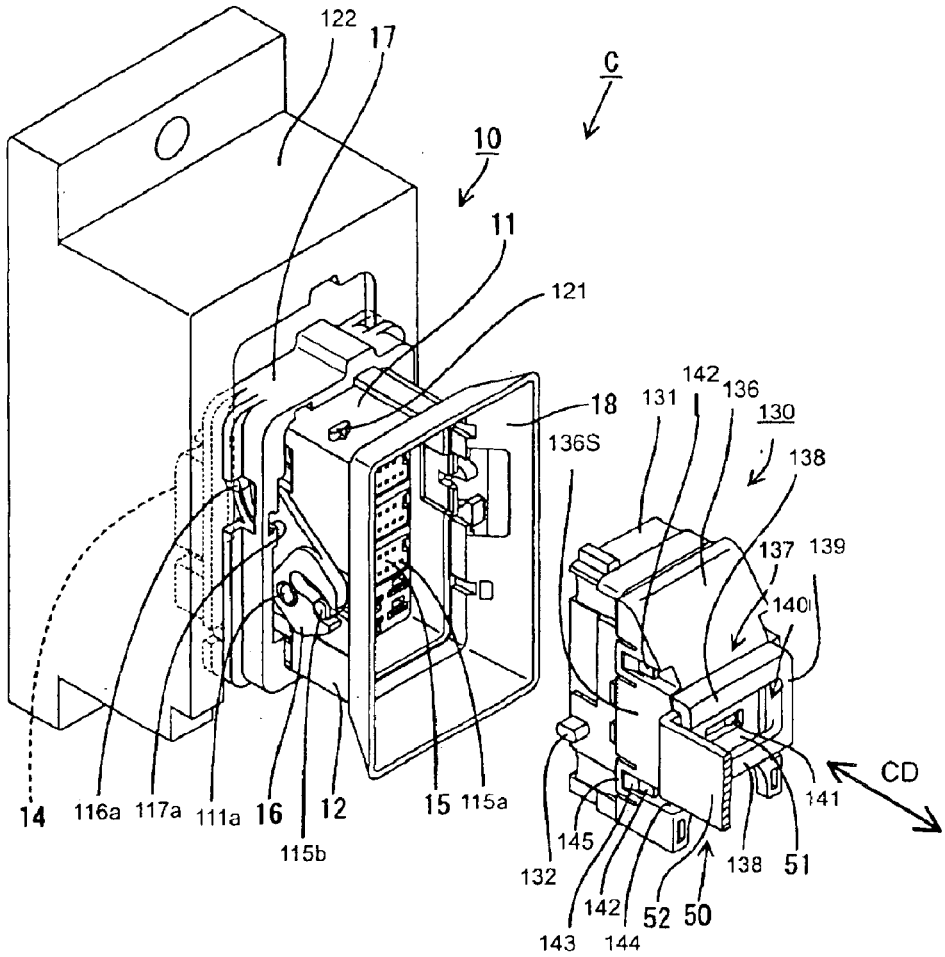
FIG. 7 is a perspective view showing a state where a male and a female connectors are separated in a second embodiment of the invention.
Figure 8:
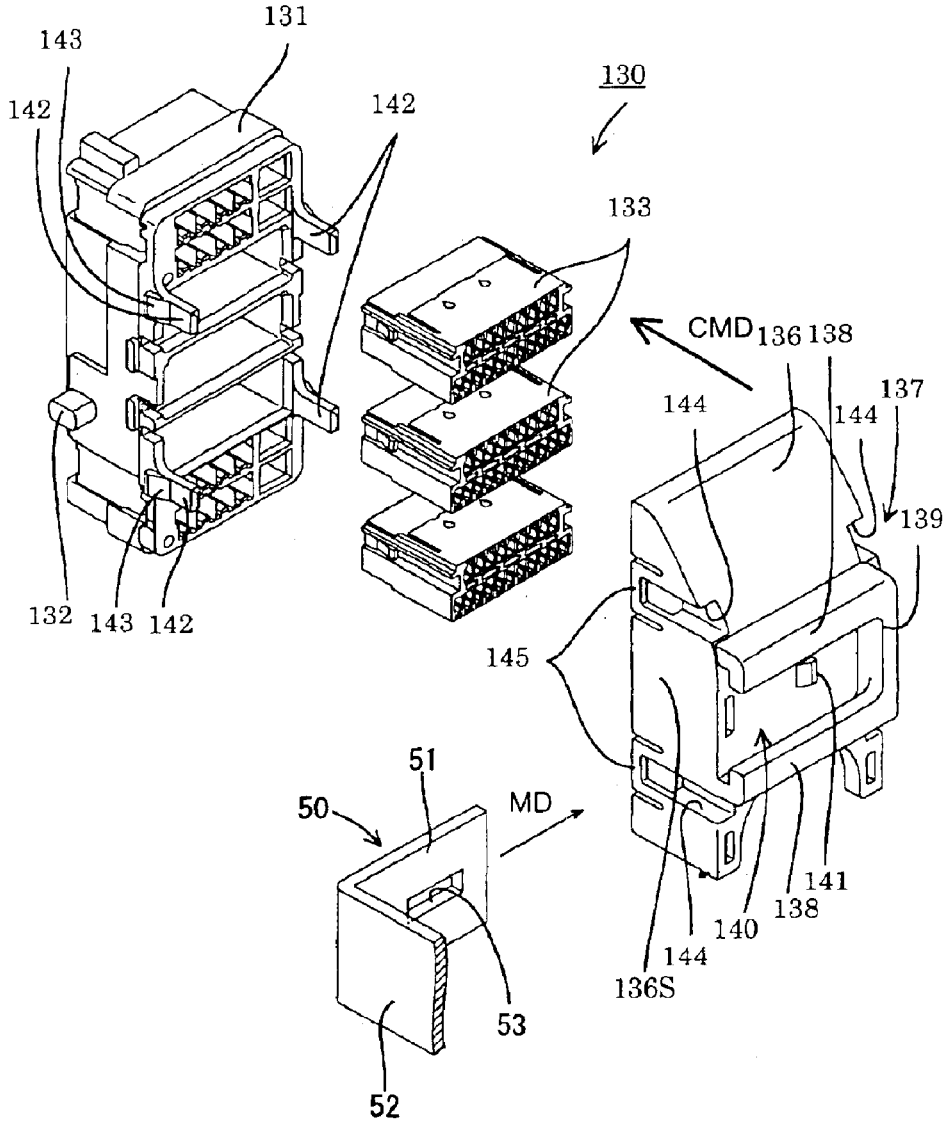
FIG. 8 is an exploded perspective view of the female connector.
Figure 9:
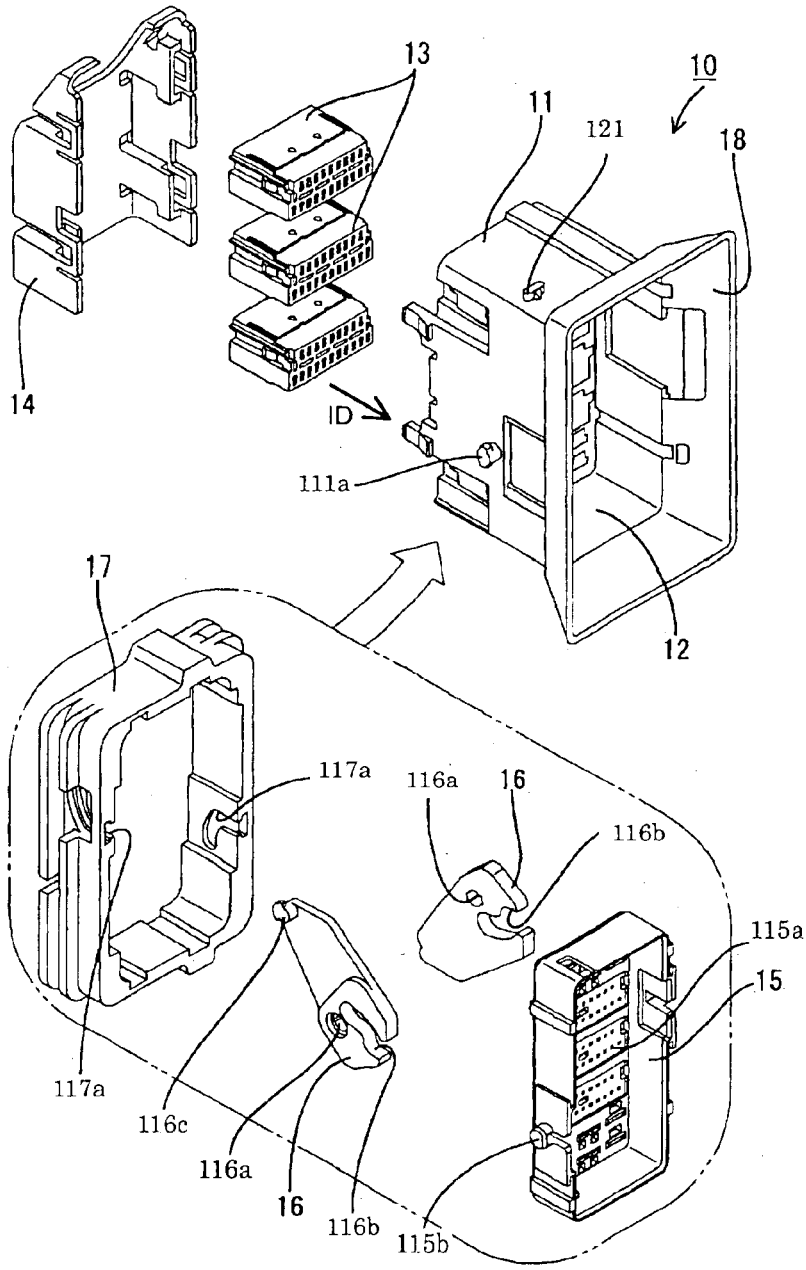
FIG. 9 is an exploded perspective view of the male connector.
Figure 10:
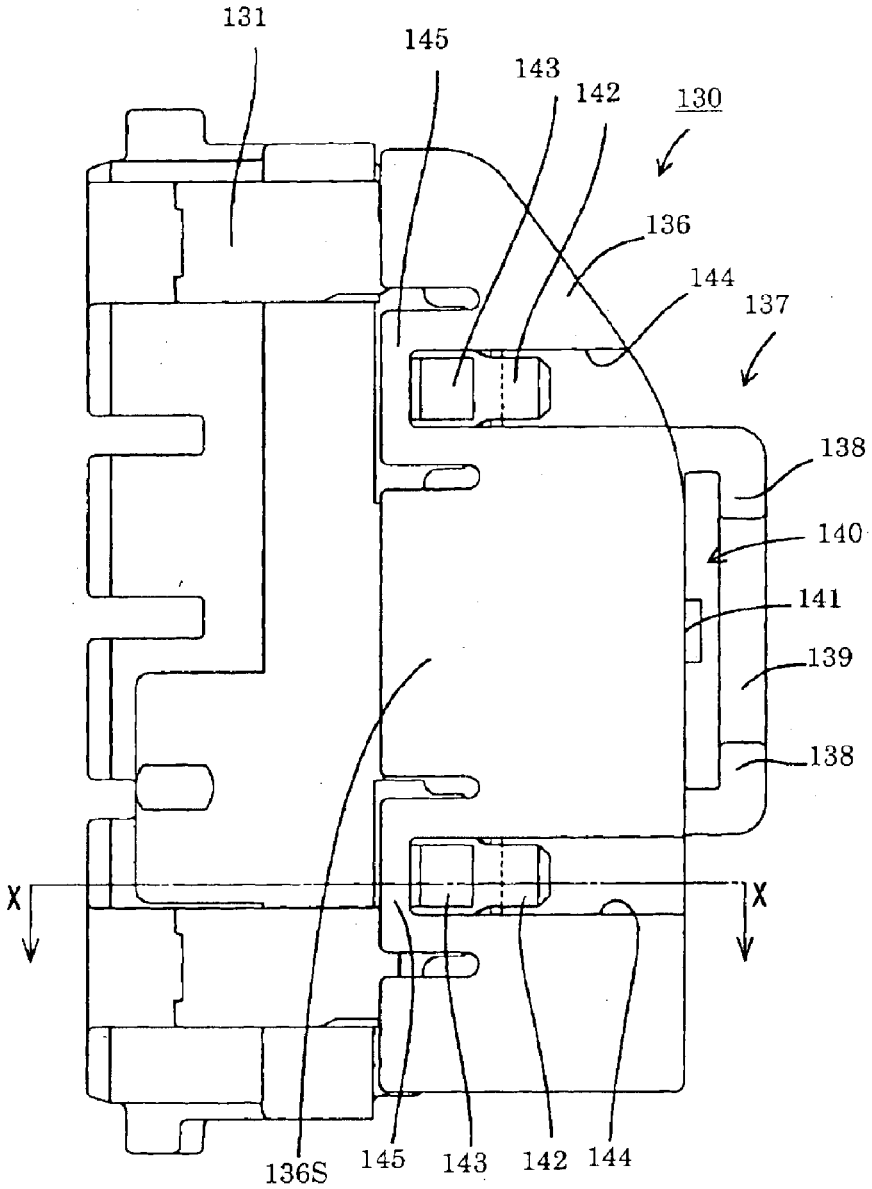
FIG. 10 is a side view of the female connector.
Figure 11:
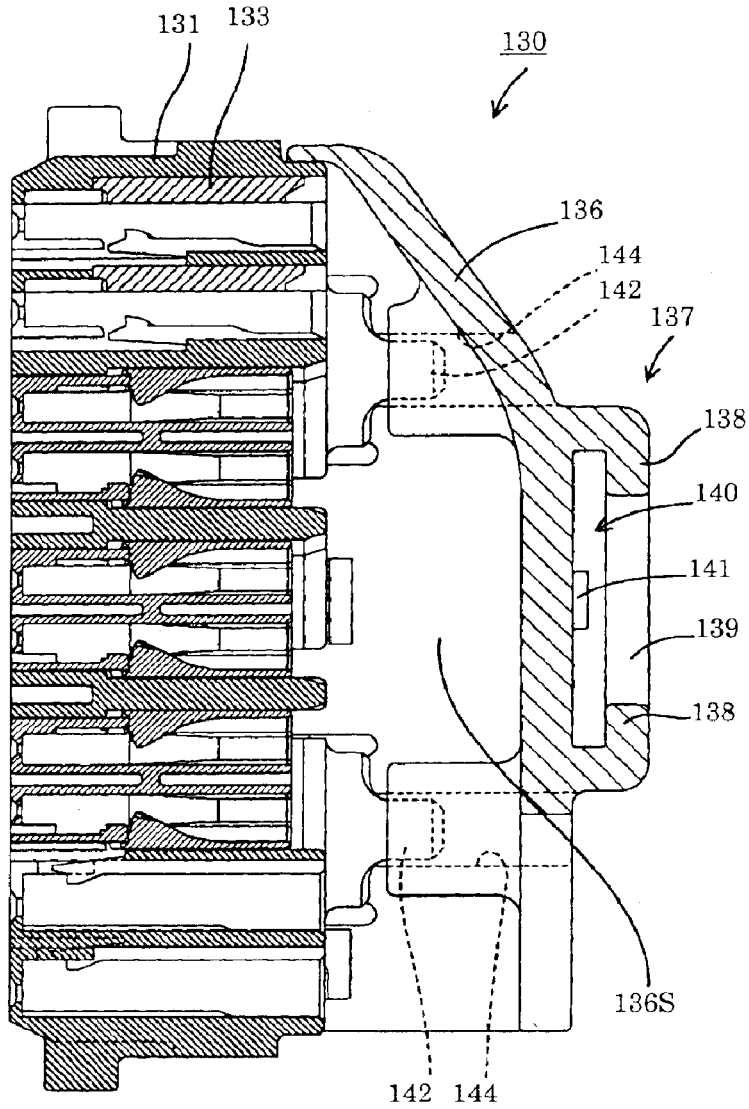
FIG. 11 is a vertical section of the female connector.
Figure 12:
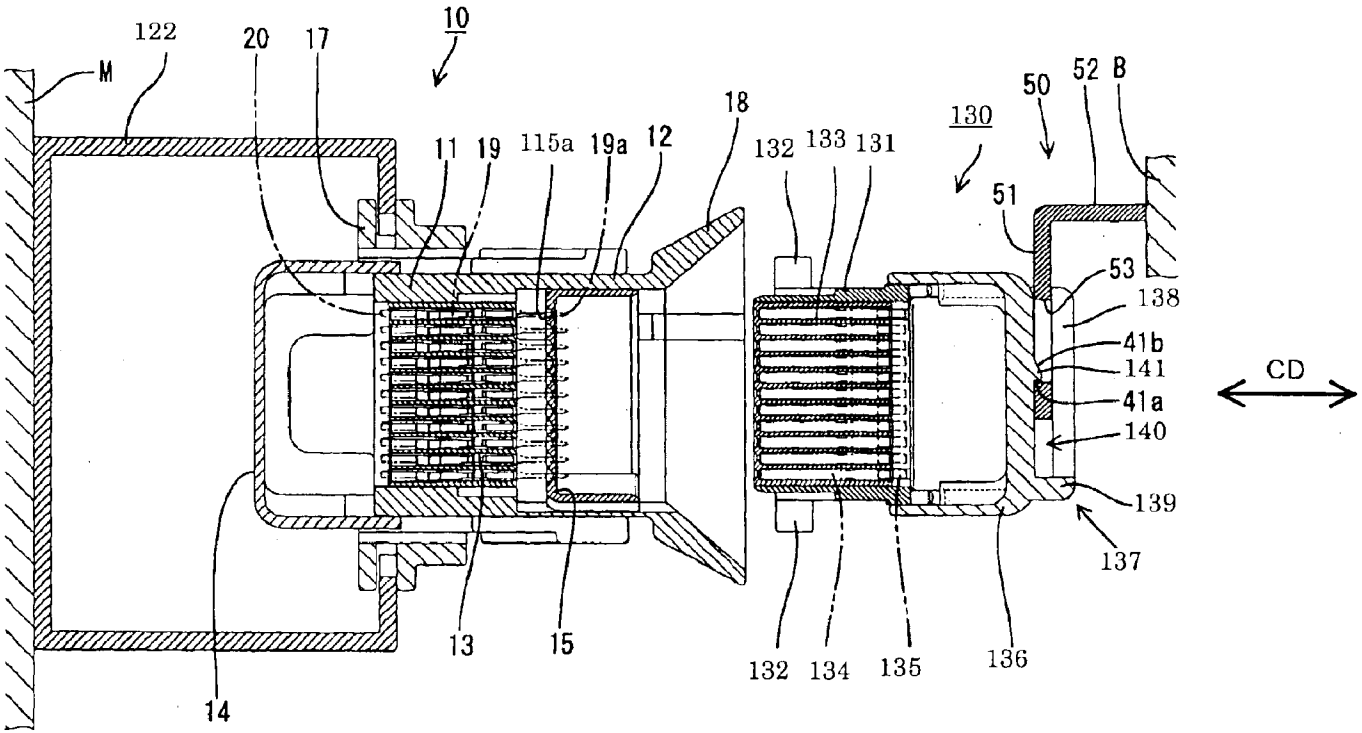
FIG. 12 is a horizontal section viewed from below showing a state where the male and female connectors are separated.
Figure 13:
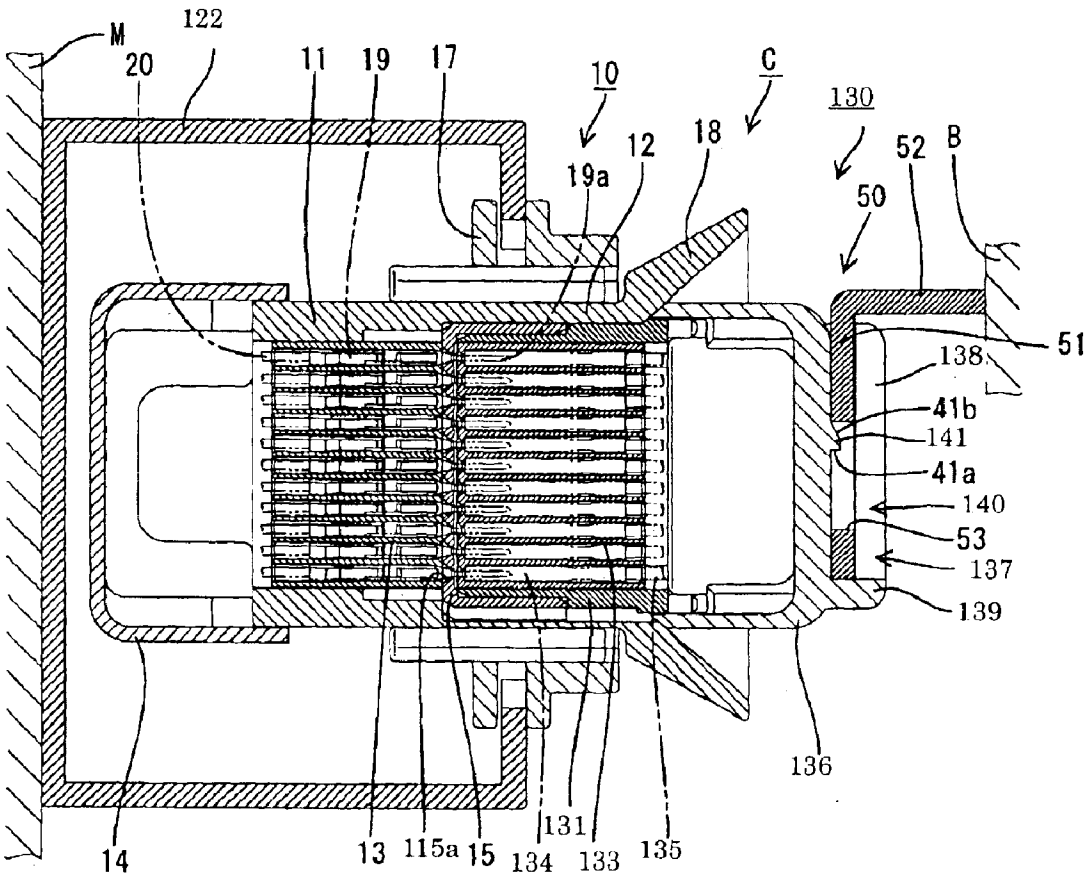
FIG. 13 is a horizontal section viewed from below showing a state where the male and female connectors are connected.
Figure 14:
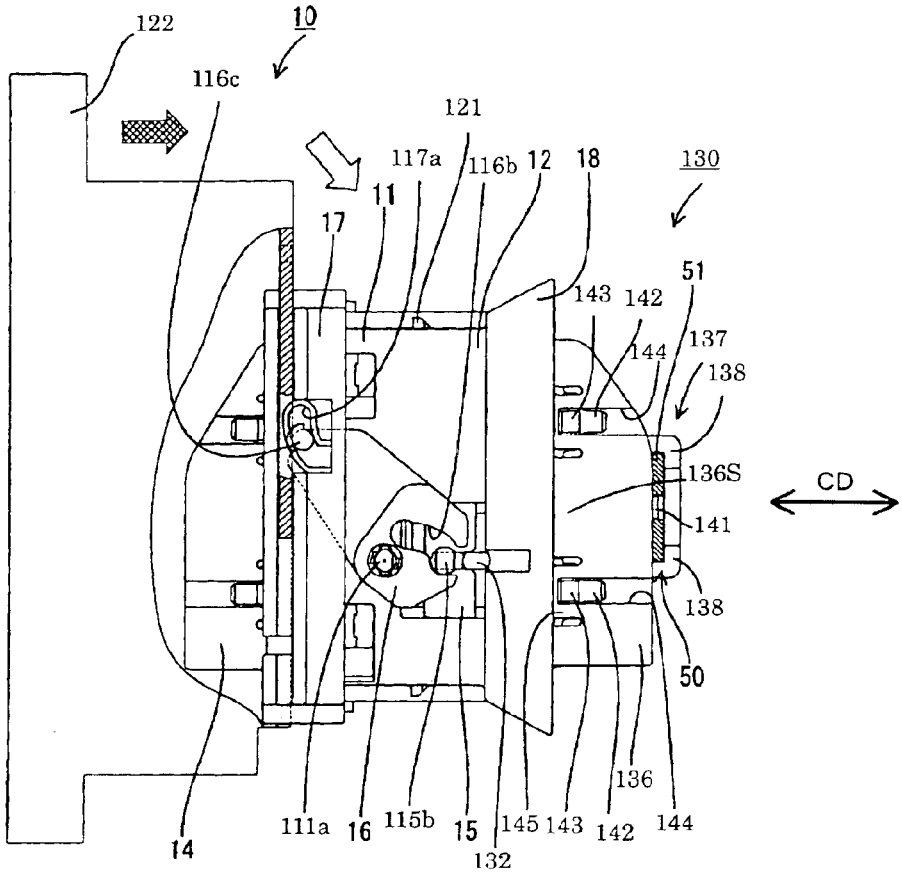
FIG. 14 is a side view partly in section showing an intermediate stage of connection of the male and female connectors.

Male terminal fittings 19 are connected with wires 20 and are inserted into the auxiliary connectors 13 in the housing 11, as shown in FIG. 6(*b*). The wires 20 are drawn out through the rear of the auxiliary connectors 13 and are bent down in the wire cover 14 at an angle to the longitudinal direction of the terminal fittings 19. The wires 20 then are drawn out from the wire cover 14.

The moving plate 15 has a known construction with positioning holes for positioning tabs at the front ends of the male terminal fittings 19. Cam followers 21 are formed at the left and right edges of the moving plate 15 and are exposed at the outer surface of the receptacle 12.

The levers 16 are substantially in the form of plates that extend along the outer side surfaces of the housing 11. Bearing holes 22 of the levers 16 are supported rotatably on supporting shafts 23 of the housing 11. Each lever 16 has a cam groove 24 and a cam follower 25 (see FIG. 2), and the corresponding cam follower 21 of the moving plate 15 engages the cam groove 24 of one of the levers 16.

The frame 17 is substantially rectangular and at least partly surrounds the housing 11. Left and right arcuate cam grooves 26 (see FIG. 2) are formed in left and right plates of the frame 17 and the cam followers 25 of the levers 16 engage the cam grooves 26. A distance from the cam follower 25 to a center of rotation of the lever 16 about the supporting shaft 23 exceeds a maximum distance from the cam groove 24 to the center of rotation of the lever 16 about the supporting shaft 23. Thus, a cam action is displayed when the housing 11 moves with respect to the frame 17 forward and backward along the connecting direction CD. Accordingly the engagement of the cam followers 25 of the levers 16 and the cam grooves 26 of the frame 17 creates large moments around the centers of rotation of the levers 16. The moments exert large pushing/pulling forces on the cam followers 21 of the moving plate 15 and the cam followers 43 of the female connector 40 forward and backward along the connecting direction CD.

Rib-shaped guidable portions 27F, 27R are formed on the outer surfaces of the left and right plates of the frame 17 and extend substantially vertically and substantially normal to the connecting direction CD. The guidable portions 27F, 27R on each side plate are spaced along the connecting direction CD of the connectors 10, 40. The space between the guidable portions 27F, 27R in each pair is shortest at contacts 28 which are substantially at vertical middle positions. The guidable portions 27F, 27R are bent substantially symmetrically at an obtuse angle at the contacts 28 with respect to a line of symmetry that is normal to the connecting direction CD. Sections above and below the contacts 28 define stoppers 29 that extend oblique to the connecting direction CD. The guidable portions 27F, 27R thus define an X-shape together when viewed sideways.

The frame 17 is assembled to move only vertically and normal to the connecting direction CD with respect to the holder 30 and the module M to which the holder 30 is fixed. Specifically, the holder 30 has a substantially rectangular opening 31 in which the frame 17 and the male connector 10 are accommodated. Left and right guide rails 32 are formed at the left and right edges of the opening 31 and extend substantially straight in a vertical direction normal to the connecting direction CD of the connectors 10, 40. The guide rails 32 are ribs that project in towards the opening 31 of the holder 30, and the dimension along the connecting direction CD is slightly shorter than the space between the contacts 28 of the paired guidable portions 27F, 27R, which is the shortest spacing between the guidable portions 27F, 27R.

The guidable portions 27F, 27R are mounted to hold the guide rails 32 from the front and back. In the mounted state, the guidable portions 27F, 27R and the male connector 10 are movable vertically with respect to the holder 30 and the module M by sliding the guidable portions 27F, 27R along the guide rails 32. Further, the guidable portions 27F, 27R and the male connector 10 are inclinable forward and back with respect to the holder 30 and the module M substantially about the contacts 28 of the guidable portions 27F, 27R. The guidable portions 27F, 27R and the male connector 10 can make forward or backward pivotal displacements PD while making vertical displacements substantially normal to the connecting direction CD of the connectors 10, 40.

The female connector 40 has a substantially rectangular housing 41 that fits into the receptacle 12 of the male connector 10 from the front and a wire cover 42 to be mounted on the rear surface of the housing 41.

Cam followers 43 project from the left and right outer surfaces of the housing 41 and engage with recesses of the cam followers 21 of the moving plate 15. Thus, the cam followers 21, 43 are engaged, as integral units, with the cam grooves 24 of the levers 16. Accordingly, the female connector 40 and the moving plate 15 can move together in forward and backward directions substantially along the connecting direction CD.

Female terminal fittings 44 are inserted into the housing 41, and wires 45 connected with the respective female terminal fittings 44 are drawn out through the rear surface of the connector housing 41. The wires 45 then are bent down in the wire cover 42 in a direction substantially normal to the female terminal fittings 44 and are drawn out from the wire cover 42. A mounting, portion 46 is formed on the rear surface of the wire cover 42, and an L-shaped bracket 47 to be fixed to the body B is mounted on the mounting portion 46. In this way, the female connector 40 is fixed to the body B.

Figure 3:
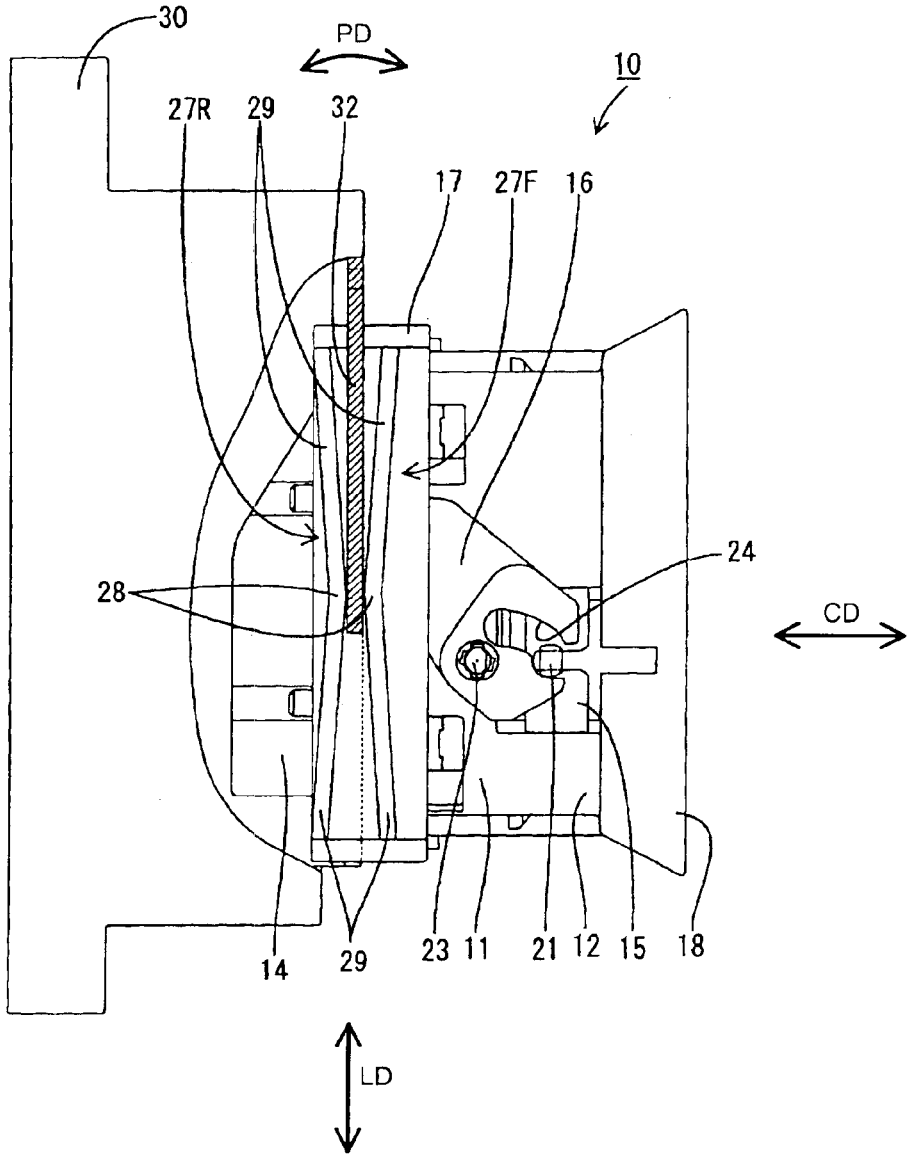
FIG. 3 is a side view partly in section showing a state where the male connector is in a neutral posture.
Figure 4:
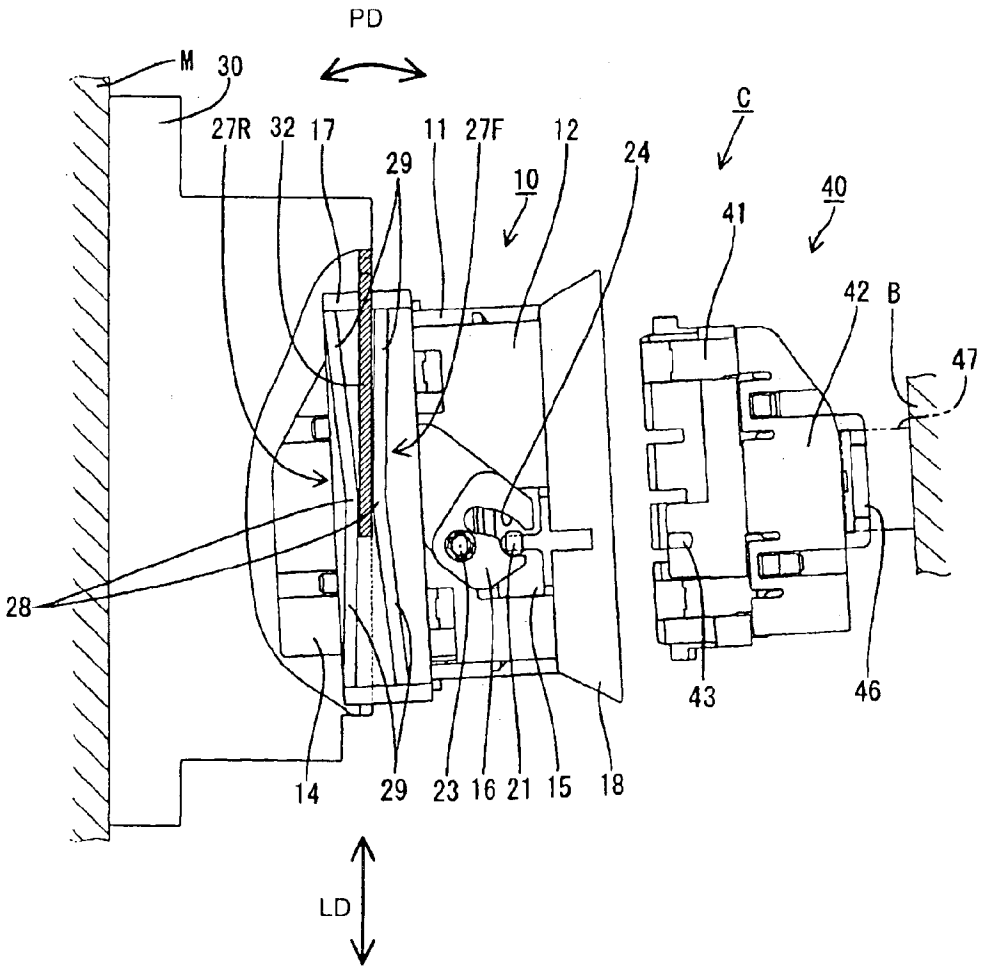
FIG. 4 is a side view partly in section showing a state where the male connector is so inclined as to conform to the female connector.

The auxiliary connectors 13, the male terminal fittings 19 and the wire cover 14 are assembled with the housing 11 before connecting the two connectors 10, 40. The housing 11 then is moved forward with respect to the frame 17 to bring the cam followers 21 of the moving plate 15 substantially to the entrances of the cam grooves 24 of the levers 16 in the male connector 10, as shown in FIG. 3. On the other hand, the female terminal fittings 44 and the wire cover 42 are assembled with the housing 41 of the female connector 40 and the mounting portion 46 of the female connector 40 is mounted on the bracket 47 of the body B.

The module M then is brought substantially horizontally along the connecting direction CD to the body B. Thus, the female connector 40 is fit at least partly into the receptacle 12 from the front. The male connector 10 may be displaced with respect to the female connector 40 up, down, left and/or right in a direction intersecting the connecting direction CD. However, the slanted inner surface of the guiding portion 18 contacts the outer peripheral edge of the front end of the housing 41 of the female connector 40. As the connection progresses, the male connector 10 and the frame 17 move laterally along the inclination of the guiding portion 18, and are corrected to a substantially proper position with respect to the female connector 40 and the body B. More particularly, the contacts 28 of the guidable portions 27F, 27R slide in contact with the guide rails 32 to displace the male connector 10 laterally.

The male connector 10 may be inclined forward or backward with respect to the female connector 40. However, the guidable portions 27F, 27R are inclined backward or forward along an inclination direction PD with respect to the guide rails 32 substantially about the contacts 28. In this way, the male connector 10 is oriented to face the female connector 40 directly from the front, and the two connectors 10, 40 can be connected without any hindrance.

The cam followers 43 of the female connector 40 unite with the cam followers 21 of the moving plate 15 as the female connector 40 is fit into the receptacle 12. The female connector 40 then is fit further and pushes the housing 11 of the male connector 10 back with respect to the frame 17. As a result, the cam followers 25 of the levers 16 engage the cam grooves 26 of the frame 17 to rotate the levers 16. The cam followers 21, 43 are engaged in the cam grooves 24 of the rotating levers 16. Thus, the female connector 40 and the moving plate 15 are pulled toward the back of the frame 17. Finally, the two connectors 10, 40 reach their connected state.

Figure 5A:
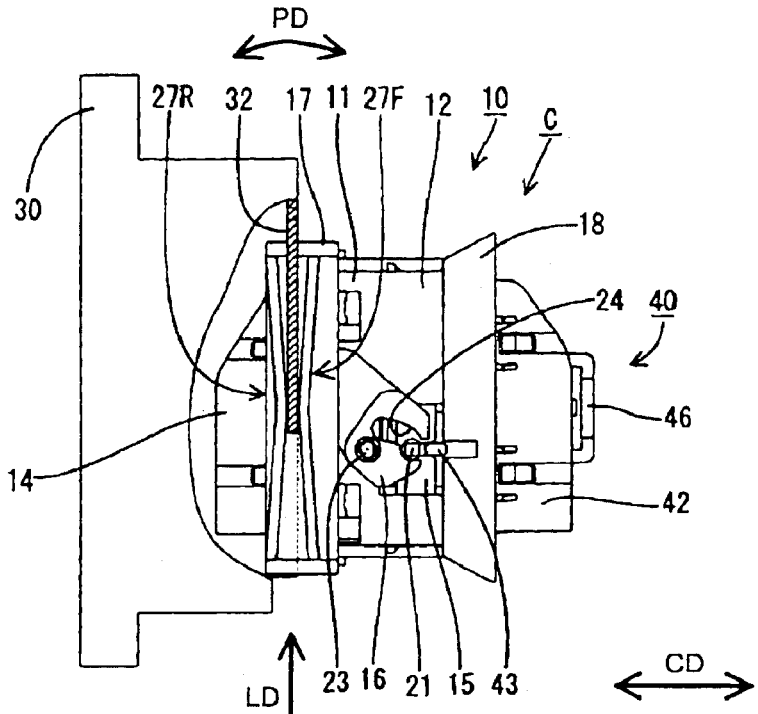
FIGS. 5(*a*) and 5(*b*) are a side view partly in section and a section showing an intermediate stage of connection of the two connectors.
Figure 5B:
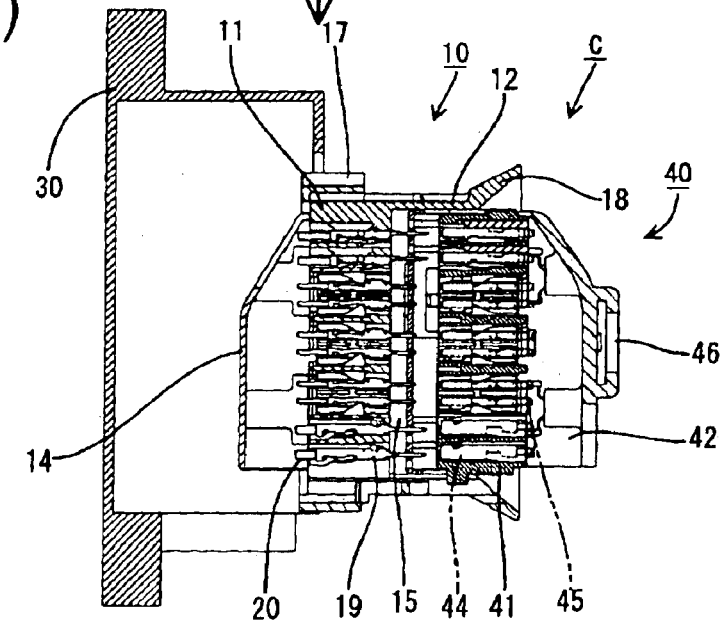

The module M and the holder 30 are moved down with respect to the body B and the two connectors 10, 40 in a direction intersecting the connecting direction during connection of the connectors 10, 40 (see FIGS. 5 and 6). This downward movement causes the module M to be caught by a fixing piece (not shown) of the body B. As a result, the module M is fixed to the body B.

As described above, the two connectors 10, 40 may be displaced in a direction that intersects the connecting direction CD. However, the guidable portions 27F, 27R move along the guide rails 32 to take up the displacement between the connectors 10, 40. Spring pieces for resiliently supporting the connector need not be provided at the opposite sides of the connector, and the absence of spring pieces enables the connector assembly to be smaller.

The guidable portions 27F, 27R and the male connector 10 are pivotable along the pivotal movement direction PD and are vertically pivotable substantially about the contacts 28 which is an axis intersecting both the longitudinal direction of the guide rails 32 and the connecting direction CD of the connectors 10, 40. Thus, displacements resulting from parallel movements in directions intersecting the connecting direction CD, and those resulting from inclinations oblique to the connecting direction CD can be dealt with.

The prior art uses the spring pieces made of a synthetic resin for resiliently supporting the male connector. However, nothing resiliently deformable is used to take up the displacement of the male connector 10 in this embodiment. Thus, there is no problem of excessive deformation of the spring pieces beyond their resiliency limit or a loss of the resiliency of the spring pieces caused by deterioration with time.

The guidable portions 27F, 27R are paired to hold the corresponding guide rail 32 from the opposite sides, and are inclined so that the spacing therebetween is shortest at the contacts 28 with the guide rail 32. The stoppers 29 are defined on the guidable portions 27F, 27R at positions spaced from the contacts 28. The stoppers 29 contact the guide rails 32 to limit the maximum angle of the pivotal displacement of the male connector 10.

The guiding portion 18 is slanted to widen the opening edge of the receptacle 12 of the male connector 10. Thus, if the male connector 10 is displaced with respect to the female connector 40, the relative positions of the connectors 10, 40 are corrected automatically by the slanted guiding portion 18 and the connectors 10, 40 can be connected properly without manually correcting the position and posture of the male connector 10.

A connector assembly C according to a second embodiment is illustrated in FIGS. 7 to 17. The connector assembly C is designed to connect a male connector 10 on a module M, such as an instrument panel, and a female connector 30 on a body B, such as an automotive vehicle as the module M is connected to the body B. In the following description, a connecting or mating side of the connectors 10, 130 is referred to as the front.

The male connector 10 has a housing 11 with a substantially rectangular forwardly open receptacle 12. Auxiliary connectors 13 are mountable from behind and along an inserting direction ID into the housing 11. A wire cover 14 is mounted on the rear surface of the housing 11, and a moving plate 15 is movable forward and back in the receptacle 12 substantially along the connecting direction CD. Two levers 16 are supported rotatably on the left and right outer surfaces of the housing 11, and a frame 17 is fit on the housing 11 for movement in forward and backward directions substantially along the connecting direction CD.

A guiding portion 18 is formed at the front opening edge of the receptacle 12 of the housing 11 and is slanted to widen toward the front. The guiding portion 18 corrects displacements between the male connector 10 and a female connector to be described later.

Male terminal fittings 19 are inserted into the auxiliary connectors 13 in the housing 11, and wires 20 connected with the male terminal fittings 19 are drawn out through from rear of the auxiliary connectors 13. The wires 20 are bent down in the wire cover 14 at an angle substantially normal to the longitudinal direction of the terminal fittings 19. The wires 20 then are drawn out from the wire cover 14.

The moving plate 15 is formed with positioning holes 115*a* for positioning tabs 119*a* at the front ends of the male terminal fittings 19. Cam followers 115*b* are formed at the left and right edges of the moving plate 15 and are exposed at the outer surface of the receptacle 12.

The levers 16 are plates that extend along the outer side surfaces of the housing 11, and are supported by engaging bearing holes 116*a* of the levers 116 with supporting shafts 111*a* of the housing 11. Each lever 16 has a cam groove 116*b* and a cam follower 116*c*, and the corresponding cam follower 115*b* of the moving plate 15 is engaged with the cam groove 116*b*. Left and right arcuate cam grooves 117*a* are formed in the left and right plates of the frame 17 and the cam followers 116*c* of the levers 16 are engaged with the cam grooves 117*a*. A distance from a center of rotation (supporting shaft 111*a*) of the lever 16 to the cam follower 116*c* exceeds a maximum distance from the center of rotation of the lever 16 to the cam groove 116*b*. Thus, a cam action can be displayed when the housing 11 moves with respect to the frame 17 forward and backward along the connecting direction CD, and large moments are created around the centers of rotation of the levers 16 by the engagement of the cam followers 116*c* of the levers 16 and the cam grooves 117*a* of the frame 17. The moment forces create large pushing/pulling forces on the cam followers 115*b* of the moving plate 15 and the cam followers 132 of the female connector 130 in forward and backward directions substantially along the connecting direction CD.

Forward movement of the housing 11 with respect to the frame 17 causes the cam followers 116*c* of the levers 16 to be caught in the cam grooves 117*a* of the frame 17 while the cam followers 115*b* of the moving plate 15 and the cam followers 132 of the female connector 130 are at the entrances of the cam grooves 116*b* of the levers 16. Thus, further forward movement of the housing 11 is prevented. Backward movement of the housing 11 with respect to the frame 17 causes locking projections 121 on the outer surfaces of the housing 11 to contact corresponding receiving portions 117*b* on the inner periphery of the frame 17 while the cam followers 115*b* of the moving plate 15 and the cam followers 132 of the female connector 130 are at the back ends of the cam grooves 116*b* of the levers 16. Thus, further backward movement of the housing 11 is prevented (see FIG. 16).

The holder 122 is fixed to the module M, and the frame 17 is assembled to move only vertically with respect to the holder 122. The male connector 10 is mounted on the module M via the holder 122. The module M is assembled with the body B by being moved substantially horizontally along the connecting direction CD, and is guided by an unillustrated guiding means.

The female connector 130 is comprised of a substantially rectangular housing 31 that fits into the receptacle 12 of the male connector 10 from the front. Auxiliary connectors 133 are mountable into the housing 131 from behind, and a wire cover 136 is mounted in a cover mounting direction CMD on the rear surface of the housing 131.

Cam followers 132 project from the left and right outer surfaces of the housing 131 and engage recesses of the cam followers 115*b* of the moving plate 15. Thus, the cam followers 115*b*, 132 engage as integral units with the cam grooves 116*b* of the levers 16. The engagement of the cam followers 115*b*, 132 enables the female connector 130 and the moving plate 15 to move together forward and back along the connecting direction CD. Female terminal fittings 134 are inserted into the auxiliary connectors 133 in the housing 131, and wires 135 connected with the female terminal fittings 134 are drawn out through the rear of the auxiliary connectors 133.

The wire cover 136 is substantially a box having open front and bottom surfaces and is mounted along the cover mounting direction CMD on the housing 131 to cover the rear surface (right surface in FIGS. 12 to 16) of the housing 131. The wires 135 are drawn out through this rear surface of the housing 131 and are bent down in the wire cover 136 at an angle substantially normal to the longitudinal direction of the female terminal fittings 13 and substantially parallel with the rear surfaces of the auxiliary connectors 133. The wires 135 then are drawn out laterally from the wire cover 136.

A mounting portion 137 for fixing the female connector 130 to the body B is formed on the rear surface (right surface in FIGS. 12 to 16) of the wire cover 136. The mounting portion 137 has upper and lower ribs 138 that extend substantially normal to the connecting direction CD along the rear surface of the wire cover 136. The ribs 138 are substantially L-shaped when viewed sideways to form catches that restrict a space from the rear surface. Ends of the ribs 138 at one side are coupled by a narrow projection 139. Thus, the ribs 138 and the projection 139 on the rear surface of the wire cover 136 define a mounting space 140. The mounting space 140 is open at a transverse side opposite the projection 139 and at the backside. Accordingly, the bracket 50 can be mounted in the mounting space in a mounting direction MD arranged substantially normal to the connecting direction CD and normal to the cover mounting direction CMD. A fastening projection 141 is formed on the rear surface of the wire cover 136 and projects into the mounting space 140. The fastening projection 141 has a locking surface 141*a* that is aligned normal to the rear surface of the wire cover 136 and faces the projection 139. The fastening projection 141 also has a slanted guide surface 141*b* that is aligned oblique to the rear surface of the wire cover 136 and faces towards the open side of the mounting space 140.

A mounting portion 137 is mounted on a bracket 50 to be fixed to the body B. The bracket 50 has a mounting plate 51 substantially parallel with the rear surface of the wire cover 136 and a supporting plate 52 extending back from a lateral edge of the mounting plate 51 and continuous with the body B. The mounting plate 51 has a fastening hole 53 that is engageable with the fastening projection 141.

Upper and lower outward-displacement restricting portions 142 are formed on the rear edges of each of the outer left and right surfaces of the housing 131 of the female connector 130. The outward-displacement restricting portions 142 contact sidewalls 136S of the wire cover 136 to restrict outward displacements of the sidewalls 136S. Further, a fastening projection 143 is formed on an outer surface of the base end of each outward-displacement restricting portion 142. Recesses 144 are formed in the outer surfaces of the left and right side walls 136S of the wire cover 136 and extend forward and back along the cover mounting direction CMD to accommodate the leading rear ends of the respective outward-displacement restricting portions 142. The wire cover 136 is mounted on the housing 131 in the cover mounting direction CMD so that the outward-displacement restricting portions 142 are accommodated in the recesses 144 and contact the inner surfaces of the recesses 144 from outside. The sidewalls 136S of the wire cover 136 also are formed with locking pieces 145 that project in the cover mounting direction CMD forward from the recesses 144. Thus, the locking pieces 145 extend along the outer surfaces of the base ends of the outward-displacement restricting portions 142. The wire cover 136 is mounted on the housing 131 from behind in the cover mounting direction CMD. Thus, the locking pieces 145 engage the fastening projections 143 of the wire cover 136 from the front. As a result, the wire cover 136 is held on the housing 131 and will not disengage.

The auxiliary connectors 13, the male terminal fittings 19 and the wire cover 14 are assembled with the housing 11 before connecting the two connectors 10, 130. Additionally, the housing 11 is moved forward in the connecting direction CD with respect to the frame 17 to bring the cam followers 115*b* of the moving plate 15 substantially to the entrances of the cam grooves 116*b* of the levers 16 in the male connector 10. Similarly, the auxiliary connectors 133, the female terminal fittings 134 and the wire cover 136 are assembled with the housing 131. Additionally, the mounting portion 137 of the female connector 130 is mounted along the mounting direction MD onto the mounting plate 51 of the bracket 50 of the body B (see FIGS. 7 and 12) by inserting the mounting plate 51 into the mounting space 140 between the two ribs 138 along the rear surface of the wire cover 136. The mounting plate 51 moves over the fastening projection 141 during the inserting process and deforms back at an angle substantially normal to the mounting direction MD. The fastening projection 141 engages the fastening hole 53 to prevent the mounted female connector 130 from being disengaged from the bracket 50 along the mounting direction MD. Further, the two ribs 138 engage the opposite upper and lower edges of the mounting plate 51 to prevent the female connector 130 from being disengaged forward from the bracket 50.

The module M then is brought substantially horizontally along the connecting direction CD to the body B to fit the female connector 130 into the receptacle 12 from the front. The receptacle 12 could be displaced up, down, left and/or right with respect to the female connector 130 in a direction intersecting the connecting direction CD. However, the slanted inner surface of the guiding portion 18 contacts the outer peripheral edge of the front end of the housing 131 of the female connector 130. As the connection progresses, the positions of the receptacle 12 and the module M are corrected to proper positions with respect to the female connector 130 and the body B along the inclination of the guiding portion 18.

The cam followers 132 of the female connector 130 are united with the cam followers 115*b* of the moving plate 15 as the female connector 130 is fit into the receptacle 12. Movement of the female connector 130 further along the connecting direction CD pushes the housing 11 of the male connector 10 back with respect to the frame 17. The engagement of the cam grooves 117*a* of the frame 17 and the cam followers 116*c* of the levers 16 rotates the levers 16. Additionally, the cam followers 115*b*, 132 move in the cam grooves 116*b* due to the rotation of the levers 16 and pull the female connector 130 and the moving plate 15 toward the back side of the frame 17.

The frame 17 and the module M are moved down with respect to housing 11 of the male connector 10 and the female connector 130 in a direction intersecting the connecting direction CD during the connection of the connectors 10, 130.

Figure 15:
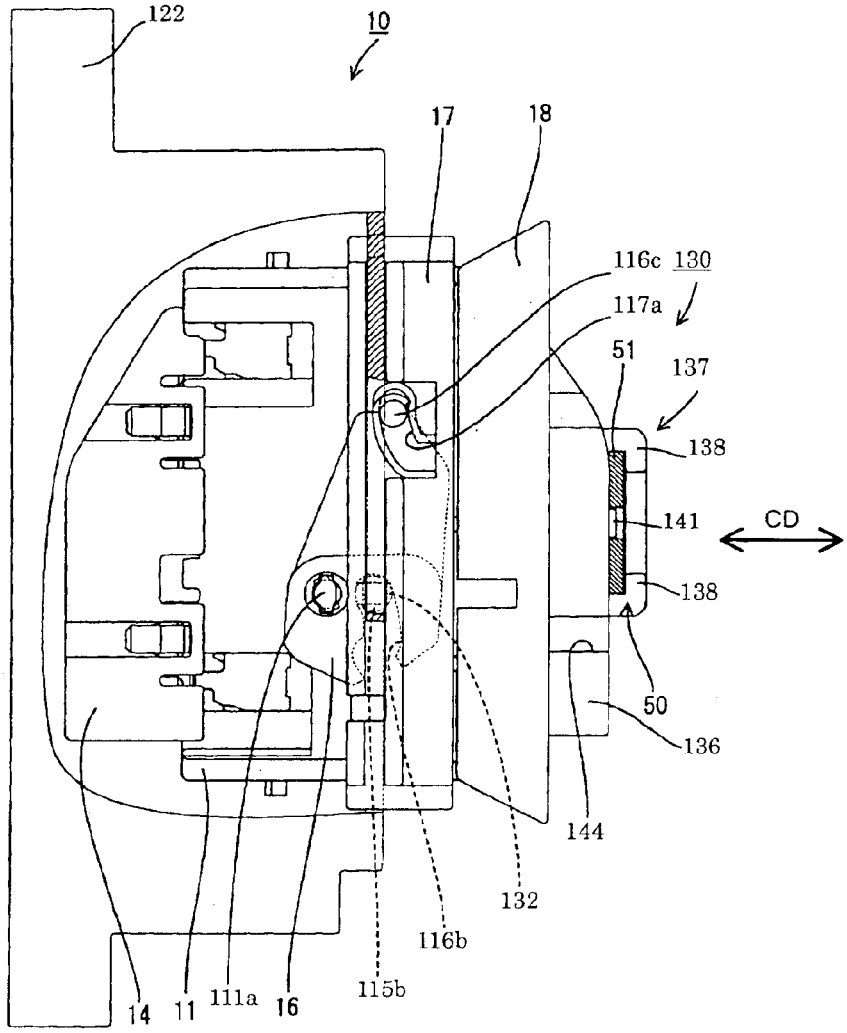
FIG. 15 is a side view partly in section showing a state where the male and female connectors are connected.
Figure 16:
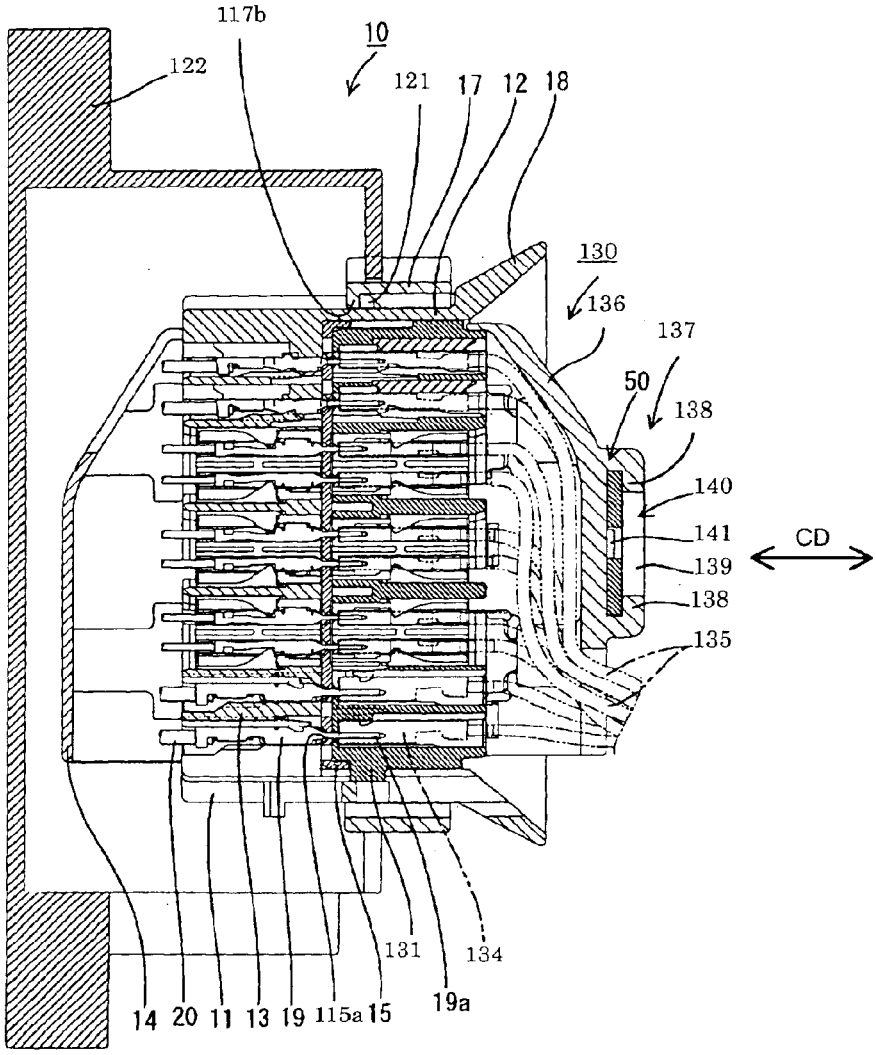
FIG. 16 is a vertical section showing the state where the male and female connectors are connected.
Figure 17:
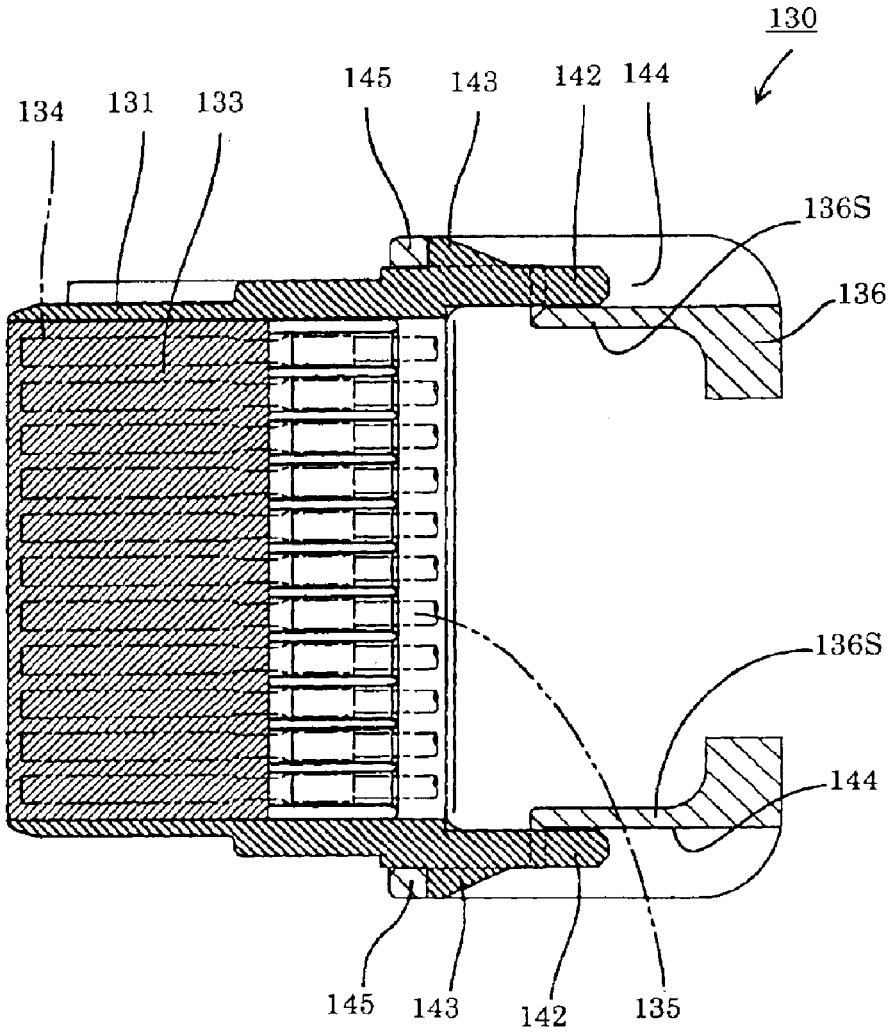
FIG. 17 is a section along 17—17 of FIG. 10.
Figure 18:
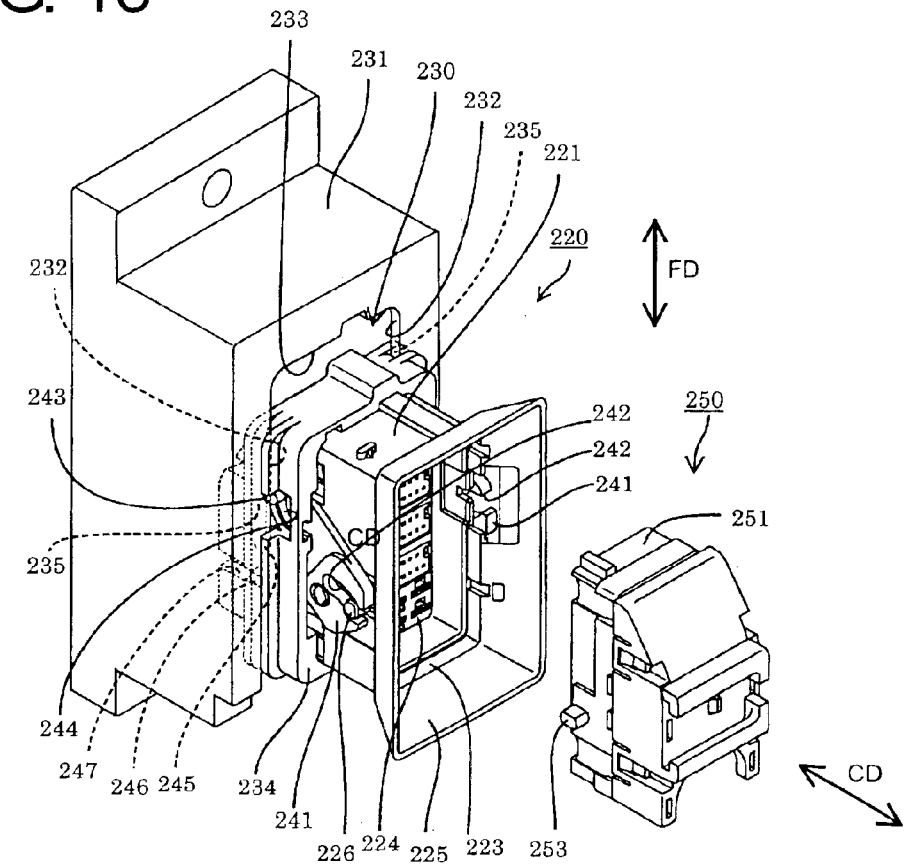
FIG. 18 is a perspective view showing a state when a male and a female connectors are not yet connected in a third embodiment of the invention.
Figure 19:
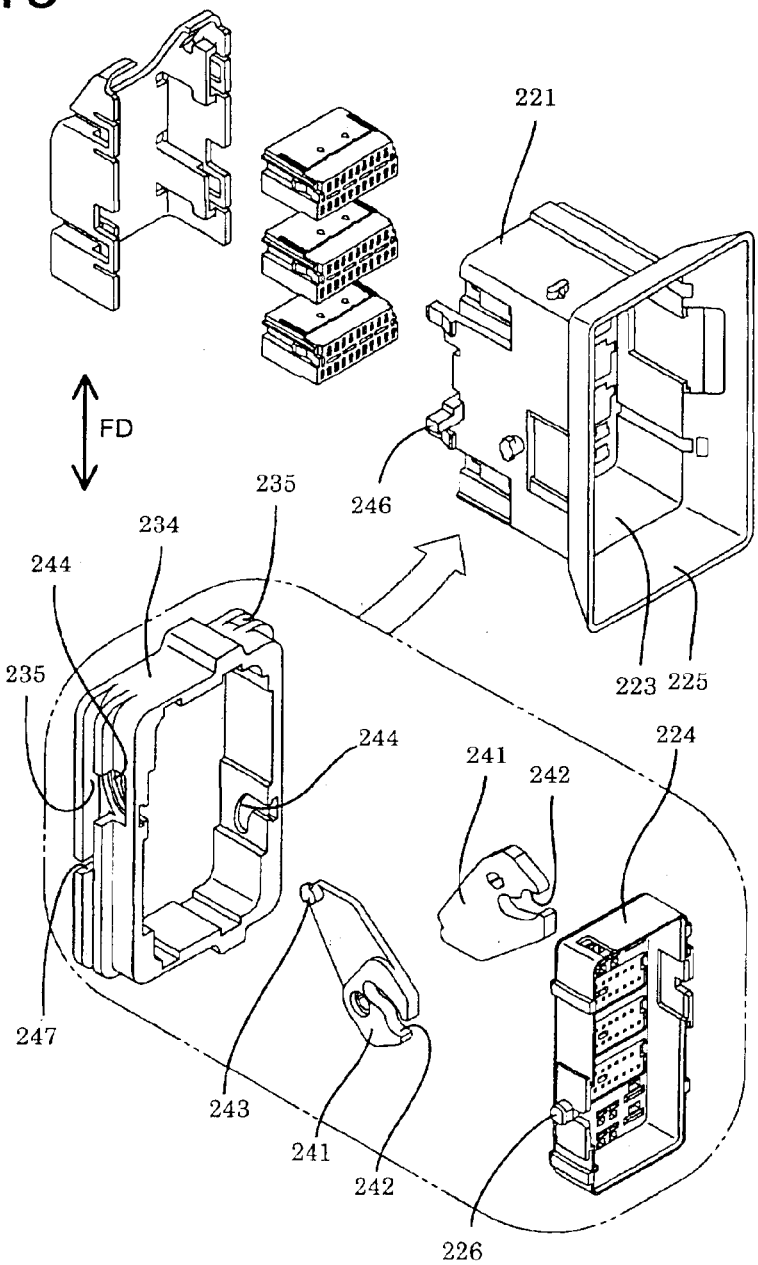
FIG. 19 is an exploded perspective view of the male connector mounted on a module.
Figure 20:
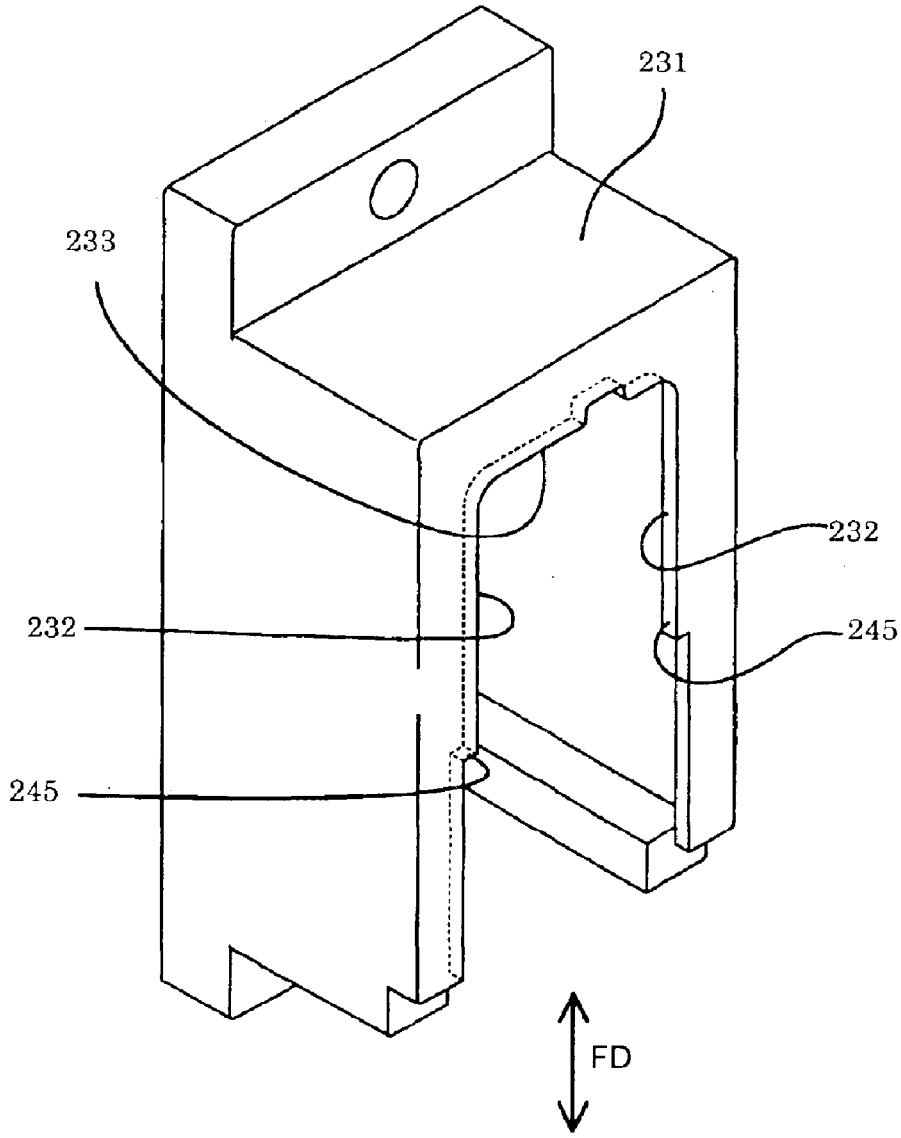
FIG. 20 is a perspective view of a holder.

The two connectors 10, 130 and the module M are moved sideways together with respect to the body B after the two connectors 10, 130 reach their properly connected state (see FIGS. 15 and 16). This movement engages the module M with an unillustrated fixing piece on the body B to prevent loose movement. Simultaneously, the mounting portion 137 of the wire cover 136 of the female connector 130 is slid sideways with respect to the bracket 50 of the body B, and reaches the state shown in FIG. 13.

As described above, the mounting portion 137 for fixing the female connector 130 to the bracket 50 of the body B is on the rear surface of the wire cover 136 of the female connector 130 as seen along the connecting direction CD and along the cover mounting direction CMD. Thus, the female connector 130 is smaller as compared to one having a mounting portion that projects back from the rear surface thereof.

Further, the mounting portion 137 does not hinder the insertion of the female terminal fitting 134 from behind if the wire cover 136 is left detached from the connector housing 131.

The wire cover 136 is mounted to the rear of the female connector 130 and the guiding portion 18 of the male connector 10 surrounds the wire cover 136 when the two connectors 10, 130 are connected. Thus, there is no likelihood that the guiding portion 18 and the wire cover 136 will interfere with each other.

Further, the mounting portion 137 is formed by the ribs 138 extending along the rear surface of the wire cover 136. Thus, the female connector 130 can be made even smaller as compared to the one having a mounting portion that projects vertically from the rear surface of a wire cover.

The rear surface of the wire cover 136 of the female connector 130 may be pressed against the bracket 50 as the two connectors 10, 130 are being connected and may generate forces to open the side walls 136S of the wire cover 136. However, the outward-displacement restricting portions 142 on the housing 131 of the female connector 130 contact the side walls 136S from outside to prevent such outward displacements of the side walls 136S.

The outward-displacement restricting portions 142 extend along the outer surfaces of the sidewalls 136S of the wire cover 136 and may be deformed or damaged by interference with external matter. However, the outward-displacement restricting portions 142 are accommodated in the recesses 144 in the sidewalls 136S. Thus, interference of external matter with the outward-displacement restricting portions 142 is prevented.

A connector assembly according to a third embodiment of the invention is described with reference to FIGS. 18 to 28. The connector assembly of this embodiment is designed to connect a male connector 220 and a female connector 250 along a connecting direction CD. The male connector 220 is on a module M, such as an instrument panel, and the female connector 250 is on a body B, such as an automotive vehicle. In the following description, a connecting or mating side of the male and female connectors 220, 250 is referred to as the front.

First, a moving path of the module M is described. As shown in FIG. 28, a guide pin 210 is fixed to the body B, and the module M has a guide groove 211. The guide groove 211 is open at its front end, and has a front substantially horizontal guiding portion 212 continuous with the open front end. A slanted guiding portion 213 extends obliquely down to the back from the rear end of the front horizontal guiding portion 212, and a slide guiding portion 214 extends up from the rear end of the slanted guiding portion 213. Finally, a rear substantially horizontal guiding portion 215 extends back from the upper end of the slide guiding portion 214. The guide groove 211 engages the guide pin 210 so that the module M first is moved substantially horizontally forward along a connecting direction CD from a state of FIG. 28(*a*) to a state of FIG. 28(*b*). The module M then is moved obliquely up to the front from a state of FIG. 28(*b*) to a state of FIG. 28(*c*). Next, the module M slides down from a state of FIG. 28(*c*) to a state of FIG. 28(*d*); and finally the module M moves substantially horizontally forward from a state of FIG. 28(*d*) to a state of FIG. 28(*e*). The module M is mounted on the body B after moving along this path.

The male connector 220 has a housing 221 in which male terminal fittings 222 are accommodated. The housing 221 has a forward-opening substantially rectangular receptacle 223, and a moving plate 224 is movable in the receptacle 223 for positioning tabs at the leading ends of the male terminal fittings 222. A slanted guiding portion 225 is formed near an opening edge of the receptacle 223 and widens toward the front. The two connectors 220, 250 may be displaced up, down, left and/or right in directions intersecting the connecting direction CD when the female connector 250 is fit into the receptacle 223. However, the front peripheral edge of the female connector 250 contacts the slanted inner surface of the guiding portion 225 to correct the displacement. Cam followers 226 are formed at the left and right edges of the moving plate 224 and are exposed at the outer surface of the receptacle 223.

The male connector 220 is mounted on the module M via a floating mechanism 230. The floating mechanism 230 is comprised of a holder 231 fixed to the module M for movement therewith, guide rails 232 formed on the holder 231, a floating member 234 displaceably supported on the holder 231, and a restricting means 240.

A substantially rectangular opening 233 is formed in the front surface of the holder 231, and guide rails 232 are defined at the left and right edges of the opening 233. The guide rails 232 extend substantially normal to the connecting direction CD and are aligned substantially vertically straight. The floating member 234 is a substantially rectangular frame that conforms to the opening 233 of the holder 231. Two guide grooves 235 are formed in the left and right outer surfaces of the floating member 234. The guide grooves 235 extend substantially normal to the connecting direction CD and are substantially vertically straight and parallel to the guide grooves 232. Additionally, the guide grooves 235 engage the guide rails 232. Thus, the floating member 234 and the male connector 220 supported on the floating member 234 are displaceable along the guide rails 232 and the guide grooves 235 with respect to the holder 231 and the module M. The displacement is in a floating direction FD that is substantially vertical and normal to the connecting direction CD. The opening 233 of the holder 231 opens down for mounting the floating member 234. However, a stopper 236 is fixed at an open bottom edge after the floating member 234 is mounted to prevent the floating member 234 from falling down and separating from the holder 231.

The floating member 234 is fit on the housing 221 and the receptacle 223 of the male connector 220. The male connector 220 is permitted to move relative to the floating member 234 in forward and backward directions parallel to the connecting direction CD. However, the male connector 220 cannot move relative to the floating member 234 along vertical and/or transverse directions that intersect the connecting direction CD.

The restricting means 240 includes a displacing means and contact means. The male connector 220 is supported on the floating member 234 via the displacing means. Specifically, two plate-shaped levers 241 are rotatably supported on the left and right outer surfaces of the housing 221 of the male connector 220. Each lever 241 has a cam groove 242 and a cam follower 243. The cam followers 226 of the moving plate 224 engage the cam grooves 242. Further, the floating member 234 is formed with left and right arcuate cam grooves 244, and the cam followers 243 of the levers 241 engage the cam grooves 244. A distance from a center of rotation of the lever 241 to the cam follower 243 exceeds a maximum distance from the center of rotation of the lever 241 to the cam groove 242. Thus, a cam action can be displayed. More particularly, the engagement of the cam followers 243 of the levers 241 and the cam grooves 244 of the floating member 234 create large moments around the centers of rotation of the levers 241 as the male connector 220 moves forward and back with respect to the floating member 234 along the connecting direction CD. The moments create large pushing/pulling forces in forward and backward directions along the connecting direction CD. These forces are exerted on cam followers 226 of the moving plate 224 and cam followers 253 of the female connector 250. The male connector 220 is displaced backward with respect to the floating member 234 substantially in the connecting direction CD as the connection of the male and female connectors 220, 250 progresses.

Next, the contact means are described. The rails 232 are formed only in an upper area, preferably an upper half, of the opening 233, and the left and right edges of the opening 233 are cut off or widened below the bottom ends of the respective guide rails 232. Thus, bottom ends of the guide rails 232 are stepped or widened. The bottom surfaces of the stepped portions define receiving portions 245 and function as part of the contact means. On the other hand, the female connector 220 is formed with projections 246 that project from the outer left and right surfaces of the housing 221 and function as another part of the contact means. Movement of the floating member 234 up in the floating direction FD along the guide rails 232 is interrupted when the projections 246 contact the receiving portions 245 from below.

Figure 22A:
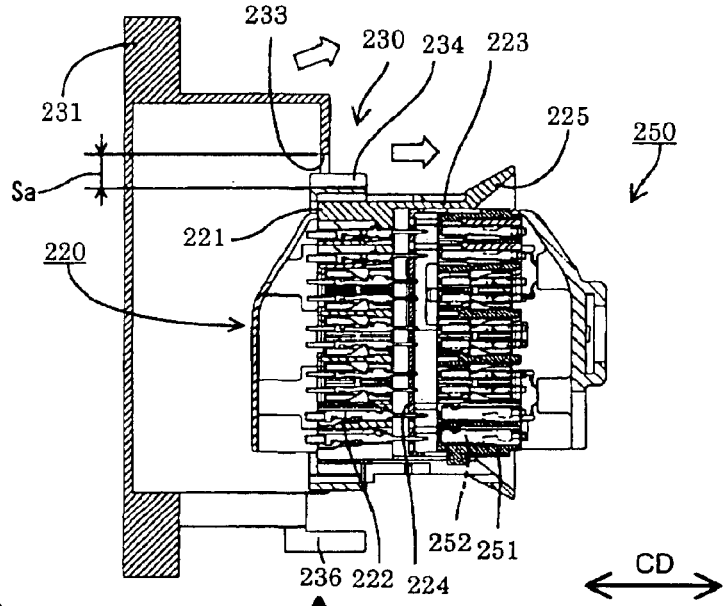
FIGS. 22(*a*) and 22(*b*) are a section and a side view partly in section showing a state where the connection of the connectors is started.
Figure 22B:
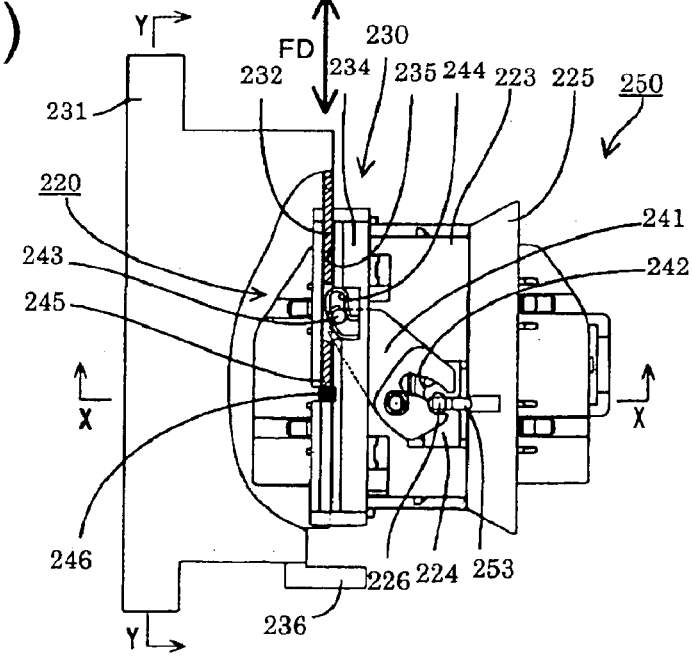
Figure 24A:
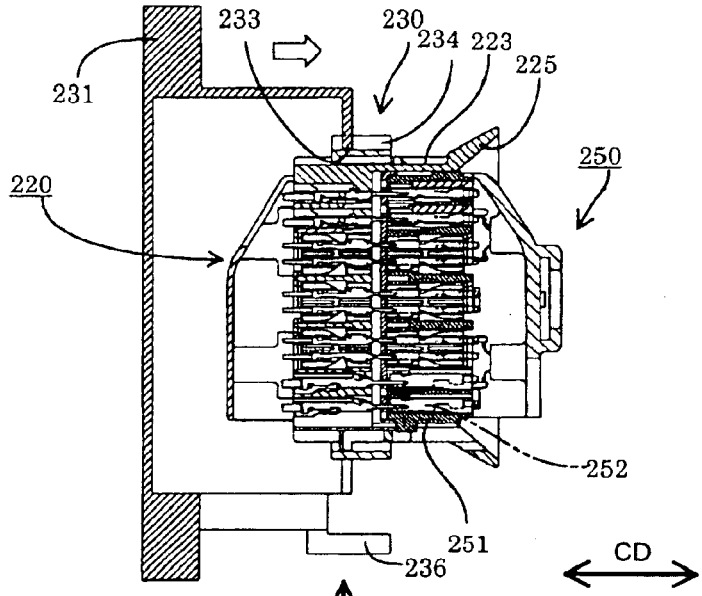
FIGS. 24(*a*) and 24(*b*) are a section and a side view partly in section showing a state where the module is slid down from the state of FIG. 23.
Figure 24B:
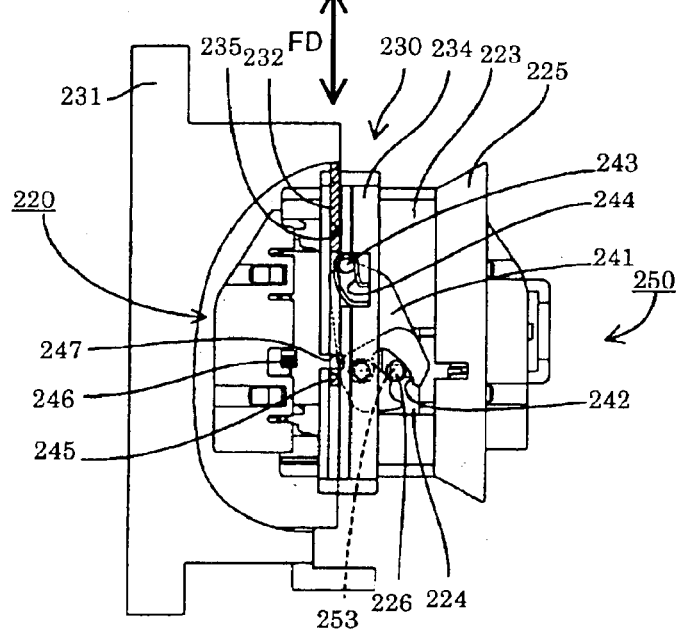
Figure 25A:
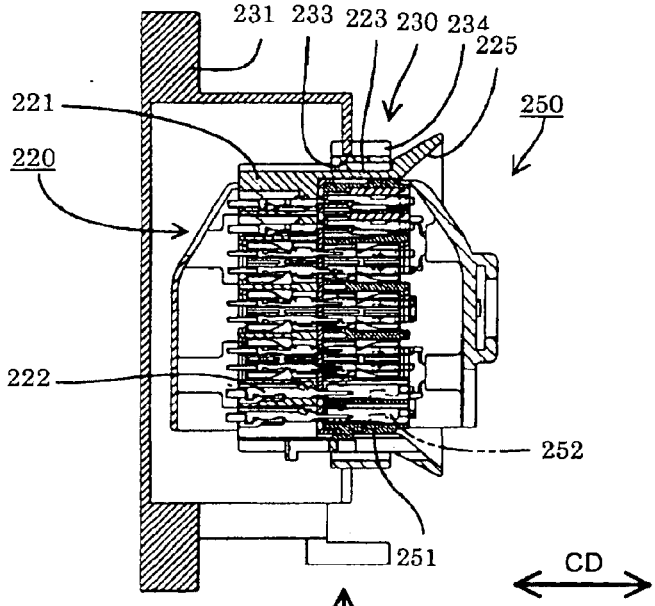
FIGS. 25(*a*) and 25(*b*) are a section and a side view partly in section showing a state where the connection of the two connectors is completed.
Figure 25B:
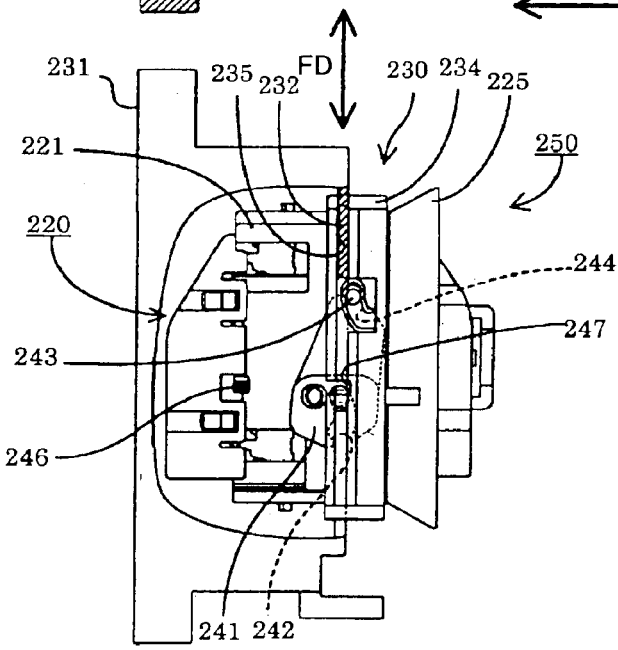
Figure 26:
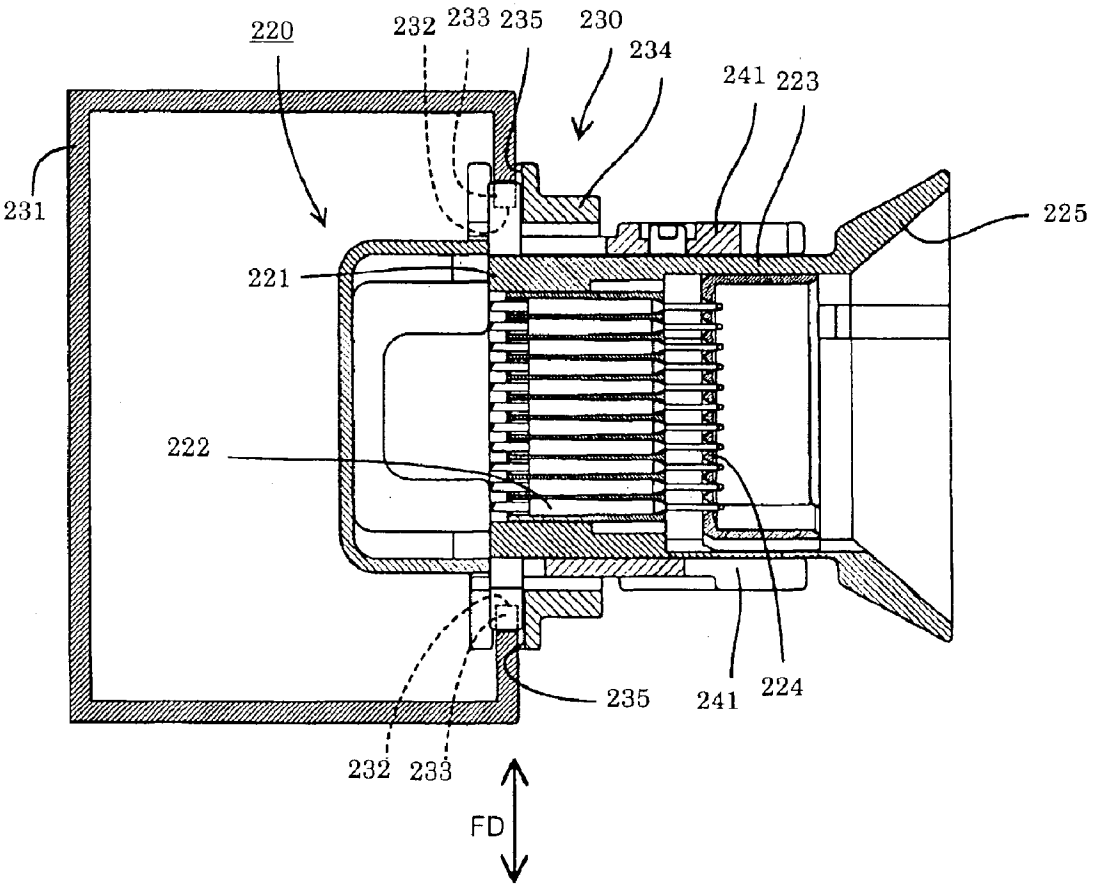
FIG. 26 is a section along 26—26 of FIG. 22(*b*).
Figure 27:
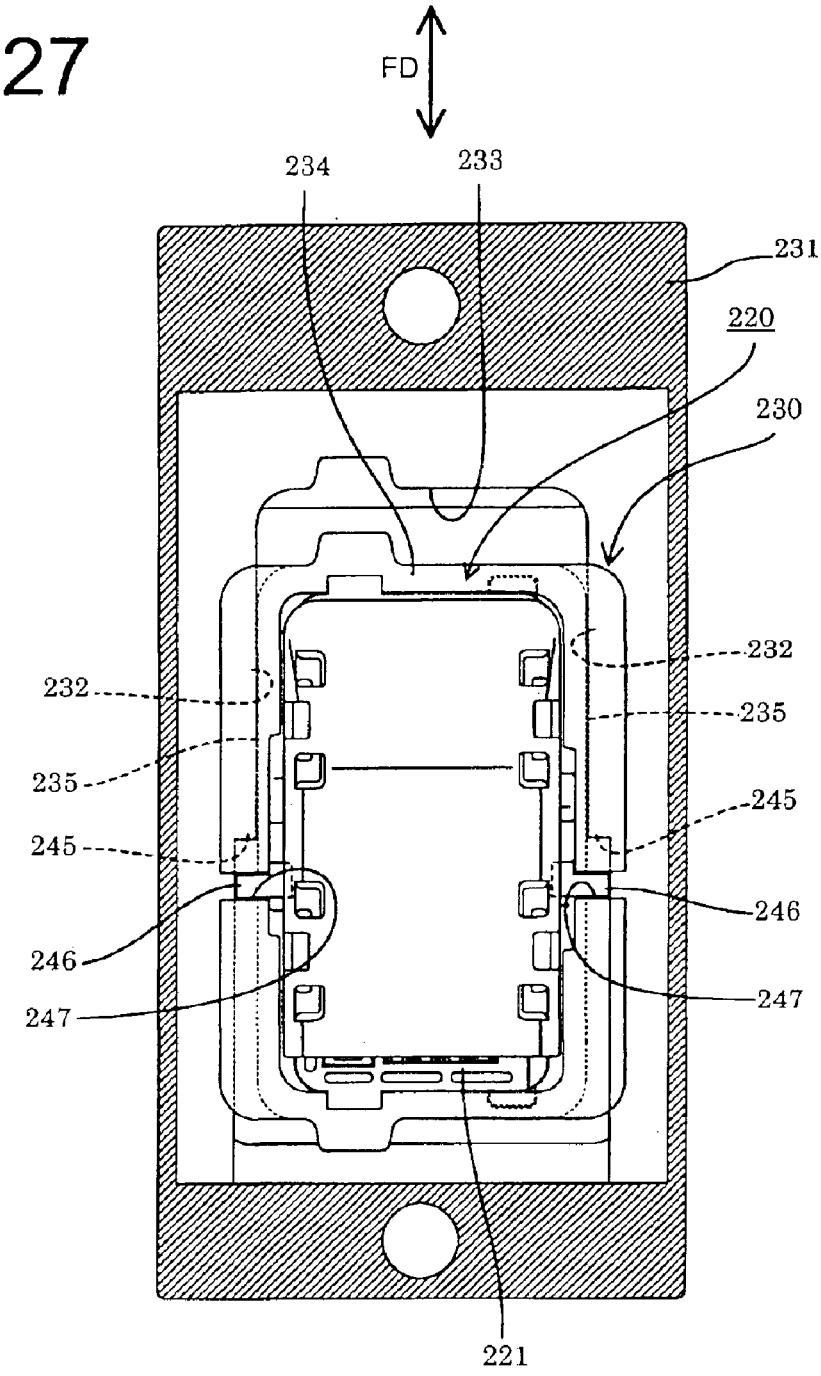
FIG. 27 is a section along 27—27 of FIG. 22(*b*).
Figure 28A:
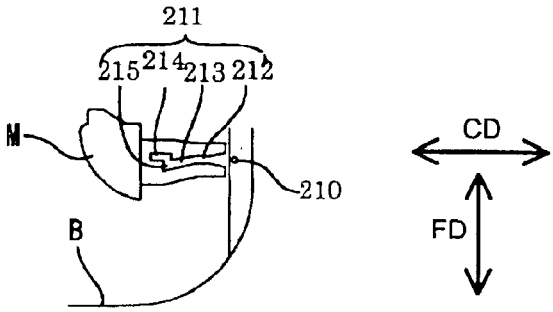
FIGS. 28(*a*), 28(*b*), 28(*c*), 28(*d*) and 28(*e*) are schematic side views corresponding to FIGS. 21, 22, 23, 24 and 25, respectively, showing a moving path of the module at the time of being assembled with a body.
Figure 28B:
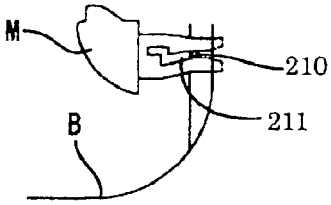
Figure 28C:
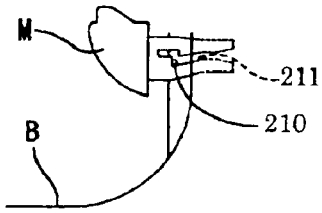
Figure 28D:
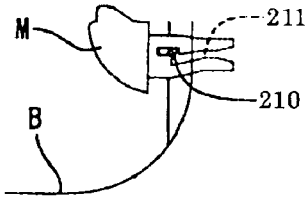
Figure 28E:
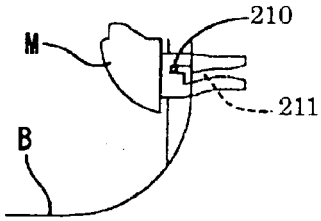
Figure 28E:
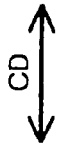

The projections 246 are below and near the receiving portions 245 when the two connectors 220, 250 unconnected, thereby restricting upward movement of the floating member 234 with respect to the holder 231. Specifically, the upper end surface of the floating member 234 and the upper edge of the opening 233 of the holder 231 are spaced apart vertically along the floating direction FD by a spacing Sa, as shown in FIG. 22, when the projections 246 are held in contact with the receiving portions 245. Contrary to this, the male connector 220 is moved back with respect to the floating member 234 when the connection of the two connectors 220, 250 is started. Thus, the projections 246 disengage from the receiving portions 245. The floating member 234 then is moved up along the floating direction FD with respect to the holder 231 until the projections 246 are higher than the receiving portions 245. As shown in FIG. 24, an upward movement of the floating member 234 along the floating direction FD is restricted when the upper end surface of the floating member 234 contacts the upper edge of the opening 233.

Escape grooves 247 extend from the rear end surface of the floating member 234 to the guide grooves 235. The escape grooves 247 are at a height substantially corresponding to the projections 246 of the male connector 220. With the two connectors 220, 250 unconnected, the projections 246 are in the escape grooves 247 and, therefore, can be located right below and near the receiving portions 245. The projections 246 disengage backward from the receiving portion 245 and come out of the escape grooves 247 as the connection progresses.

The female connector 250 has a substantially rectangular housing 251 and female terminal fittings 252 are inserted from behind into the housing 251. The housing 251 fits into the receptacle 223 of the male connector 220 from the front, and is fixed to the body B by an unillustrated bracket or other fixing means. Cam followers 253 project from the left and right outer surfaces of the housing 251 and fit into recesses of the cam followers 226 of the moving plate 224. Thus, the cam followers 226, 253 engage as integral units with the cam grooves 242 of the levers 241. With the cam followers 226, 253 engaged, the female connector 250 and the moving plate 224 move together forward and back substantially along the connecting direction CD.

Figure 21A:
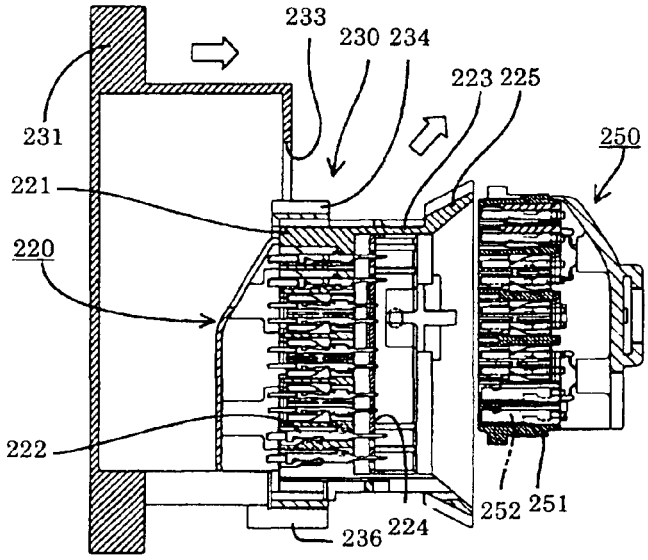
FIGS. 21(*a*) and 21(*b*) are a section and a side view partly in section showing a state where a floating movement of the male connector is restricted with the male and female connectors unconnected, respectively.
Figure 21B:
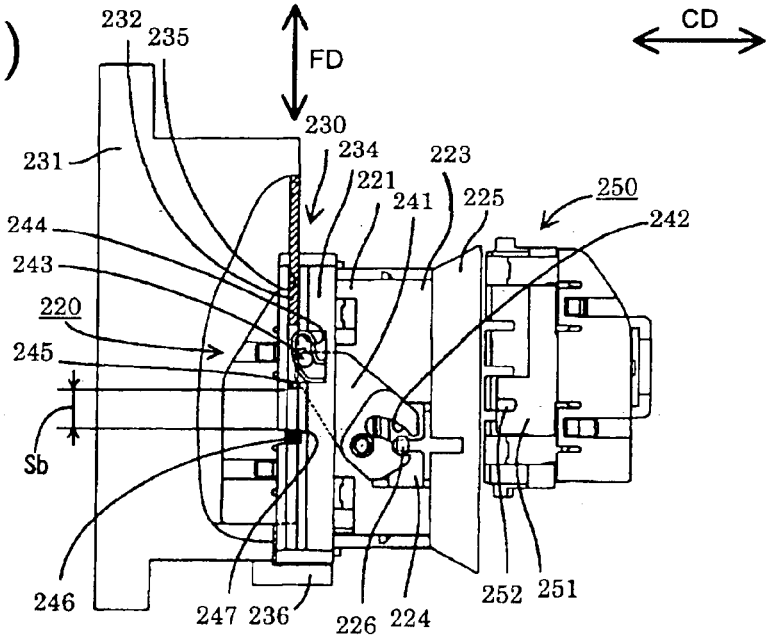

The male connector 220 is moved forward with respect to the floating member 234 before connecting the two connectors 220, 250 to bring the cam followers 226 of the moving plate 224 near the entrances of the cam grooves 242 of the levers 241, as shown in FIG. 21. Further, the floating member 234 is substantially in contact with the stopper 236 at a bottommost position of the floatable area of the floatable member 234 along the vertical floating direction FD with respect to the holder 231.

Further, the projections 246 of the male connector 220 enter the escape grooves 247 of the floating member 234 and are located below and near the receiving portions 245 as shown in FIG. 21(*b*). A clearance Sb is defined between the projections 246 and the receiving portions 245 substantially vertically along the floating direction FD. Therefore, the floating member 234 can move up along the floating direction FD with respect to the holder 231. This moving distance is shorter than a maximum floating distance Sc of the floating member 234 shown in FIG. 23(*a*). Thus, upward floating movements of the male connector 220 and the floating member 234 with respect to the module M and the holder 231 are restricted in this state.

Movement of the module M along the specified path in this state causes the male connector 220 to be displaced down and towards the female connector 250, as shown in FIG. 21. This displacement enables the upper edge of the front end of the female connector 250 to contact the inner surface of the guiding portion 225. The slanted surface of the guiding portion 225 brings the male connector 220 up to substantially the same height as the female connector 250 as the two connectors 220, 250 are brought closer to each other, as indicated by an arrow in FIG. 21(*a*). Then, as shown in FIG. 22, the front end of the female connector 250 fits into the receptacle 223 to start the connection of the two connectors 220, 250. At this time, the module M is moved substantially horizontally along the connecting direction CD without changing its height, as indicated by an arrow in FIG. 21(*a*). Thus, the floating member 234 is slid along the guide rails 232 of the holder 231.

The two connectors 220, 250 then are connected further without substantially changing their height as indicated by an arrow in FIG. 22(*a*). On the other hand, the module M and the holder 231 continue to move forward in the connecting direction CD while being displaced up along the floating direction FD with respect to two connectors 220, 250, as indicated by an arrow in FIG. 22(*a*).

Figure 23A:
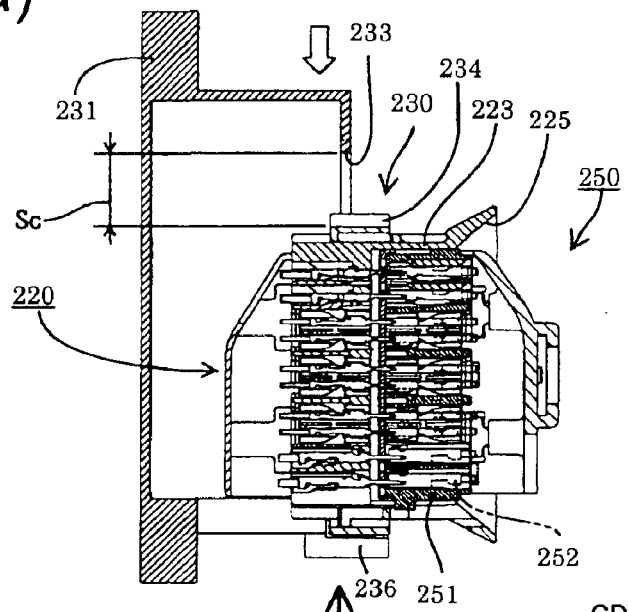
FIGS. 23(*a*) and 23(*b*) are a section and a side view partly in section showing a state where the restriction on the floating movement of the male connector is canceled as the connection of the connectors progresses and a floating member is slid relatively upward with respect to the two connectors.
Figure 23B:
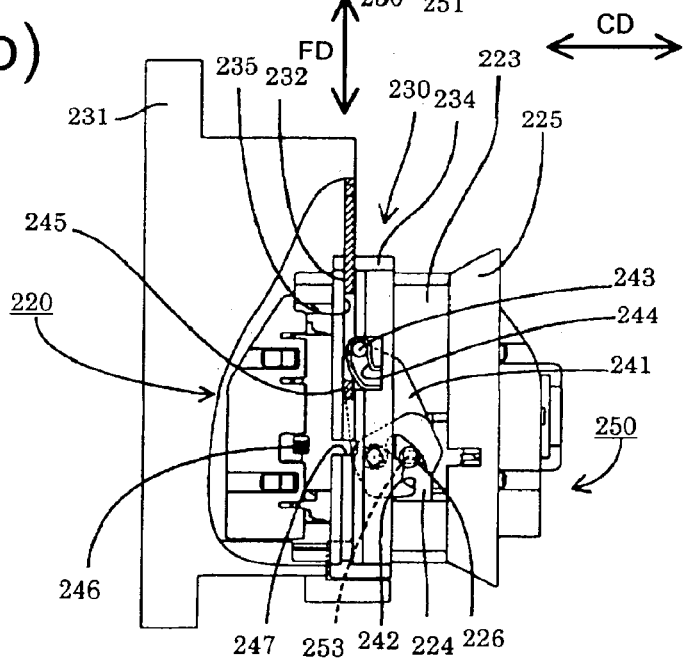

The cam followers 253 of the female connector 250 are united with the cam followers 226 of the moving plate 224, and the female connector 250 pushes the male connector 220. The cam action generated as the levers 241 are rotated pulls the female connector 250 and the moving plate 224 to the back side of the receptacle 223 while the male connector 220 is moved back with respect to the floating member 234, whereby the connection progresses. The backward movement of male connector 220 along the connecting direction with respect to the floating member 234 causes the projections 246 of the male connector 220 to move back from their positions below the receiving portions 245 as shown in FIG. 23(*b*). In this way, the restriction on the upward floating movement of the male connector 220 and the floating member 234 with respect to the module M and the holder 231 is canceled. Thus, the floating member 234 can be moved up along the floating direction FD to a maximum height where the upper end of the floating member 234 contacts the upper edge of the opening 233 of the holder 231.

The module M is slid down with respect to the two connectors 220, 250 in a direction intersecting the connecting direction CD (see arrow in FIG. 23(*a*)), when the two connectors 220, 250 reach their properly connected state. This sliding movement engages the module M lockingly with an unillustrated bracket on the body B. At this time, a moving distance of the module M and the holder 231 with respect to the two connectors 220, 250 and the floating member 234 is a maximum distance Sc within a floatable range. In this state, the upper edge of the opening 233 of the holder 231 contacts the upper end of the floating member 234 and the receiving portions 245 are below the projections 246, as shown in FIG. 24.

Thereafter, the module M moves horizontally forward substantially along the connecting direction CD without changing its height (see arrow in FIG. 24(*a*)). Accordingly, the floating member 234 moves forward with respect to the two connectors 220, 250 while the levers 241 are rotated to the state shown in FIG. 25. In this way, the assembling of the module M with the body B and the connection of the two connectors 220, 250 are completed.

As described above, the floating mechanism 230 supports the male connector 220 for displacement with respect to the module M in a floating direction FD that intersects the connecting direction CD of the two connectors 220, 250. This floating mechanism 230 includes the restricting means 240 for restricting the relative displacement of the male connector 220 with respect to the module M with the two connectors 220, 250 unconnected and canceling the restriction on the displacement of the male connector 220 after the connection of the two connectors 220, 250 is started.

The restricting means 240 ensures that only a small displacement can be generated between the male connector 220 and the module M with the two connectors 220, 250 unconnected. Therefore, the guiding portion 225 for correcting the displacement can be smaller.

The restriction by the restricting means 240 is canceled after the connection of the two connectors 220, 250 is started. Thus, the male connector 220 can be displaced maximally with respect to the module M in the floating mechanism 230. Accordingly, the module M can be slid a large distance with respect to the body B in the floating direction FD, which intersects the connecting direction CD of the two connectors 220, 250. This large sliding distance of the module M with respect to the body B ensures a large area of engagement of the bracket on the body B and the module M.

The above-described embodiment achieves a large floating distance between the module M and the male connector 220 in the floating mechanism 230 to correct displacement between the two connectors 220, 250 without enlarging the guiding portion 225.

Figure 29:
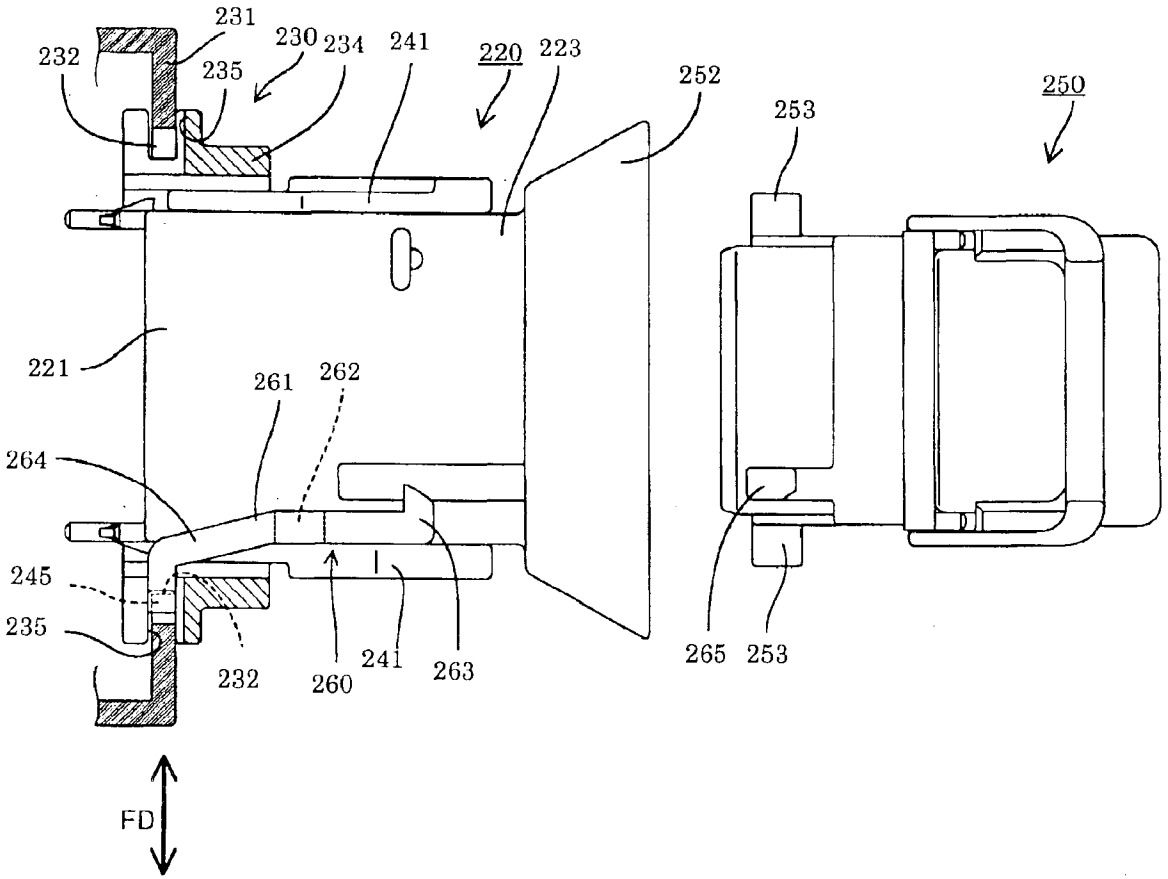
FIG. 29 is a bottom view partly in section showing a state where a floating movement of the male connector with the male and female connector unconnected in a fourth embodiment of the invention.

A fourth embodiment of the invention is described with reference to FIGS. 29 and 30. In this embodiment, a restricting means 260 has a construction different from the third embodiment, but the other elements are similar to or the same as in the third embodiment. Elements with a similar structure, function and effect as the third embodiment are not described again, but rather merely are identified by the same reference numerals.

The restricting means 260 of the fourth embodiment is comprised of an arm 261 on the bottom surface of the male connector 220 and a disengaging projection 265 on the bottom surface of the female connector 250. The arm 261 includes a support 262 supported on the bottom surface of the male connector 220 and a lock 263 that extends forward from the support 262. A contact 264 extends back from the support 262, and is resiliently displaceable like a seesaw in a horizontal plane about the support 262.

The rear end of the contact 264 of the arm 261 is below and near the receiving portion 245 of the holder 231 when the connectors 220, 250 are unconnected. Thus, upward movements along the floating direction FD of the floating member 234 and the male connector 220 with respect to the module M and the holder 231 are restricted.

Figure 30:
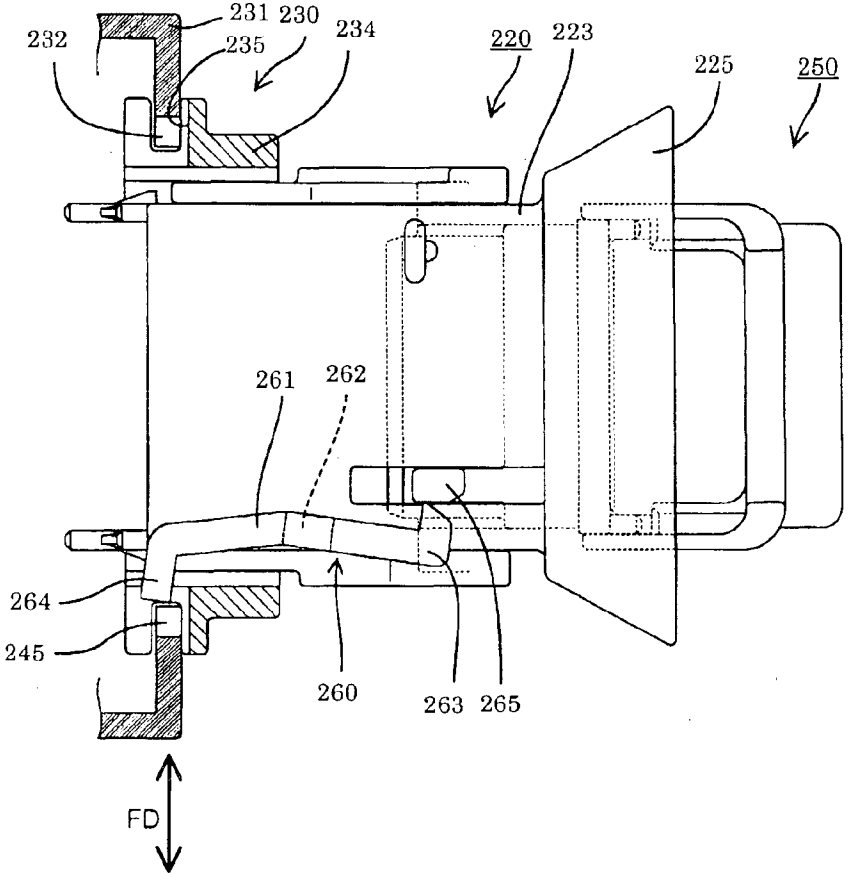
FIG. 30 is a bottom view partly in section showing a state where the male and female connectors are connected and the restriction on the floating movement of the male connector is canceled.

The disengaging projection 265 of the female connector 250 contacts the lock 263 of the arm 261 when the connection of the connectors 220, 250 is started to displace the arm 261 substantially horizontally, as shown in FIG. 30. Additionally, the leading end of the contact 264 moves back from the position below and near the receiving portion 245 as the arm 261 is displaced. Thus, the restriction on the movements of the floating member 234 and the male connector 220 with respect to the module M and the holder 231 is canceled.

Figure 42:
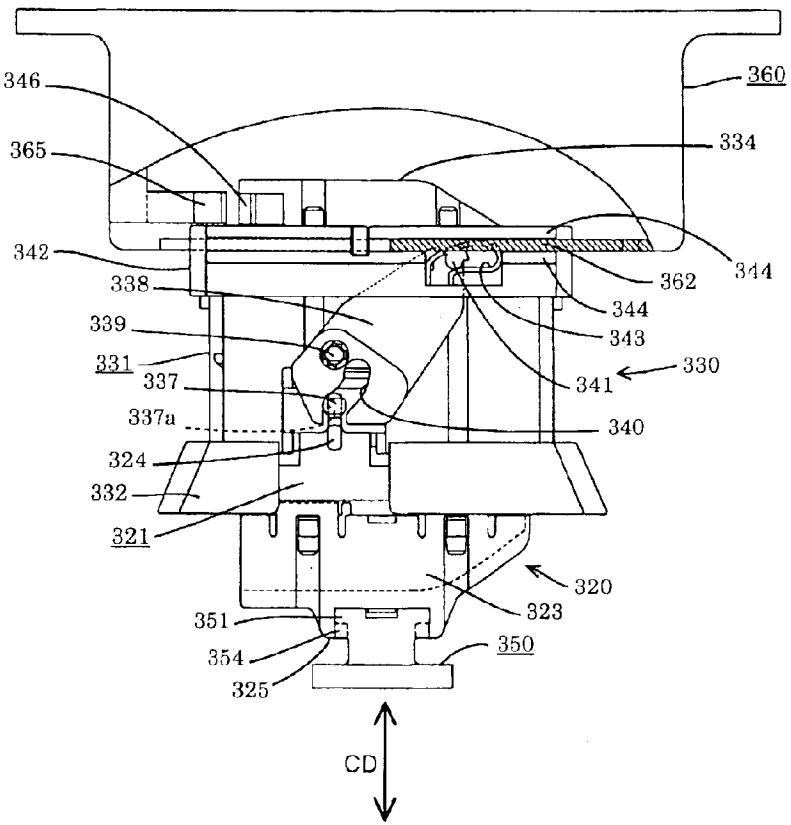
FIG. 42 is a front view partly in section showing a state where, the connection of the movable connector with the waiting-side connector is started.
Figure 43:
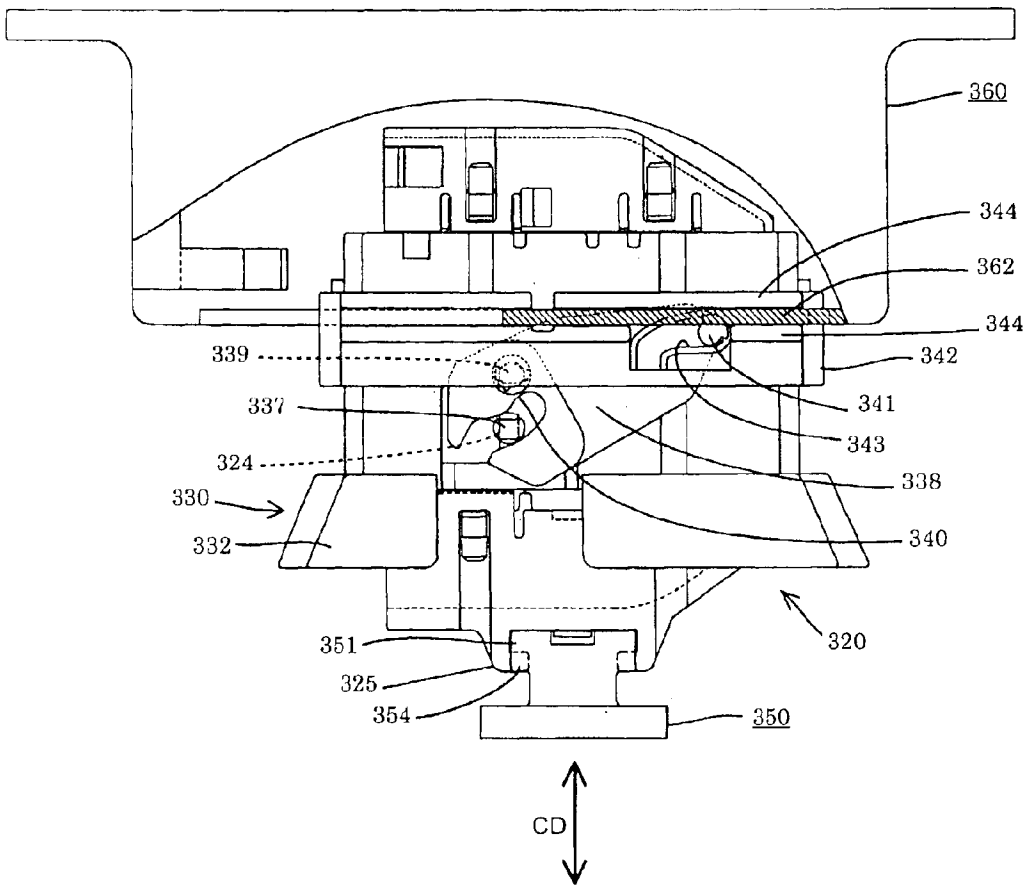
FIG. 43 is a front view partly in section showing a state during the connection of the movable connector and the waiting-side connector.
Figure 44:
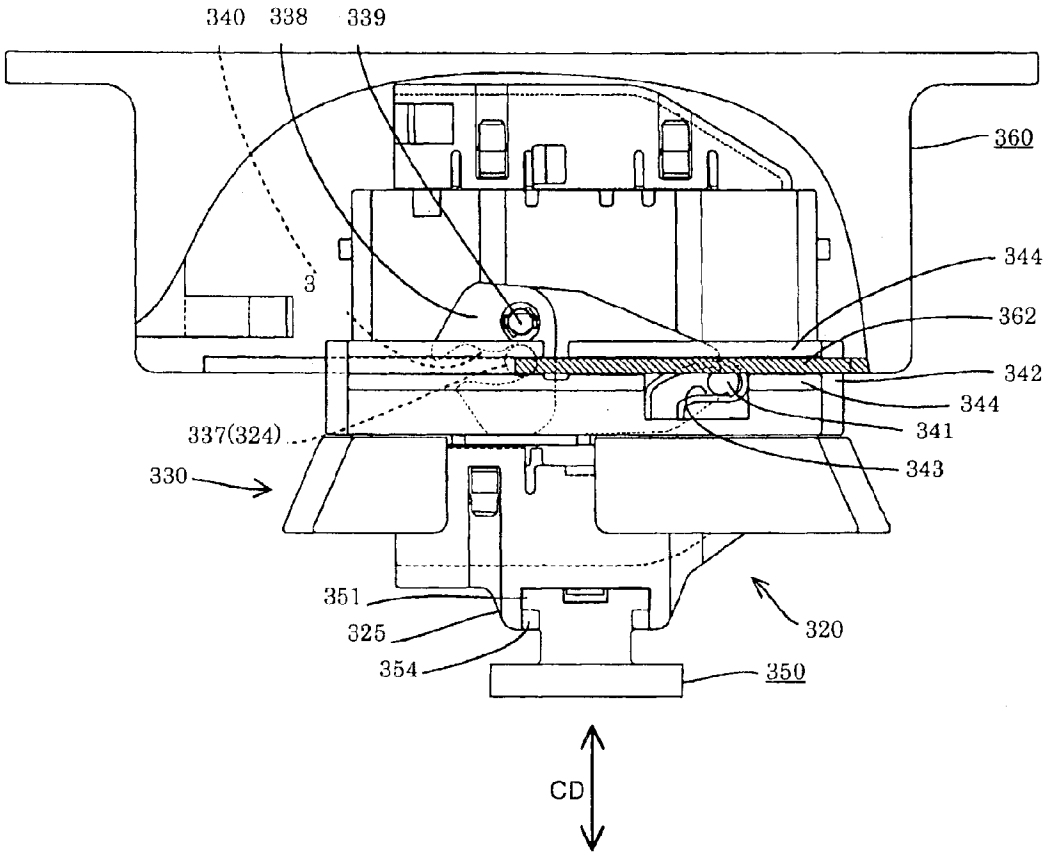
FIG. 44 is a front view partly in section showing a state where the connection of the movable connector and the waiting-side connector is completed.
Figure 45:
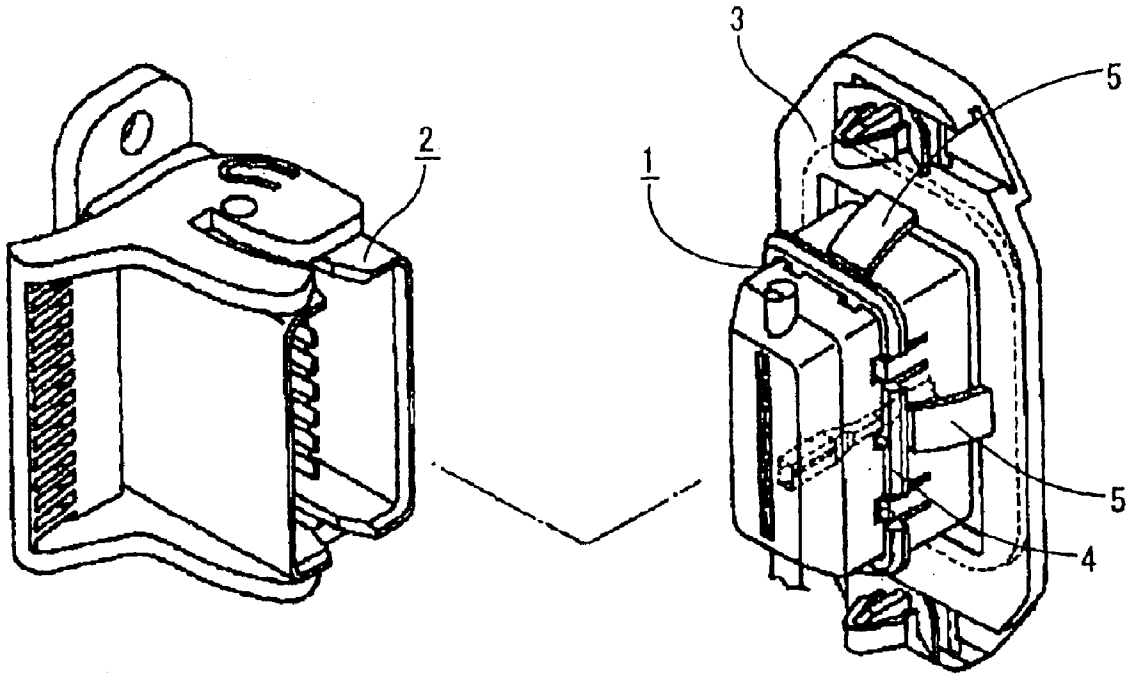
FIG. 45 PRIOR ART
FIG. 45 is a perspective view of a prior art connector connecting construction.

A fifth embodiment of the invention is described with reference to FIGS. 31 to 44. In this embodiment, a movable connector 330 is connected with a waiting-side connector 320. The movable connector 330 is mounted on a module "m", such as an instrument panel, and the waiting-side connector 320 is mounted on the body "b" of an automotive vehicle. In the following description, directions substantially normal to a connection direction CD of the movable connector 330 and the waiting-side connector 320 (right and left sides in FIGS. 32, 34, 36 and 39) are referred to as the front and rear sides concerning forward and backward directions FBD. Additionally, reference is made to FIGS. 33, 35, 37, 38 and 40 concerning the transverse direction TD, which is substantially normal to the connecting direction CD and/or to the forward and backward directions FBD. Further, all figures, excluding FIG. 38, illustrate a correction substantially parallel to the connecting direction CD. It should be noted that a bracket 350 on the body "b" is not shown in FIGS. 42 to 44.

Figure 41A:
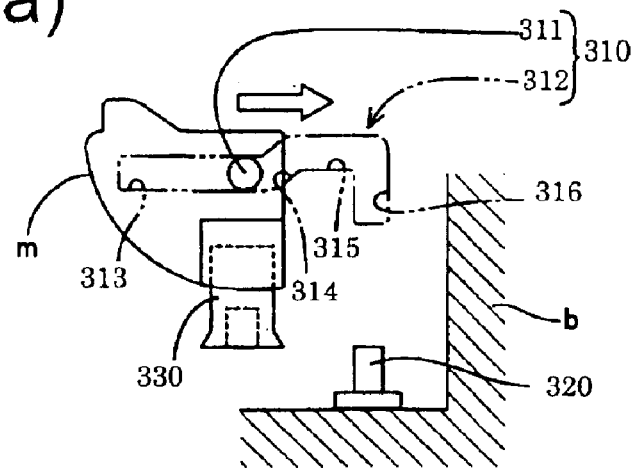
FIG. 41(*a*) is a schematic side view showing a state the module and the movable connector are located behind the waiting-side connector, FIG. 41(*b*) is a schematic side view showing a state where the movable connector is located right above the waiting-side connector, and FIG. 41(*c*) is a schematic side view showing a state where the movable connector is connected with the waiting-side connector as the module is lowered.
Figure 41B:
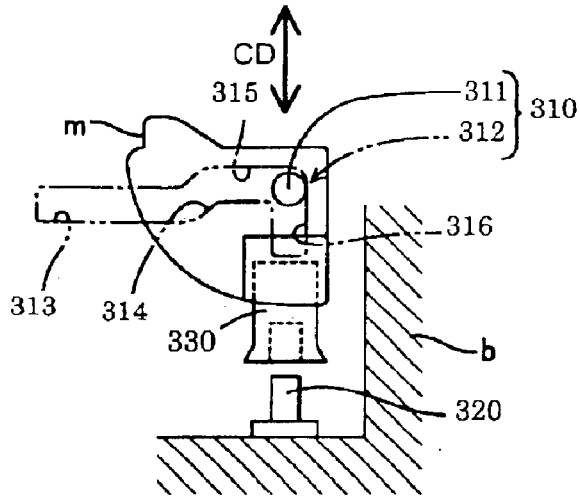
Figure 41C:
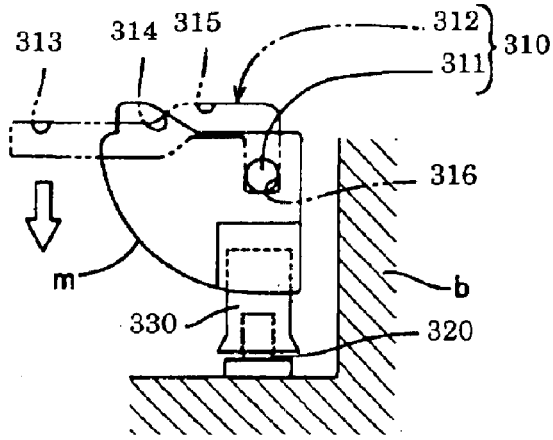

The module "m" is guided substantially horizontally forward by a guiding means 310 for assembly with the body "b", as shown in FIG. 41. The guiding means 310 includes guidable portions 311 provided on the left and right surfaces of the module "m" and guide rails 312 on an unillustrated assembly line for the module "m". Each guide rail 312 has a substantially straight rear guiding portion 313 that extends substantially horizontally forward and backward. A slanted guiding portion 314 extends obliquely up to the front from the front end of the horizontal rear guiding portion 313. A substantially horizontal front guiding portion 315 extends substantially straight forward from the front end of the slanted guiding portion 314, and a guiding portion 316 extends down substantially normal to the horizontal front guiding portion 315 substantially along the connecting direction CD, from the front end of the front horizontal guiding portion 315. The guidable portions 311 fit into the corresponding guide rails 312 so that the module "m" and the movable connector 330 are movable substantially forward along the guide rails 312 in response to a manual pushing force by an operator. It should be noted that the module "m" preferably is suspended by an unillustrated crane and detached from the crane or suspension means (such as a robot, etc.) after the module "m" is assembled with the body "b" and the movable connector 330 is connected with the waiting-side connector 320.

Figure 31:
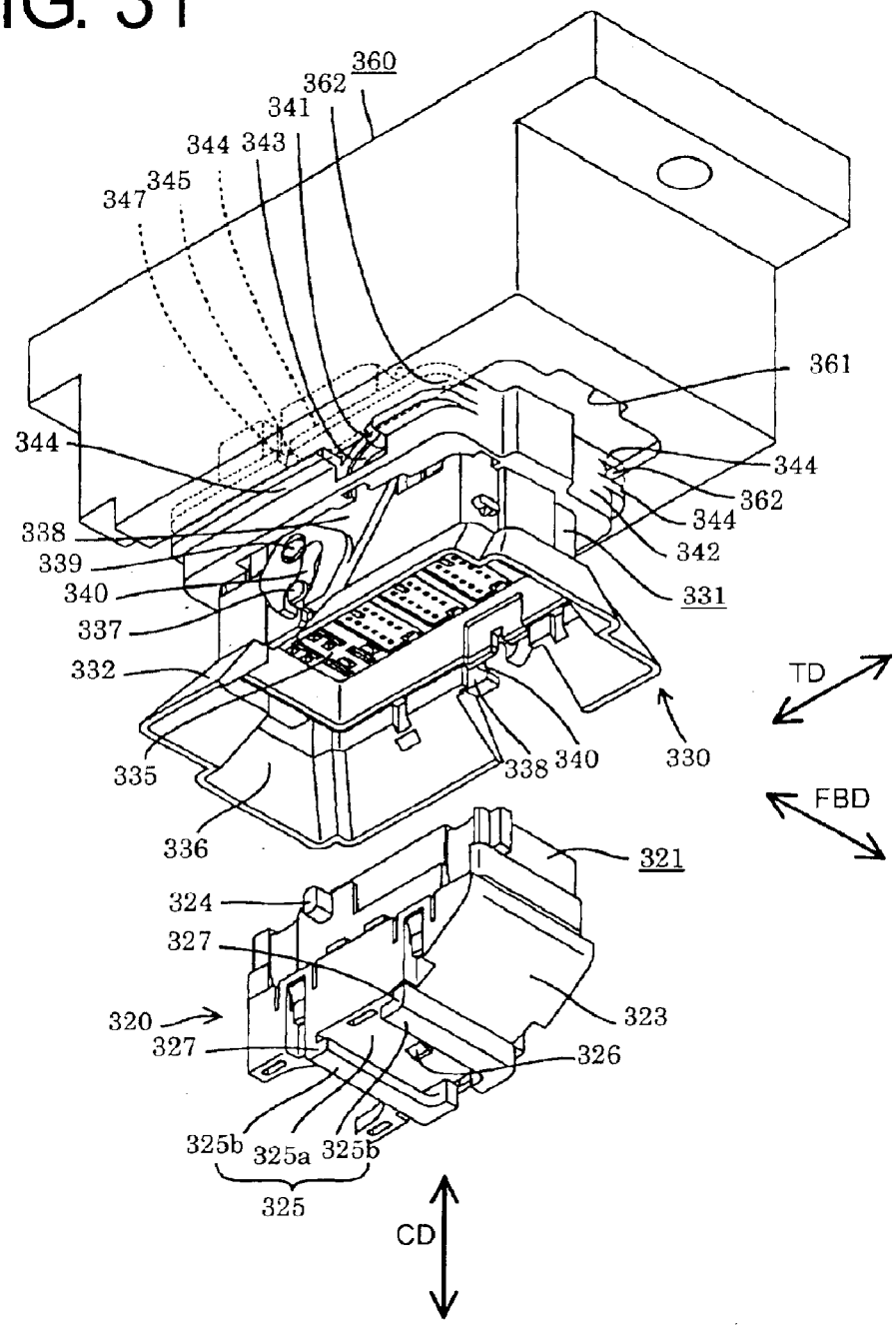
FIG. 31 is a perspective view showing a state before a waiting-side connector and a movable connector according to a fifth embodiment of the invention are connected.
Figure 32:
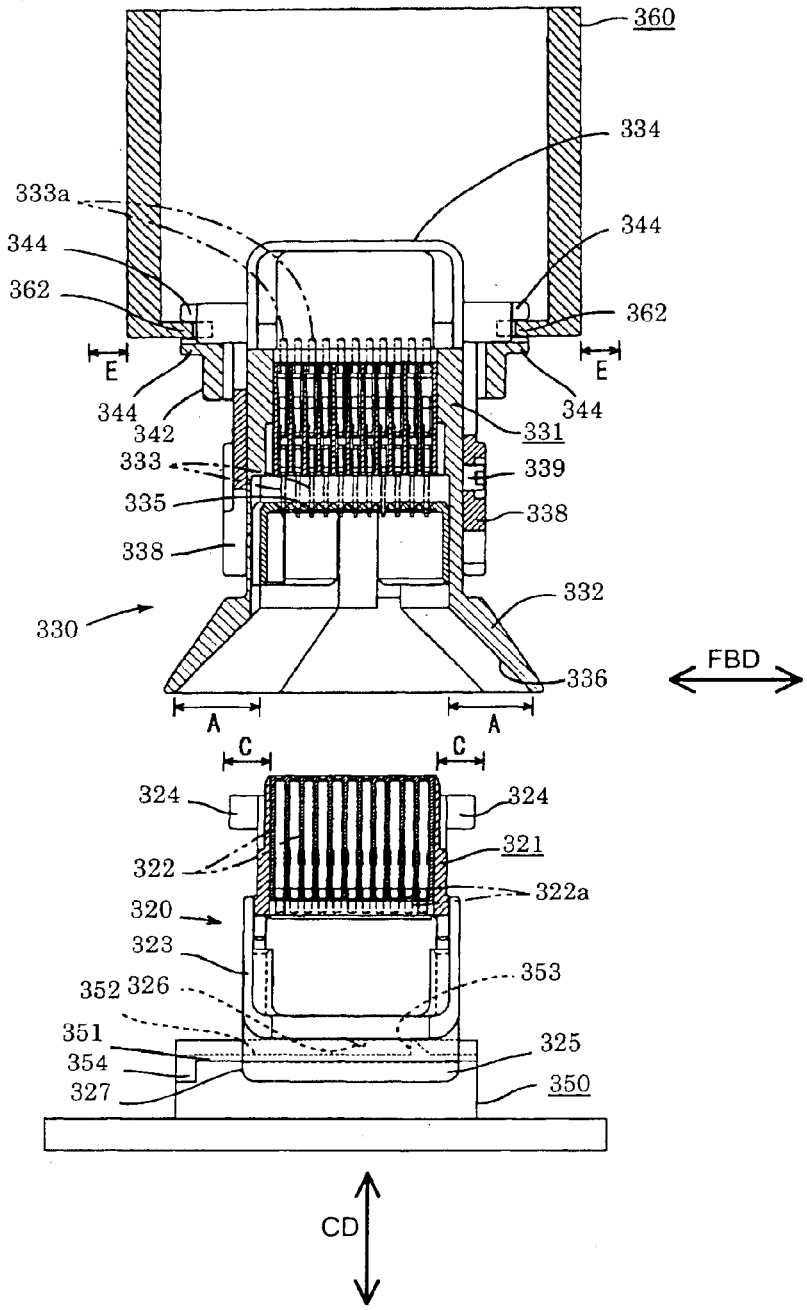
FIG. 32 is a horizontal section showing the state where the two connectors are connected.
Figure 33:
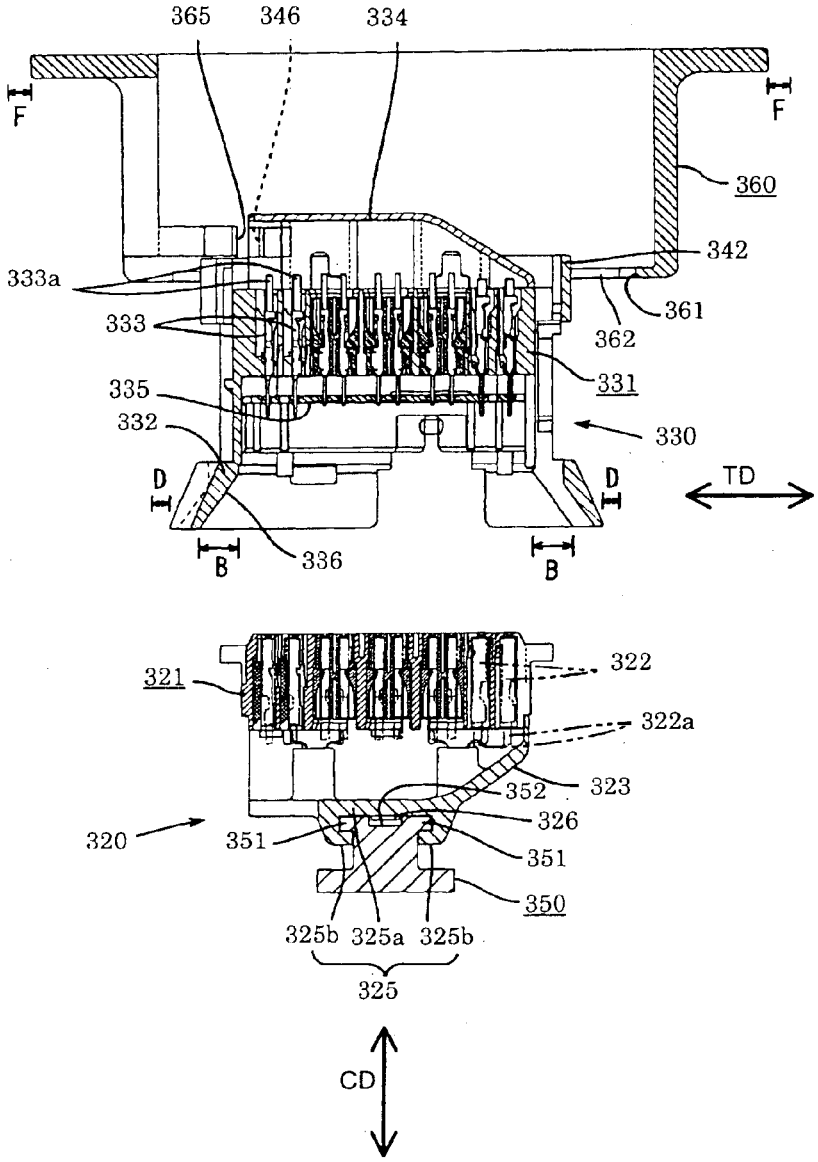
FIG. 33 is a vertical section showing the state where the two connectors are connected.
Figure 34:
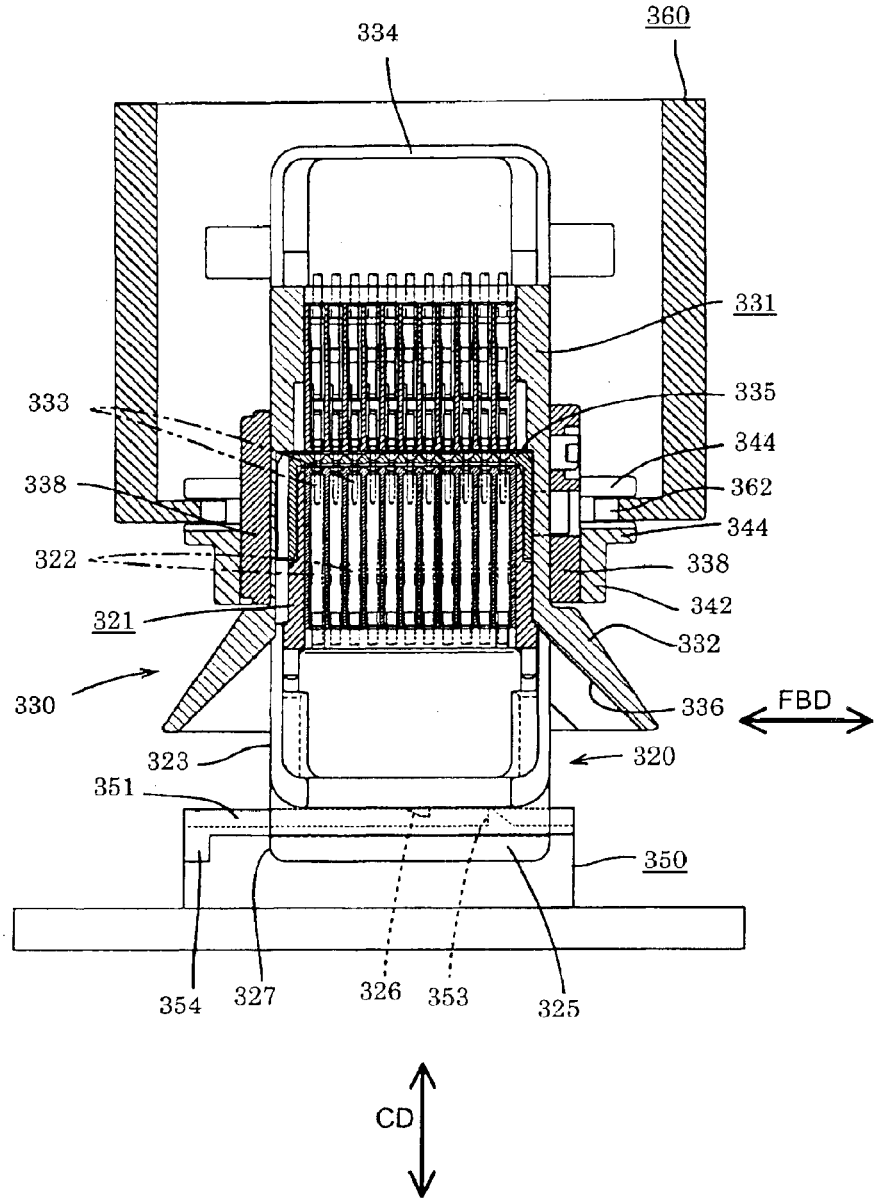
FIG. 34 is a horizontal section showing a state where the two connectors are properly connected.
Figure 35:
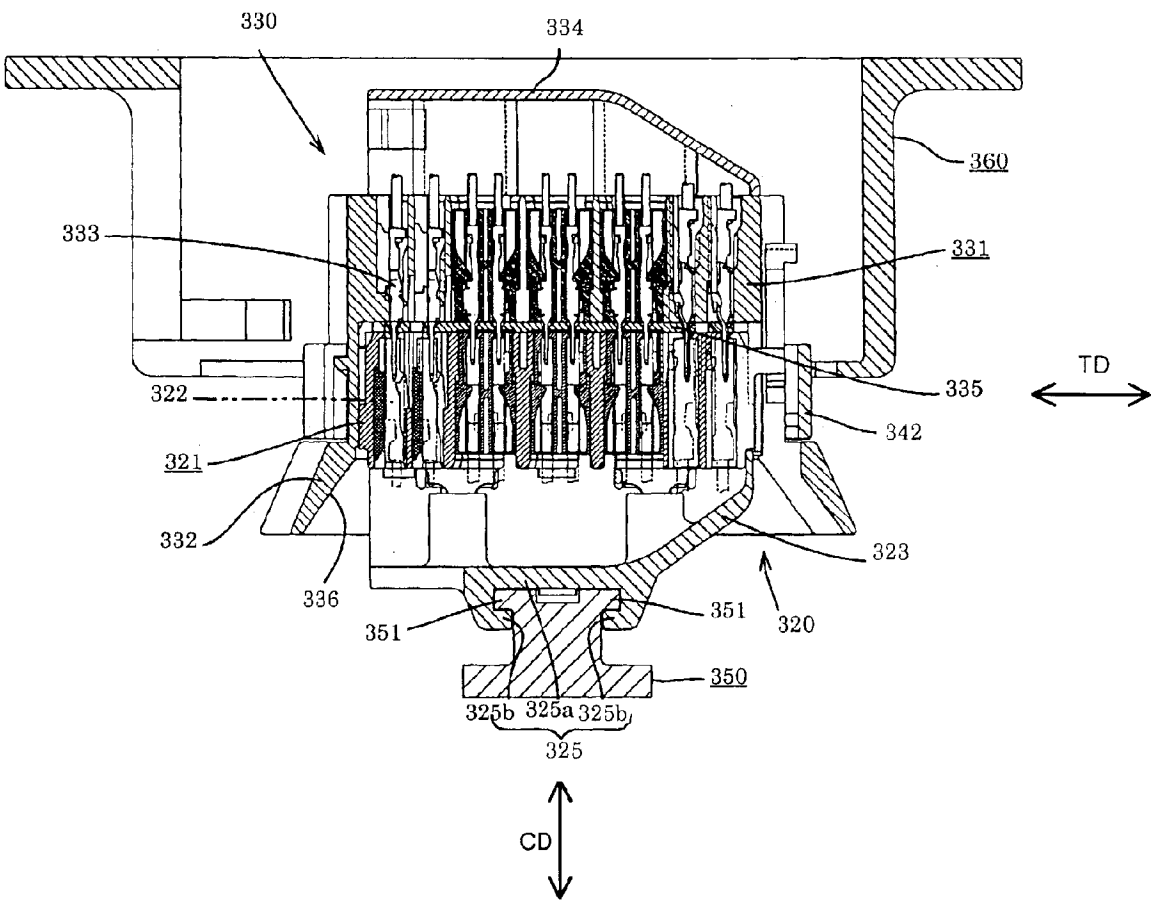
FIG. 35 is a vertical section showing the state where the two connectors are properly connected.

The waiting-side connector 320 is a female connector, and has a block-shaped housing 321 that is wide in a transverse direction TD, as shown in FIGS. 31 to 33. A wire cover 323 is mounted on the bottom surface of the housing 321. Female terminal fittings 322 are inserted into the housing 321 substantially along the connecting direction CD, and each female terminal fitting 322 is connected with an end of a wire 322*a*. The wires 322*a* extend down from the bottom surface of the housing 321 and are drawn out horizontally from the cover 323 substantially normal to the longitudinal direction of the terminal fittings 322.

The movable connector 330 is a male connector and includes a housing 331 with a substantially rectangular receptacle that opens forward. Male terminal fittings 333 are insertable into the housing 331 from above, and a wire cover 334 is mounted on the upper surface of the housing 331. A moving plate 335 is mounted in the receptacle 332 and is movable substantially vertically along the connecting direction CD.

An upper part of the receptacle 332 is a substantially rectangular tube into which the moving plate 335 is fittable. However, a lower part of the receptacle 332*f* widens toward the bottom end to increase an opening area. The inner peripheral surface of the lower part of the receptacle 332 defines a guide surface 336 aligned oblique to the vertical connecting direction CD. Displacement between the connectors 320, 330 in directions normal to the connecting direction CD brings the peripheral edge of the upper surface of the waiting-side connector 320 into sliding contact with the guide surface 336. Thus, the two connectors 320, 330 are guided by the inclination of the guide surface 336 so that the connecting surfaces thereof are substantially right opposed to each other. Guidable areas A are defined in a plane substantially normal to the connecting direction CD and the waiting-side connector 320 can be guided in the guidable areas A by the guide surface 336, as shown in FIG. 32 with respect to forward and backward directions FBD and areas B in FIG. 33 with respect to the transverse direction TD.

Each male terminal fitting 333 is connected with an end of a wire 333*a* similar to the female terminal fitting 322. The wires 333*a* are drawn out and bent substantially normal to the longitudinal direction of the terminal fitting 333 to extend horizontally from the wire cover 334.

The moving plate 335 has a known structure with positioning holes for positioning tabs of the respective male terminal fittings 333 that project into the receptacle 332. Two cam pins 337 extend from the front and rear edges of the moving plate 335 and project out through escape grooves in the receptacle 332. A recess 337*a* is formed in the inner surface of each cam pin 337 for receiving the cam pin 324 of the waiting-side connector 320.

The movable connector 330 is mounted into a frame 342 via front and rear levers 338. The levers 338 are flat and rotatably supported on supporting shafts 339 that project from the front and rear outer surfaces of the housing 331. A cam groove 340 and a cam pin 341 are formed at the opposite ends of each lever, and the cam pin 337 of the moving plate 335 engages with the cam groove 340.

The frame 342 is substantially rectangular and surrounds the housing 331 at the front, back, right and left sides. The movable connector 330 is movable substantially vertically along the connecting direction CD, but is held in the frame 342 so as to make almost no loose horizontal movement. The frame 342 has front and rear arcuate cam grooves 343, and the cam pins 341 of the levers 338 engage with the cam grooves 343. A distance from a center of rotation (supporting shaft 339) of the lever 338 to the cam pin 341 exceeds a maximum distance from the center of rotation of the lever 338 to the cam groove 340. Thus, a cam action is displayed when the housing 331 moves substantially vertically along the connecting direction CD with respect to the frame 342. The engagement of the cam pins 341 of the levers 338 and the cam grooves 343 of the frame 342 create large moments around the centers of rotation of the levers 338. The moments create large pushing/pulling forces that act along the connecting direction CD. The pushing/pulling forces are exerted on the cam pins 337 of the moving plate 335 and the cam pins 324 of the waiting-side connector 320 due to the engagement of cam pins 337, 324 with the cam grooves 340 of the levers 338.

The movable connector 330 moves down substantially along the connecting direction CD with respect to the frame 342. Therefore, the cam pins 341 of the levers 338 get caught by the edges of the cam grooves 343 of the frame 342 when the cam pins 337, 324 of the moving plate 335 and the waiting-side connector 320 are at the entrances of the cam grooves 340 of the levers 338. As a result, further downward movement along the connecting direction CD of the movable connector 330 is prevented.

The waiting-side connector 320 is mounted on a bracket 350 fixed to the body "b" for sliding movement along the forward and backward direction FBD substantially normal to the connecting direction CD. On the other hand, the movable connector 330 is mountable on a bracket 360 fixed to the module "m" for sliding left and right horizontally substantially along the transverse direction TD. Thus, the two connectors 320, 330 are relatively displaceable in directions substantially normal to each other in a horizontal plane to correct eccentricity when the connecting surfaces of the two connectors 320, 330 are not directly opposed to each and experience a horizontal displacement.

Two guide rails 351 bulge out at the upper end of the bracket 350 fixed to the body "b", and extend substantially straight along forward and backward directions FBD. The guide rails 351 are formed over the substantially entire length of the upper part of the bracket 350 along forward and backward directions FBD, and the length of the guide rails 351 exceeds the dimension of the waiting-side connector 320 along forward and backward directions FBD.

A guidable portion 325 is on the bottom surface of the wire cover 323, and is engageable with the guide rails 351 from outside. The guidable portion 325 is comprised of a bottom wall 325*a* of the wire cover 323, and L-shaped holding portions 325*b* that project down from the left and right edges of the bottom wall 325*a*. The guidable portion 325 surrounds the guide rails 351 to support the waiting-side connector 320 for sliding movement substantially along forward and backward directions FBD. The guide rails 351 are held by the bottom wall 325*a* of the wire cover 323 and the holding portions 325*b* from upper and lower sides. Thus, vertical shaking of the waiting-side connector 320 in the connecting direction CD with respect to the bracket 350 is suppressed. Further, the bracket 350 is held from left and right sides by the inner edges of the holding portions 325*b* of the guidable portions 325. Thus, shaking of the waiting-side connector 320 in the transverse direction TD is suppressed.

The sliding structure for the waiting-side connector 320 has a restricting means for defining a slidable area of the waiting-side connector 320. More particularly, a groove 352 is formed along forward and backward directions FBD substantially in the transverse center of the upper surface of the bracket 350, and a front restricting portion 353 projects near the front end of the groove 352. Contrary to this, a front engaging portion 326 projects at a substantially transverse center of the bottom surface of the wire cover 323 and fits in the groove 352 to engage the rear surface of the front restricting portion 353. On the other hand, a rear restricting portion 354 projects down along the connecting direction CD at the rear end of each guide rail 351 for engaging the rear edge of the corresponding holding portion 325*b*. The rear edge of each holding portion 325*b* serves as a rear engaging portion 327.

Figure 36A:
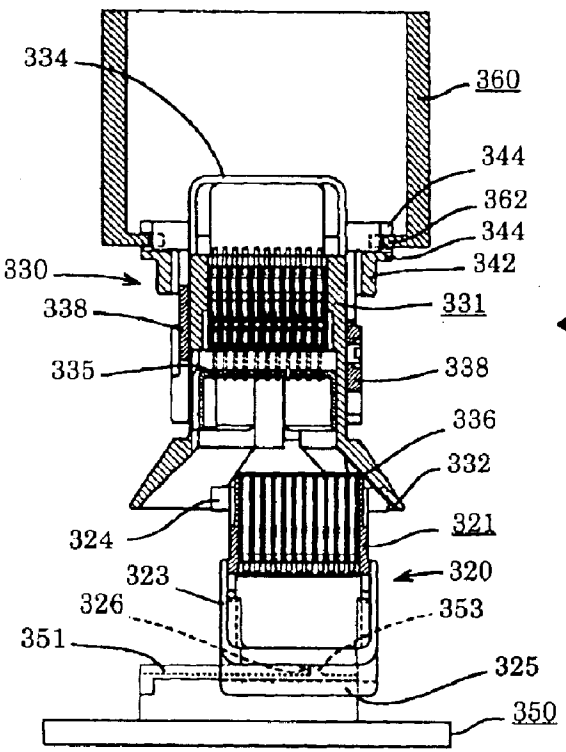
FIGS. 36(*a*) and 36(*b*) are horizontal sections showing a state where the waiting-side connector is located at a front most position and a state where it is located at a rearmost position, respectively.
Figure 36B:
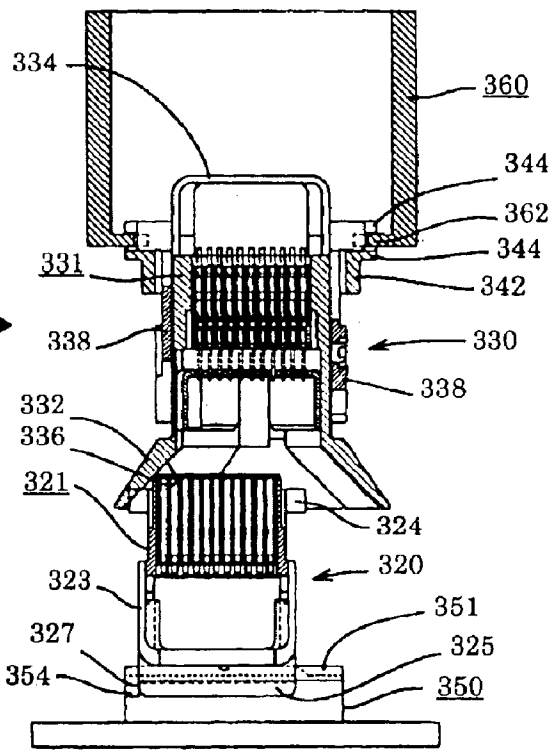

The slidable area of the waiting-side connector 320 along forward and backward directions FBD is from a front most position (see FIG. 36(*a*)), where the front surface of the front engaging portion 326 engages the rear surface of the front restricting portion 353, to a rearmost position (see FIG. 36(*b*)), where the rear engaging portion 327 engages the front surface of the rear restricting portion 354, as indicated by C in FIG. 32. Here, the guidable area A along forward and backward directions FBD is substantially equal to or larger than a sum of the slidable area C and an assembling displacing area (E in FIG. 32) along forward and backward directions FBD which occurs upon assembling the module "m" with the body "b".

An opening 361 is formed at the bottom end of the bracket 360 fixed to the module "m" and opens at the upper, lower and left sides. The front and rear edges of the opening 361 define guide rails 362 that extend substantially straight along the transverse direction TD. The transverse dimension of the guide rails 362 is longer than the movable connector 330.

Upper and lower guidable portions 344 project from each of the front and rear outer surfaces of the frame 342 and define a clearance into which the corresponding guide rail 362 can fit. The guidable portions 344 extend substantially straight in the transverse direction TD and have substantially the same length as the entire length of the frame 342. The guide rails 362 are held between the upper and lower guidable portions 344 so that the guidable portions 344 support the movable connector 330 for transverse sliding. The guidable portions 344 hold the guide rails 362 from upper and lower sides. Thus, the frame 342 and the movable connector 330 will not shake vertically along the connecting direction CD with respect to the bracket 360. Further, the frame 342 is held by the inner edges of the guide rails 362 from front and back sides. Thus, the frame 342 and the movable connector 330 will not shake along forward and backward directions FBD with respect to the bracket 360.

The sliding structure for the movable connector 330 also has a restricting means for defining a slidable area. More particularly, right engaging portions 345 project substantially in the transverse centers of the front and rear outer surfaces of the wire cover 334, as shown in FIG. 38. A cut is made in forward and backward directions FBD over more than one third of, and most preferably about half, the length of each guide rail 362 and opens to the left, thereby forming a notch 363 for receiving the right engaging portion 345. The right edge of the notch 363 defines a right restricting portion 364 for engaging the right surface of the corresponding right engaging portion 345. On the other hand, left engaging portions 346 project at the left ends of the front and rear outer surfaces of the wire cover 334. Contrary to this, two left restricting portions 365 are cantilevered at the left end of the opening 361 of the bracket 360 and are engageable with the left surfaces of the corresponding left engaging portions 346. The left restricting portions 365 are resiliently displaceable substantially along forward and backward directions FBD. Each upper guidable portion 344 is formed with an engaging recess 347 that is engageable with the corresponding right engaging portion 345 before the connectors 320, 330 are connected. The right engaging portions 345 disengage from the engaging recesses 347 and the notches 363 when the movable connector 330 is moved up along the connecting direction CD with respect to the frame 342 during connection with the waiting-side connector 320. Thus, the restriction on the transverse movement of the movable connector 330 with respect to the frame 342 and the bracket 360 is canceled.

Figure 37A:
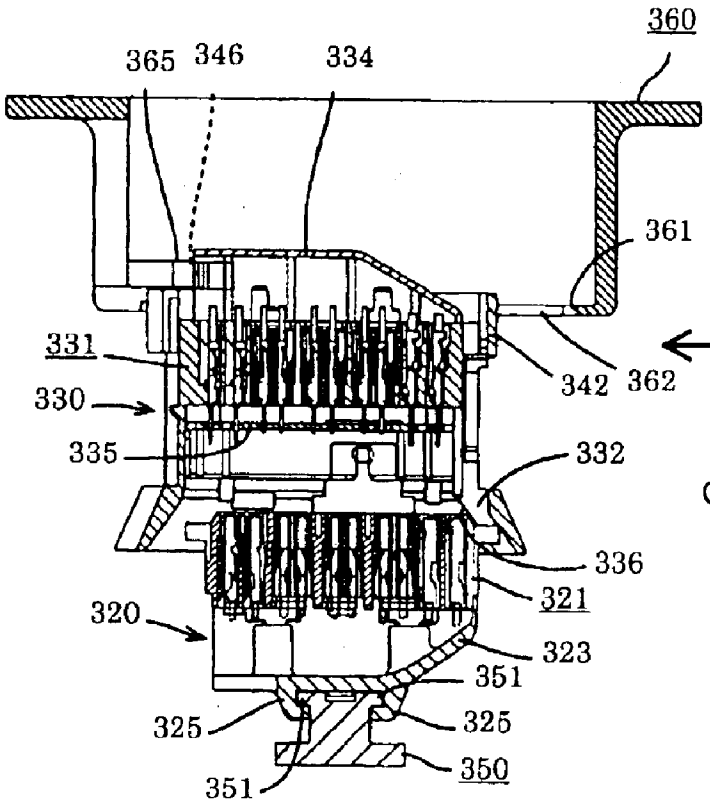
FIGS. 37(*a*) and 37(*b*) are vertical sections showing a state where the movable connector is located at a leftmost position and a state where it is at a rightmost position, respectively.
Figure 37B:
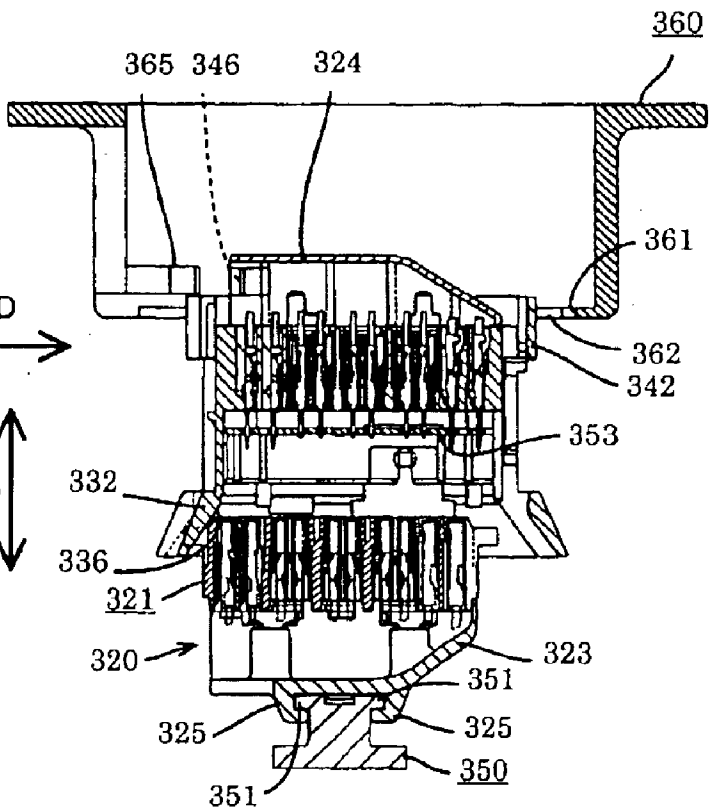
Figure 38A:
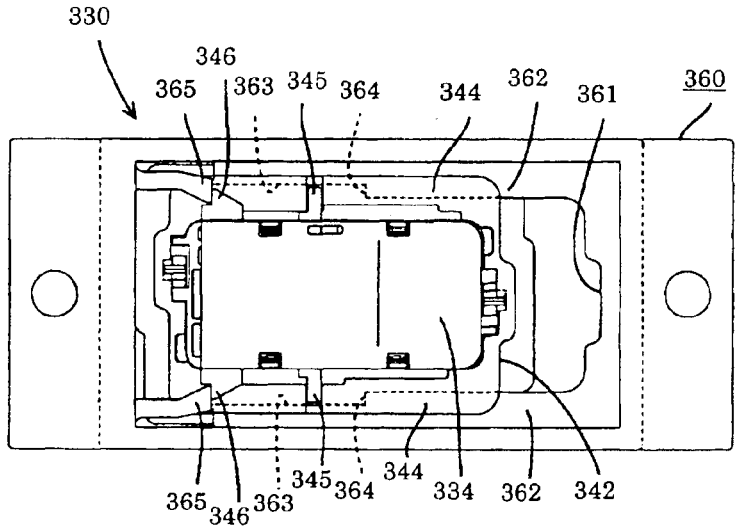
FIGS. 38(*a*) and 38(*b*) show the movable connector at the leftmost position and at a rightmost position, respectively.
Figure 38B:
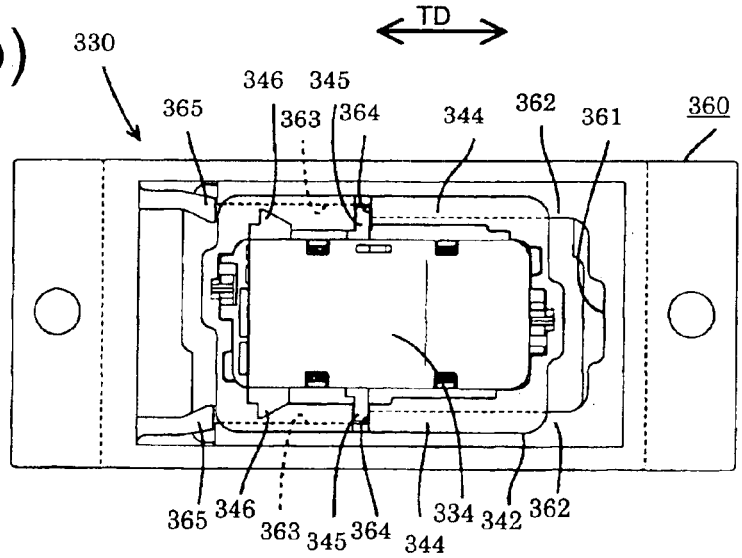

A slidable area of the movable connector 330 along the transverse direction TD is from a leftmost position (see FIGS. 37(*a*) and 38(*a*)), where the left surfaces of the left engaging portions 346 engage the right surfaces of the left restricting portions 365, to a rightmost position (see FIGS. 37(*b*) and 38(*b*)), where the right surfaces of the right engaging portions 345 engage the right restricting portions 364 as indicated by D in FIG. 33. Here, the guidable area B along transverse direction TD is substantially equal to or larger than a sum of the slidable area D and an assembling displacing area F in FIG. 33 along the transverse direction during assembling the module "m" with the body "b".

Assembly of the movable connector 330 starts by inserting the male terminal fittings 333 into the housing 331 and then mounting the wire cover 334 on the housing 331. The movable connector 330 then is moved down along the connecting direction CD with respect to the frame 342. As a result, the cam pins 337 of the moving plate 335 are brought to the entrances of the cam grooves 340 of the levers 338. In this state, an attempt is made to move the frame 342 transversely together with the movable connector 330 from the left side. Thus, the frame 342 fits into the opening 361 of the bracket 360 of the module "m". A rightward sliding movement then is guided by the sliding contact of the guidable portions 344 with the guide rails 362 from upper and lower sides. The right engaging portions 345 enter the notches 363 to face the right restricting portions 364, and the left engaging portions 346 cause the left restricting portions 365 to be displaced up or down and then to be restored resiliently. As a result, the left restricting portions 365 face the left restricting portions 365 from the right. In this way, the movable connector 330 is supported slidably along the transverse direction TD within the slidable area D shown in FIG. 33 and with the connecting surface thereof faced down.

Assembly of the waiting-side connector 320 starts by inserting the female terminal fittings 322 into the housing 321 and then mounting the wire cover 323 on the housing 321. The waiting-side connector 320 then is mounted into the bracket 350 of the body "b" from the front. Assembly proceeds by bringing the guidable portion 325 into sliding contact with the guide rails 351 to hold the guide rails 351 from upper and lower sides and guiding a backward sliding movement. Thus, the rear engaging portions 327 face the rear restricting portions 354. Additionally, the front engaging portions 326 fit into the grooves 352 and move over the front restricting portions 353 to face the front restricting portions 353 from behind. In this way, the waiting-side connector 320 is supported slidably along forward and backward directions FBD within the slidable area C shown in FIG. 32 with the connecting surface thereof faced up or toward the movable connector 330.

The connectors 320, 330 are connected by pushing the module "m" forward toward the body "b" with the guidable portions 11 of the module "m" engaged with the rear horizontal guiding portions 13 of the guide rails 12. The module "m" moves forward along the rear horizontal guiding portions 13 from a position behind the waiting-side connector 320 as shown in FIG. 41(*a*). The module "m" then moves obliquely up and away from the waiting-side connector 320 to the front along the slanted guiding portions 14 and then moves substantially in the forward and backward direction FBD along the substantially horizontal front guiding portions 15. The movable connector 330 is substantially right above and facing the waiting-side connector 320 along the connecting direction CD when the guidable portions 11 reach the front ends of the substantially horizontal front guiding portions 15 (see FIG. 41(*b*)). Immediately thereafter, the module "m" moves down in the connecting direction CD along the guiding portions 16 by the action of gravity (see FIG. 41(*c*)). The movable connector 330 is connected with the waiting-side connector 320 as the module "m" moves down along the connecting direction C.

The two connectors 320, 330 are connected by moving the movable connector 330 down along the connecting direction CD from the state shown in FIGS. 32 and 33 so that the receptacle 332 approaches the waiting-side connector 320 from above and along the connecting direction CD. The cam pins 324 of the waiting-side connector 320 unite with the cam pins 337 of the moving plate 335 when the receptacle 332 starts being fitted to the waiting-side connector 320 (see FIGS. 42 and 43). Thereafter, the movable connector 330 is displaced up substantially along the connecting direction CD with respect to the frame 342 upon the action of a connection resistance between the two connectors 320, 330. The cam grooves 343 of the frame 342 engage the cam pins 341 of the levers 338 and rotate the levers 338 to pull the movable connector 330 and the frame 342 down toward the waiting-side connector 320. The connectors 320, 330 and the module "m" are moved horizontally forward together with respect to the body "b" after the connectors 320, 330 reach their properly connected state (see FIGS. 34, 35 and 44). This movement brings the module "m" to a properly assembled position with respect to the body "b". The guidable portion 325 is slid along the guide rails 351 of the bracket 350 of the body "b" as the connectors 320, 330 and the module "m" move forward.

The two connectors 320, 330 may be displaced and located at any position within the slidable areas C, D shown in FIGS. 36 and 37. However, their positions are still within the guidable areas A, B. Accordingly, the waiting-side connector 320 enters the receptacle 323 and the outer peripheral edge of the top of the housing 321 is brought into sliding contact with the guide surface 336. Thus, the two connectors 320, 330 slide horizontally along the guide rails 351, 362 to be aligned substantially automatically and corrected to a proper position where the connecting surfaces thereof are opposed to each other.

Figure 39B:
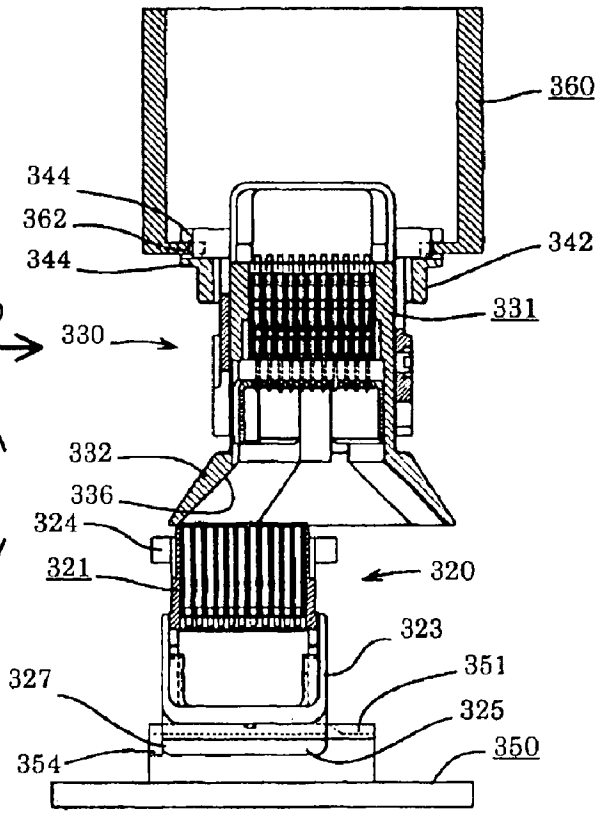
FIGS. 39(*a*) and 39(*b*) are horizontal sections showing a state where a module is maximally displaced backward and the waiting-side connector is located at the front most position and a state where the module is maximally displaced forward and the waiting-side connector is located at the rearmost position, respectively.
Figure 39A:
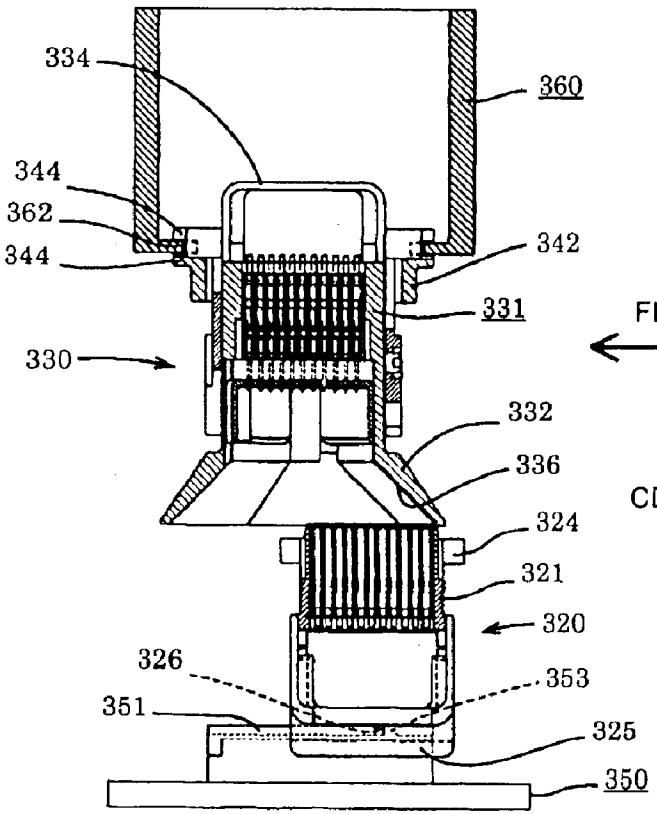
Figures 40A, 40B:
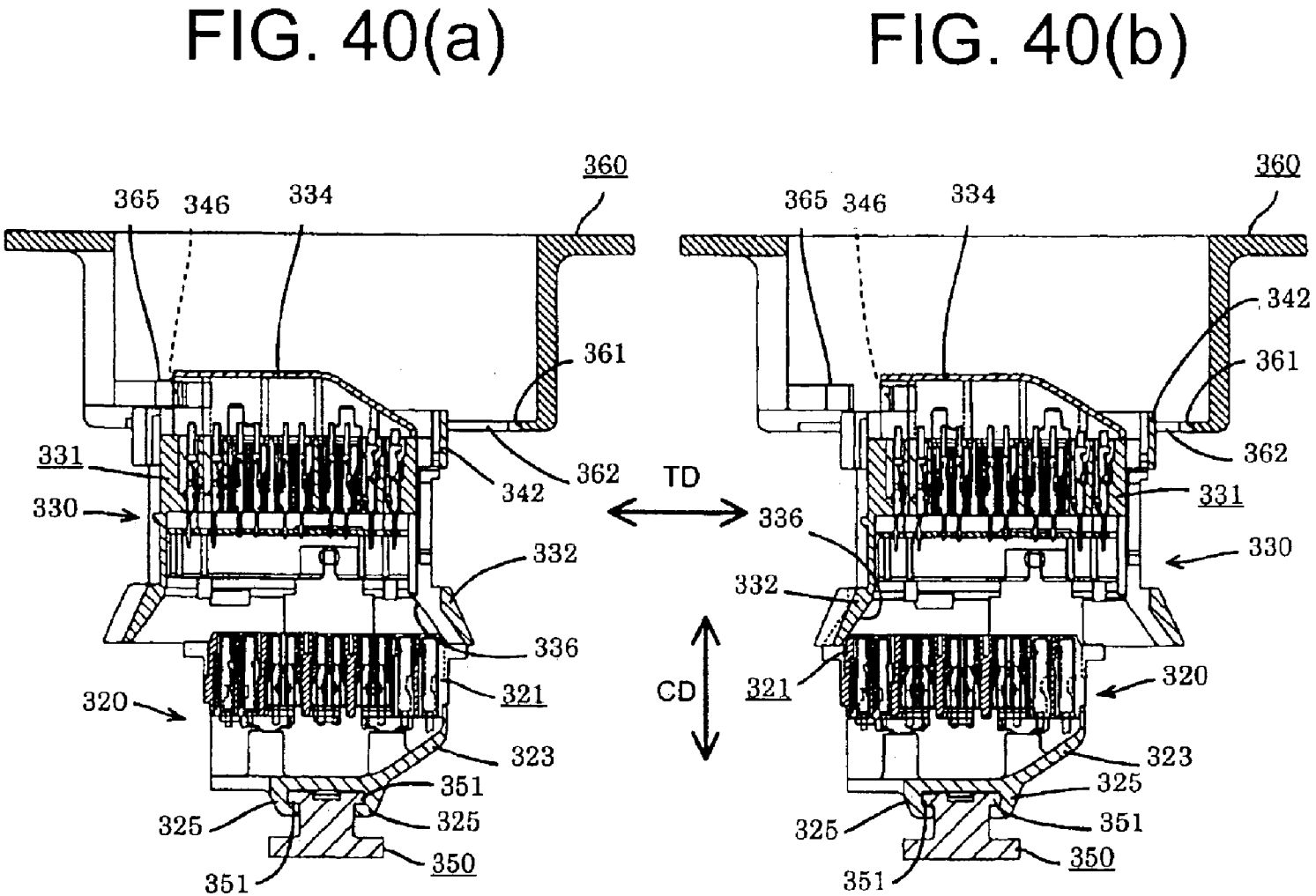
FIGS. 40(*a*) and 40(*b*) are vertical sections showing a state where a module is maximally displaced rightward and the movable connector is at the leftmost position and a state where the module is maximally displaced leftward and the movable connector is located at the rightmost position, respectively.

The module "m" and the body "b" may be displaced horizontally from each other in a direction intersecting the connecting direction CD within a range of an assembling tolerance when the module "m" is moved down along the connecting direction CD with respect to the body "b". For example, the module "m" may be displaced maximally backward (FIG. 39(*a*)) or forward (FIG. 39(*b*)) with respect to the body "b" and the waiting-side connector 320 may be at a front most position (FIG. 39(*a*)) or a rearmost position (FIG. 39(*b*)) in the slidable area C as shown in FIG. 39. However, the guidable area A is substantially equal to or larger than the sum of the assembling displacement area E and the slidable area C, as described above. Therefore, the waiting-side connector 320 is brought into sliding contact with the guide surface 336 of the movable connector 330. On the other hand, the module "m" may be displaced maximally rightward (FIG. 40(*a*)) or leftward (FIG. 40(*b*)) with respect to the body "b" and the waiting-side connector 320 may be at a leftmost position (FIG. 40(*a*)) or a rightmost position (FIG. 40(*b*)) in the slidable area D, as shown in FIG. 40. However, the guidable area B is substantially equal to or larger than the sum of the assembling displacement area F and the slidable area D. Therefore, the waiting-side connector 320 is brought into sliding contact with the guide surface 336. In this way, the two connectors 320, 330 can be aligned and connected properly even if the module "m" and the body "b" are displaced to place the connectors 320, 330 at eccentric positions while assembling the module "m" with the body "b".

As described above, the connectors 320, 330 can be aligned properly by sliding the waiting-side connector 320 along the guide rails 351. Thus, unlike the prior art, it is not necessary to deform resilient supporting pieces and a force necessary for the connection is small. In addition, the movable connector 330 is slid along the guide rails 362 in a direction substantially normal to the sliding direction of the waiting-side connector 320 for achieving alignment. Accordingly, the two connectors 320, 330 can be aligned more precisely, and connection resistance can be reduced to further improve operational efficiency.

Further, the guide rails 351, 362 are held by the guidable portions 325, 344 from upper and lower sides in both the waiting-side connector 320 and the movable connector 330. Thus, the waiting-side connector 320 and the movable connector 330 can be slid without vertically shaking.

Furthermore, the restricting means restrict the slidable areas C, D of the waiting-side connector 320 and the movable connector 330 within the guidable areas A, B by the guide surface 336. Thus, the waiting-side connector 320 and the movable connector 330 are within the guidable areas A, B regardless of the positions in the respective slidable areas C, D. Therefore, the waiting-side connector 320 can be brought into sliding contact with the guide surface 336 in the connecting process for achieving alignment with the movable connector 330.

Further, the movable connector 330 is connected with the waiting-side connector 320 as the module "m" is displaced down along the connecting direction CD. Thus, the weight of the module "m" assists connection of the connectors 320, 330, and an operator easily can move the module "m" manually even if connection resistance is large.

The invention is not limited to the above described and illustrated embodiments. For example, the following embodiments are also are embraced by the technical scope of the invention as defined by the claims. Beside the following embodiments, various changes can be made without departing from the scope and spirit of the invention as defined by the claims.

The module-side connector is a male connector and the body-side connector is a female connector in the foregoing embodiments. However, the module-side connector may be a female connector and the body-side connector may be a male connector according to the invention.

The mounting portion is formed by ribs extending substantially along the rear surface of the wire cover in the first embodiment. However, the mounting portion may project vertically from the rear surface of the wire cover.

The connector is movable only vertically in the first embodiment. However, the connector may be movable both vertically and transversely according to the invention. In such a case, the frame of the first embodiment may be supported on a separate frame and may be constructed to move transversely with respect to the separate frame.

The floating mechanism is only in the module-side connector in certain embodiments. However the floating mechanism may be only in the body-side connector or both in the module-side connector and the body-side connector. In the case of a floating mechanism both in the module-side connector and the body-side connector, a function of taking up displacements can be extended if the moving directions of both connectors are normal to each other (e.g. one connector is moved in transverse direction and the other connector is moved in vertical direction in the case of horizontally connecting the two connectors).

The guiding means is rib-shaped in the first embodiment. However, the guiding means may be groove-shaped and the guidable portions of the housing may be movably engaged with the groove-shaped guiding means.

Although the guidable portions are bent to form an X-shape in the first embodiment, they may be convexly curved toward each other.

Pressing portions contact the base ends of the outward-displacement restricting portions in the second embodiment. However, they may contact the leading ends of the outward-displacement restricting portions.

The connecting direction CD of the connectors is substantially horizontal in certain embodiments. However, it may be substantially vertical or any other orientation. In this case, the module is slid substantially horizontally after the start of the connection of the connectors.

The module is slid down after the start of the connection of the connectors with the connecting direction substantially horizontal in certain embodiments. However, the sliding direction may be substantially horizontal and may intersect the connector connecting direction. For example, if the connector connecting direction CD is along forward and backward directions, the module may be slid in a transverse direction.

Although the connectors are connected using levers in the foregoing embodiments, the levers may not be used according to the present invention.

The displaceable range of the connector is made narrower than the maximum displacement range by the restricting means in the foregoing embodiments. However, the connector may be fixed immovably by the restricting means according to the present invention.

Although the movable connector is mounted slidably on the bracket fixed to the module in the foregoing embodiment, it may be fixed immovably according to the present invention. Further, the movable connector may be singly connected with the waiting-side connector without being mounted on the module according to the present invention.

Although the guide rails are substantially straight in the certain embodiments, they may be curved according to the present invention. Further, the substantially straight guide rails may extend in an oblique direction intersecting with the connecting direction CD according to the present invention.

In the foregoing embodiment, the guide rails are provided at the frames of the waiting-side connector and the movable connector and the guidable portions are provided at the brackets. Conversely, the guide rails may be provided at the brackets and the guidable portions may be provided at the connectors. Further, the restricting portions may be on the connectors and the respective engaging portions may be on the brackets.

The guidable portions hold the guide rails from the front and back with respect to the connecting direction CD in the fifth embodiment. However, they need not have such shapes and can take any desired shape. Further, in the waiting-side connector, the guidable portion may also be provided, for example, at the front and rear surfaces of the wire cover in addition to the rear surface of the wire cover.

Although the two connectors are connected as the module is displaced downward in the foregoing embodiment, they may be connected, for example, as the module is displaced forward according to the present invention.

Although the connector is provided with the moving plate and the levers in the foregoing embodiment, the present invention is also applicable connectors having none of these.

In the foregoing embodiment, the movable connector is a male connector and the waiting-side connector is a female connector. Conversely, the movable connector may be a female connector and the waiting-side connector may be a male connector.

What is claimed is:

1. A connector assembling construction for connecting a first connector on a module and a second connector on a body along a connecting direction as the module is assembled with the body in an automotive vehicle, comprising:

a floating mechanism to support at least one of the first and second connectors for displacement in a floating direction intersecting the connector connecting direction; and the floating mechanism comprising restricting means for restricting a displacement of the connector that is supported on the floating mechanism when the connectors are unconnected and canceling the restriction on displacement of the connector that is supported on the floating mechanism after connection of the first and second connectors is started, the restricting means comprising contacts on the floating mechanism and on the connector that is supported on the floating mechanism for contacting one another when the first and second connectors are unconnected and thereby restricting movement of the connector that is supported on the floating connector in the floating direction and relative to the floating mechanism, the contacts on the floating mechanism and on the connector that is supported on the floating mechanism being disengaged as the connection of the connectors progresses so that the connector that is supported on the floating mechanism can displace in the floating direction relative to the floating mechanism.

2. The connector assembling construction of claim 1, wherein the first connector has a receptacle into which the second connector is fittable, a guiding portion for correcting displacement between the connectors being formed at an opening edge portion of the receptacle.

3. The connector assembling construction of claims 2, wherein the floating mechanism comprises a guide rail on at least one of the module and the body and extending along the floating direction, and a floating member movable substantially along the guide rail while supporting the connector.

4. The connector assembling construction of claim 3, wherein the restricting means comprises a displacing means for relatively displacing the connector substantially in the connecting direction with respect to the floating member as the connection of the first and second connectors progresses.

5. A connector connecting construction for connecting a movable connector with a waiting-side connector to be mounted on a fixed member, wherein one of the waiting-side connector and the fixed member comprises a guide rail extending substantially straight in a direction substantially normal to a connecting direction and slidably supporting the respective connector substantially along an extending direction of the guide rail, the movable connector being mounted on an assembling member to be assembled with the fixed member, the two connectors being connected as the assembling member is assembled with the fixed member, one of the movable connector and the assembling member comprising a second supporting member extending in a direction intersecting the connecting direction and substantially normal to a sliding direction of the waiting-side connector and slidably supporting the movable connector along an extending direction thereof, and a guidable portion slidable along the guide rail and holding the guide rail from front and back sides with respect to the connecting direction.

6. The connector connecting construction of claim 5, wherein one of the connectors includes a receptacle into which the other of the connectors is fittable, the receptacle having a guide surface for guiding the connectors into substantial alignment, and a restricting means to restrict a slidable area of at least one of the connectors permitted by the respective supporting member within a guidable area by the guide surface of the receptacle.

7. The connector connecting construction of claim 5, wherein the waiting-side connector is mounted on the fixed member with a connecting surface thereof faced up, the movable connector is mounted on the assembling member with a connecting surface faced down, and the movable connector is connected with the waiting-side connector by displacing the assembling member substantially downward with respect to the fixed member.

* * * * *